US010480113B2

(12) United States Patent
Favaro et al.

(10) Patent No.: US 10,480,113 B2
(45) Date of Patent: Nov. 19, 2019

(54) METHOD FOR OPERATING A LAUNDRY WASHING MACHINE USING A UNIT DOSE PACKAGE AND LAUNDRY WASHING MACHINE

(71) Applicant: Electrolux Appliances Aktiebolag, Stockholm (SE)

(72) Inventors: Daniele Favaro, Venice (IT); Maurizio Del Pos, Pordenone (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 159 days.

(21) Appl. No.: 15/537,902

(22) PCT Filed: Dec. 23, 2014

(86) PCT No.: PCT/EP2014/079129
§ 371 (c)(1),
(2) Date: Jun. 20, 2017

(87) PCT Pub. No.: WO2016/101994
PCT Pub. Date: Jun. 30, 2016

(65) Prior Publication Data

US 2017/0350060 A1 Dec. 7, 2017

(51) Int. Cl.
*D06F 39/02* (2006.01)

(52) U.S. Cl.
CPC ..... *D06F 39/02* (2013.01); *D06F 39/028* (2013.01)

(58) Field of Classification Search
CPC ..... D06F 39/02; D06F 39/028
See application file for complete search history.

(56) References Cited

U.S. PATENT DOCUMENTS 5,884,506 A * 3/1999 Blauert ..... D06F 39/088 68/17 R
2004/0200245 A1 10/2004 Cheo et al.
2005/0166645 A1* 8/2005 Favret ..... D06F 39/02 68/12.18
2005/0229652 A1* 10/2005 Kim ..... D06F 39/02 68/237

(Continued)

FOREIGN PATENT DOCUMENTS

DE 19537671 A1 4/1997
EP 1126070 A1 8/2001

(Continued)

OTHER PUBLICATIONS

International Search Report dated Mar. 23, 2015 in corresponding International Application No. PCT/EP2014/079129.

(Continued)

*Primary Examiner* — Joseph L. Perrin
(74) *Attorney, Agent, or Firm* — RatnerPrestia

(57) ABSTRACT

A laundry washing machine has a treating agents dispenser (20) provided with one or more compartments (23 *a*). One of the compartment is suited to receive a unit dose package (DP) comprising a pre-measured amount of treating agent (D) incorporated into a water-soluble pouch (P). The treating agents dispenser (20) comprises a water conveying line having at least one nozzle (41, 42, 43) for generating at least one water jet (51, 52, 53) which hits and breaks the unit dose package (DP) inside the compartment (23*a*).

37 Claims, 31 Drawing Sheets

(56) References Cited

U.S. PATENT DOCUMENTS

| | | | | |
|---|---|---|---|---|
| 2005/0241072 | A1* | 11/2005 | Kim | B08B 3/04 8/158 |
| 2005/0274156 | A1* | 12/2005 | Yang | D06F 39/028 68/17 R |
| 2007/0163307 | A1* | 7/2007 | Kramme | D06F 39/02 68/17 R |
| 2009/0119849 | A1* | 5/2009 | Hill | D06F 39/02 8/158 |
| 2011/0247147 | A1* | 10/2011 | Amos | D06F 39/028 8/137 |
| 2012/0060568 | A1* | 3/2012 | Buso | D06F 39/02 68/17 R |
| 2012/0067089 | A1* | 3/2012 | Buso | D06F 39/02 68/17 R |
| 2014/0157835 | A1* | 6/2014 | Del Pos | D06F 39/007 68/17 R |
| 2015/0345069 | A1* | 12/2015 | Leibman | D06F 39/022 68/17 R |
| 2016/0047077 | A1* | 2/2016 | Leibman | D06F 39/028 68/17 R |

FOREIGN PATENT DOCUMENTS

| | | | |
|---|---|---|---|
| EP | 2241669 | A1 | 10/2010 |
| WO | 2005061685 | A1 | 7/2005 |

OTHER PUBLICATIONS

International Search Report dated Mar. 9, 2015 in related International Application No. PCT/EP2014/079176.

* cited by examiner

METHOD FOR OPERATING A LAUNDRY WASHING MACHINE USING A UNIT DOSE PACKAGE AND LAUNDRY WASHING MACHINE

The present invention concerns the field of laundry washing techniques.

In particular, the present invention relates to a method for operating a laundry washing machine using a unit dose package, more particularly a unit dose detergent.

The invention relates also to the laundry washing machine.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing, or cabinet, provided with a washing tub which contains a rotatable perforated drum where the laundry is placed. A loading/unloading door ensures access to the drum.

Laundry washing machines typically comprise a water supply unit and a products supply unit, or dispenser, for the introduction of water and treating agents (i.e. detergent, softener, rinse conditioner, etc.) into the tub.

Applicant has performed a plurality of washing cycles using a unit dose package which are inserted into the drum together with the laundry at the beginning of the cycle. The unit dose package comprises a pre-measured amount of treating agent incorporated into a water-soluble pouch, wherein the treating agent includes detergent. Hereinafter we will indicate said unit dose package simply with the term "pod".

The use of pods, nevertheless, revealed some drawbacks.

A drawback posed by the use of pods lies in that the pod may easily remain trapped in the middle of the load, between clothing, determining a residual undissolved detergent into the fabric at the end of cycle, thus creating undesired spots or stains on the laundry.

Another drawback posed by the use of pods is due to the presence of undissolved product of the pod, inside the laundry washing machine, at the end of the washing cycle. In particular, residual product may be found inside the bellows connecting the tub to the external casing. Due to the movement of the drum, the pod may move inside the bellows which is typically S-shaped. The pod may remain inside the bellows for the whole cycle. Part of the detergent dose is therefore not used during the laundry washing cycle and the cleaning effect is negatively affected.

A further drawback posed by said undissolved residual product, for example residual detergent trapped inside the bellows, is that it may successively come into contact with the laundry in a rinsing phase of the laundry washing cycle, for example due to the movement of the drum which causes the residual detergent leaving the bellows. The presence of a quantity of residual detergent during a rinsing phase may cause insufficient rinsing. Insufficient rinsing, in turn, can leave detergent in laundry to affect people with allergies or sensitivity.

A further drawback posed by use of pods is due to the possibility that the pod inserted in the drum breaks down, or its pouch dissolves, before the washing cycle begins. In such situation, the detergent may fall down on the bottom of the tub. In case the washing cycle starts with a draining phase, which is typically performed for safety and/or hygienic reasons at the very beginning of the cycle, the detergent from the bottom of the tub is drained to the outside. The washing cycle then could even be carried out without use of detergent.

Another drawback posed by use of pods is due to the possibility that the washing cycle begins after a delay time with respect to the time of insertion of the pod inside the drum, for example in laundry washing machines with time delay option. Time delay allows the user to load the washing machine with pod and start it later. The pod inserted in the drum may break down, or its pouch may dissolve, before the washing cycle begins. This may create undesired spots or stains on the laundry.

Furthermore, due to the pod breakage, the detergent may fall down on the bottom of the tub. As already explained above, in case the washing cycle starts with a draining phase, the detergent from the bottom of the tub is drained to the outside. The washing cycle then could even be carried out without use of detergent.

Another drawback posed by the use of pods is due to the indeterminateness of the effective time of breakage of the pod and therefore the effective time of release of the detergent contained therein. In fact, it is not possible to predict the exact time of breakage of the pod and hence the exact time when the detergent is being distributed over the laundry.

This indeterminateness negatively affects the performance/efficiency of the washing cycle selected by the user since every washing cycle is typically optimized on the base of the time period during which the detergent is in contact with the laundry and performs its cleaning effect.

SUMMARY OF SELECTED INVENTIVE ASPECTS

An object of the present invention is therefore to overcome the drawbacks posed by the known techniques.

It is an object of the invention to provide a laundry washing machine and method for operating the laundry washing machine using a unit dose product which guarantees the use of the product without residual on the laundry.

It is another object of the invention to provide a laundry washing machine and a method for operating a laundry washing machine using a unit dose product which limits the risk of undesired spots or stains on the laundry.

It is a further object of the invention to provide a laundry washing machine and a method for operating a laundry washing machine using a unit dose product which guarantees the use of all the product contained therein.

It is another object of the invention to provide a laundry washing machine and a method for operating a laundry washing machine using a unit dose product which avoids its drainage to the outside at the beginning of the washing cycle.

The applicant has found that by providing a laundry washing machine having a treating agents dispenser comprising one or more compartments wherein one of the compartment is suited to receive a unit dose package comprising a pre-measured amount of treating agent incorporated into a water-soluble pouch and by providing the treating agents dispenser with a water conveying line having at least one nozzle for generating at least one water jet which hits and breaks the unit dose package inside the compartment, it is possible to overcome drawbacks of known techniques.

Furthermore, the applicant has found that by providing a method for operating a laundry washing machine using a unit dose package comprising a pre-measured amount of treating agent incorporated into a water-soluble pouch wherein the method comprises a step of introducing the unit dose package into a compartment of a treating agents dispenser of the laundry washing machine and wherein the method comprises a step of breaking the water-soluble pouch of the unit dose package inside the compartment, it is possible to overcome drawbacks of known techniques.

In a first aspect the present invention relates, therefore, to a laundry washing machine comprising:

- a cabinet supporting a washing drum adapted to receive laundry and a washing tub external to said washing drum;
- a treating agents dispenser comprising one or more compartments adapted to be filled with at least one treating agent, said treating agents dispenser being provided with one or more water conveying lines for conveying water to said one or more compartments;
- a supply line, fluidly connecting said treating agents dispenser and said washing tub;
- a control unit for controlling functioning of said laundry washing machine;
- an interface unit by means of which the user may select and/or set parameters;

wherein at least a first one of said one or more compartments is suited to receive a unit dose package comprising a pre-measured amount of treating agent incorporated into a water-soluble pouch and wherein at least a first one of said one or more water conveying lines comprises at least one nozzle for generating at least one water jet into said first compartment so that said at least one water jet hits said unit dose package and breaks said water-soluble pouch.

Preferably, said at least one water jet is a laminar-flow water jet.

The laminar-flow water jet is, preferably, a flow which substantially maintains its shape (or cross section) throughout its extension.

In a preferred embodiment of the invention, said at least one nozzle generates at least one water jet directed towards a predefined zone inside the first compartment which is suited for receiving the unit dose package and/or generates at least one water jet directed towards a predefined portion of a bottom side of the first compartment.

Preferably, said at least one nozzle comprises a first portion and a second terminal portion arranged downstream from the first portion, wherein the first portion has a shape which narrows down from a larger cross section to a smaller cross section and wherein the second terminal portion has a constant, or substantially constant, cross section.

The first portion of the nozzle increases the speed of water flowing therethrough and the second terminal portion advantageously defines the direction of the water jet.

Preferably, the first portion is conical shaped and second terminal portion is cylindrically shaped More preferably, the first portion and the second terminal portion of said at least one nozzle generates the laminar-flow water jet.

According to a preferred embodiment of the invention, the first water conveying line is connectable to a water source through a controllable valve and wherein the first water conveying line comprises a water tight path fluidly connecting the controllable valve and said at least one nozzle.

In a preferred embodiment of the invention, the first water conveying line is connectable to a water source through a controllable valve and wherein the first water conveying line does not comprise any air-break in the path from the controllable valve to said at least one nozzle.

Preferably, the first water conveying line comprises exclusively one or more of said at least one nozzle for generating said at least one water jet, wherein said at least one nozzle generates at least one water jet directed towards a predefined zone inside the first compartment which is suited for receiving the unit dose package and/or generates at least one water jet directed towards a predefined portion of a bottom side of the first compartment.

In a preferred embodiment of the invention, the first water conveying line comprises exclusively one or more nozzles of said at least one nozzle for generating said at least one water jet, wherein the first water conveying line does not include any other water outlets in addition to said one or more nozzles.

According to a preferred embodiment of the invention, the first water conveying line further comprises at least one outlet suitable for conveying water into the first compartment in addition to said at least one nozzle.

Preferably, said at least one outlet is arranged so that the water is directed towards a lateral side wall of the first compartment.

According to a preferred embodiment of the invention, at least a second one of said one or more water conveying lines comprises at least one outlet for conveying water into the first compartment, the second water conveying line being fluidly separated from the first water conveying line.

Preferably, the first water conveying line is connectable to a water source through a first controllable valve and the second water conveying line is connectable to the water source through a second controllable valve.

More preferably, said at least one outlet of the second water conveying line is arranged so that the water is directed towards a lateral side wall of the first compartment.

In a preferred embodiment of the invention, the second water conveying line comprises an air-break.

According to a preferred embodiment of the invention, the treating agents dispenser further comprises a stopping device associated to the first compartment adapted for stopping the unit dose package in a predefined zone inside the first compartment.

Preferably, the stopping device is suited to stop the unit dose package when the unit dose package is intact while it is configured to allow the passage of treating agent released from the unit dose package after breakage of the water-soluble pouch.

More preferably, the stopping device comprises at least one rib transversely arranged inside the first compartment.

According to a preferred embodiment of the invention, the treating agents dispenser is connectable to a water source through one or more controllable valves and wherein the treating agents dispenser further comprises a flow diverter arranged downstream from said one or more controllable valves for selectively and alternatively channelling the water arriving from the water source towards said one or more compartments.

According to a further preferred embodiment of the invention, the machine further comprises a water softening device for softening water to be directed to said one or more water conveying lines and/or to the washing tub.

Preferably, the water softening device comprising a water-softening agent container and a regeneration-agent reservoir fluidly connected one to the other.

The regeneration-agent reservoir is preferably fluidly connected to the water-softening agent container and is structured for receiving a regeneration agent which is able to regenerate the water softening function of the softening agent stored inside the water-softening agent container.

Preferably, the treating agents dispenser further comprises a water softening device, the water softening device comprising a water-softening agent container and a regeneration-agent reservoir fluidly connected one to the other.

In a further aspect thereof, the present invention concerns a method for operating a laundry washing machine comprising:

a cabinet supporting a washing drum adapted to receive laundry and a washing tub external to said washing drum;

a treating agents dispenser comprising one or more compartments adapted to be filled with at least one treating agent, said treating agents dispenser being provided with one or more water conveying lines for conveying water to said one or more compartments;

a supply line, fluidly connecting said treating agents dispenser and said washing tub;

a control unit for controlling functioning of said laundry washing machine;

an interface unit by means of which a user may select and/or set parameters; wherein said method comprises the steps of:

introducing a unit dose package comprising a pre-measured amount of treating agent incorporated into a water-soluble pouch into a first one of said one or more compartments which is suited to receive said unit dose package;

conveying water to said first compartment from a first one of said one or more water conveying lines for generating at least one water jet into said first compartment so that said at least one water jet hits said unit dose package and breaks said water-soluble pouch so as to release said pre-measured amount of treating agent.

Preferably, the step of introducing a unit dose package into the first compartment is manually performed by the user.

Preferably, the step of conveying water to the first compartment from one of the water conveying lines is controlled by the control unit.

More preferably, said step of generating at least one water jet includes a step of generating at least one laminar-flow water jet.

The laminar-flow water jet is, preferably, a flow which substantially maintains its shape (or cross section) throughout its extension.

In a preferred embodiment of the invention, the step of generating at least one water jet into the first compartment comprises directing said at least one water jet towards a predefined zone inside the first compartment which is suited for receiving the unit dose package and/or directing said at least one water jet towards a predefined portion of a bottom side of the first compartment.

According to a preferred embodiment of the invention, the method comprises a step of conveying an amount of flushing water into the first compartment to flush out the released pre-measured amount of treating agent from the first compartment and convey it into the washing tub through the supply line.

Preferably, the method comprises a step of conveying an amount of flushing water into the first compartment to flush out the released pre-measured amount of treating agent from the first compartment and convey it into the washing tub through the supply line and wherein the step of conveying an amount of flushing water is carried out through the first water conveying line.

In a further preferred embodiment of the invention, the method comprises a step of conveying an amount of flushing water into the first compartment to flush out the released pre-measured amount of treating agent from the first compartment and convey it into the washing tub through the supply line and wherein the step of conveying an amount of flushing water is carried out through a second water conveying line different from the first water conveying line.

Preferably, the step of conveying an amount of water to the first compartment for moving the unit dose package is controlled by the control unit.

According to a preferred embodiment of the invention, the method further comprises a step of positioning the unit dose package in the predefined zone inside the first compartment and/or in the predefined portion of a bottom side of the first compartment.

Preferably, the method comprises a step of providing a stopping device associated to the first compartment adapted for stopping the unit dose package in a predefined zone inside the first compartment when the unit dose package is intact while it is configured to allow the passage of treating agent released from the unit dose package after breakage of the water-soluble pouch.

In a preferred embodiment of the invention, the method further comprises a step of positioning the unit dose package in abutment to the stopping device at the predefined zone inside the first compartment.

Preferably, the step of positioning the unit dose package in a predefined zone inside the first compartment is controlled by the control unit.

According to a preferred embodiment of the invention, the positioning step comprises a step of conveying an amount of water to the first compartment from one of said one or more water conveying lines so that the unit dose package moves towards the predefined zone.

Preferably, the positioning step comprises a step of conveying an amount of water to the first compartment from one of said one or more water conveying lines so that the unit dose package moves towards the predefined zone before the unit dose package breakage step of breaking the water-soluble pouch.

According to a preferred embodiment of the invention, the positioning step comprises a step of conveying an amount of water to the first compartment from the first water conveying line so that the unit dose package moves towards the predefined zone.

According to a further preferred embodiment of the invention, the positioning step comprises a step of conveying an amount of water to the first compartment from a second water conveying line different from the first water conveying line so that the unit dose package moves towards the predefined zone.

Preferably, the step of conveying an amount of water to the first compartment for moving the unit dose package is controlled by the control unit.

Preferably, unit dose package moves towards the predefined zone by a pushing action of the amount of water.

Preferably, the unit dose package moves towards the predefined zone by slipping. In a preferred embodiment of the invention, the breakage step is carried out if the user selects a dedicated washing program through the interface unit.

More preferably, breakage step is carried out if the user selects a dedicated washing program through the interface unit which indicates the use of a unit dose package.

Preferably, the user selects the dedicated washing program by operating a selector device of the interface unit.

Preferably, the selector device is at least one of the following: a push button, a rotary knob, a touch screen, a capacitive switch.

In a further preferred embodiment of the invention, the breakage step is carried out automatically upon detection of the presence of the unit dose package in the first compartment.

Preferably, the treating agent is at least one of the following: a detergent, a softener, a rinse additive, a fabric conditioners, a waterproofing agent, a fabric enhancer, a rinse sanitization additive, a chlorine-based additive.

Preferably, the pre-measured amount of treating agent is powder or liquid or paste or waxy or a gel composition or a combination thereof.

BRIEF DESCRIPTION OF THE DRAWINGS

Further characteristics and advantages of the present invention will be highlighted in greater detail in the following detailed description of preferred embodiments of the invention, provided with reference to the enclosed drawings. In the drawings, corresponding characteristics and/or components are identified by the same reference numbers. In such drawings.

DETAILED DESCRIPTION OF EXAMPLE EMBODIMENTS

Figure 2:
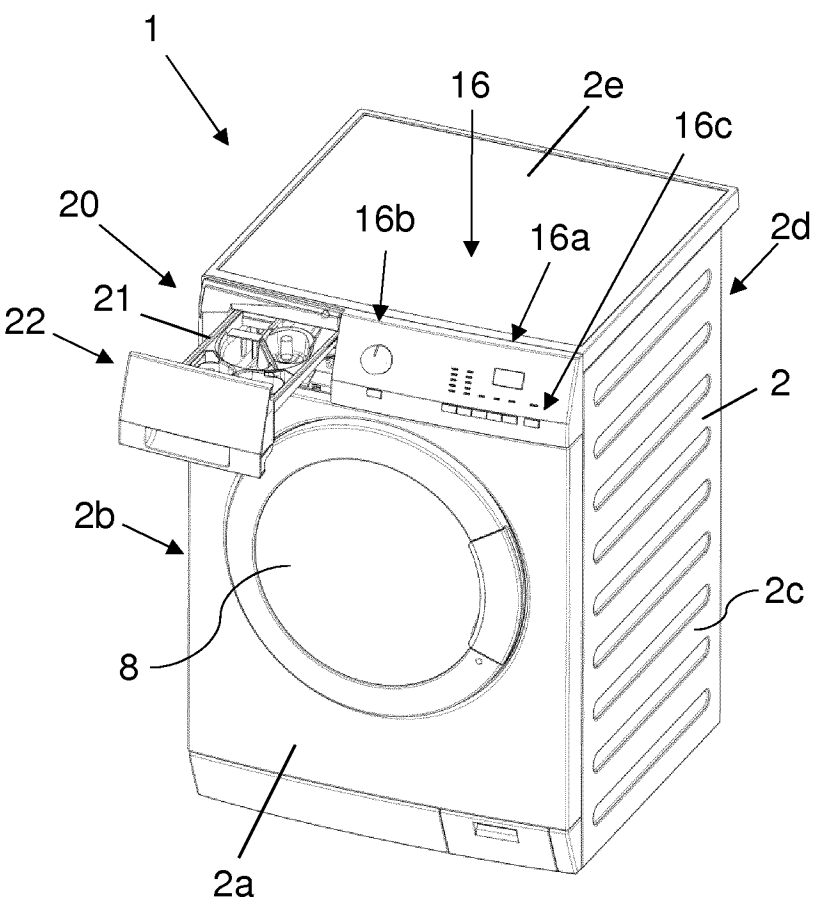
FIG. 2 shows the laundry washing machine of FIG. 1 with the drawer in its opened loading position.

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both simple laundry washing machines and laundry washing-drying machines.

A laundry washing machine 1 where a method according to a preferred embodiment of the invention is performed is described with reference to FIGS. 1 to 12.

The laundry washing machine 1 comprises an external casing or cabinet 2, in which a washing tub 3 is provided that contains a perforated washing drum 4 where the laundry to be treated can be loaded. The external casing 2 comprises vertical side walls 2*a*-2*d* and an upper side wall 2*e*.

The tub 3 and the drum 4 both preferably have a substantially cylindrical shape. Between the tub 3 and the drum 4 *a* gap is defined.

The cabinet 2 is provided with a loading/unloading door 8 which allows access to the drum 4.

The tub 3 is preferably suspended in a floating manner inside the cabinet 2, advantageously by means of a number of coil springs and shock-absorbers 17.

The drum 4 is advantageously rotated by an electric motor, not illustrated, which preferably transmits the rotating motion to the shaft of the drum 4, advantageously by means of a belt/pulley system. In a different embodiment of the invention, the motor can be directly associated with the shaft of the drum 4.

The drum 4 is advantageously provided with holes which allow the liquid flowing therethrough. Said holes are typically and preferably homogeneously distributed on the cylindrical side wall of the drum 4.

The tub 3 is preferably connected to the cabinet 2 by means of an elastic bellows 7, or gasket. The bellows 7 is preferably S-shaped.

Figure 3:
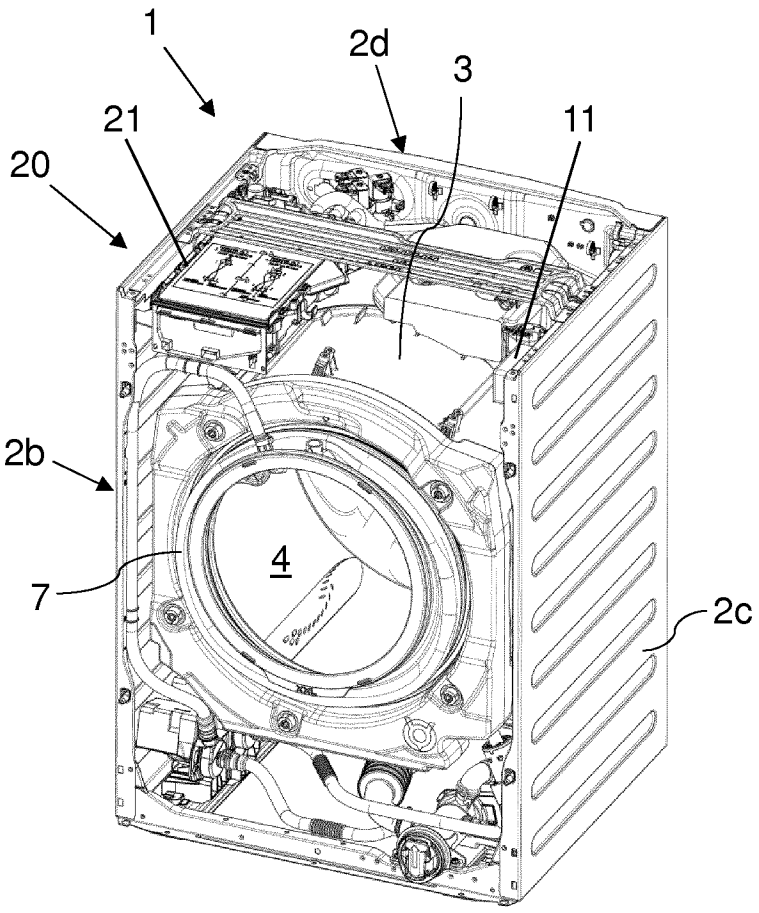
FIG. 3 shows the laundry washing machine of FIG. 1 with the front side wall and the upper side wall removed.

Laundry washing machine 1 advantageously comprises a control unit 11, for example illustrated in FIG. 3, connected to the various parts of the laundry washing machine 1 in order to ensure its operation. Laundry washing machine 1 preferably comprises an interface unit 16, connected to the control unit 11, accessible to the user and by means of which the user may select and set the washing parameters, like for example a desired washing program. Usually, other parameters can optionally be inserted by the user, for example the washing temperature, the spinning speed, etc. The interface unit 16 preferably comprises a display 16*a* which displays machine working conditions.

The unit interface 16 then preferably comprises one or more selector devices which allow to select the appropriate wash program and/or to set other parameters.

For example, the selector devices may comprise a selector 16*b* (a rotary knob) which advantageously allows to select the appropriate wash program. The selector devices may then preferably comprise push buttons. In a preferred embodiment, one of the push buttons 16*c* is advantageously dedicated for selection of a program which uses a detergent pod, as will be described later. Thus we can refer hereinafter to a "Pods cycle" button 16*c*.

In further preferred embodiments, the selection of the washing program which uses a detergent pod may be obtained through other selector devices, for example through the selector 16*b*.

In further embodiments, the selector devices may comprise other of type device, such as capacitive switch, touch screen, etc. In a preferred embodiment, the touch screen may coincide with the display 16.

The laundry washing machine 1 advantageously comprises a treating agents dispenser 20 to supply treating agents into the tub 3 during a washing cycle.

Treating agents may comprise, for example, detergents, rinse additives, fabric softeners or fabric conditioners, waterproofing agents, fabric enhancers, rinse sanitization additives, chlorine-based additives, etc.

Advantageously, the treating agents dispenser 20 comprises a box-shaped housing 21, connected to the external casing 2, internally to the latter, preferably by suitable fixing means, comprising, for example, screws or rivets, not illustrated, or also glue, or welding.

In the enclosed Figures, the housing 21 is advantageously substantially parallelepiped, and it is connected to the frontal side wall 2*a* of the external casing 2, opportunely in an upper region of the latter, positioned above the tub 3.

Figure 1:
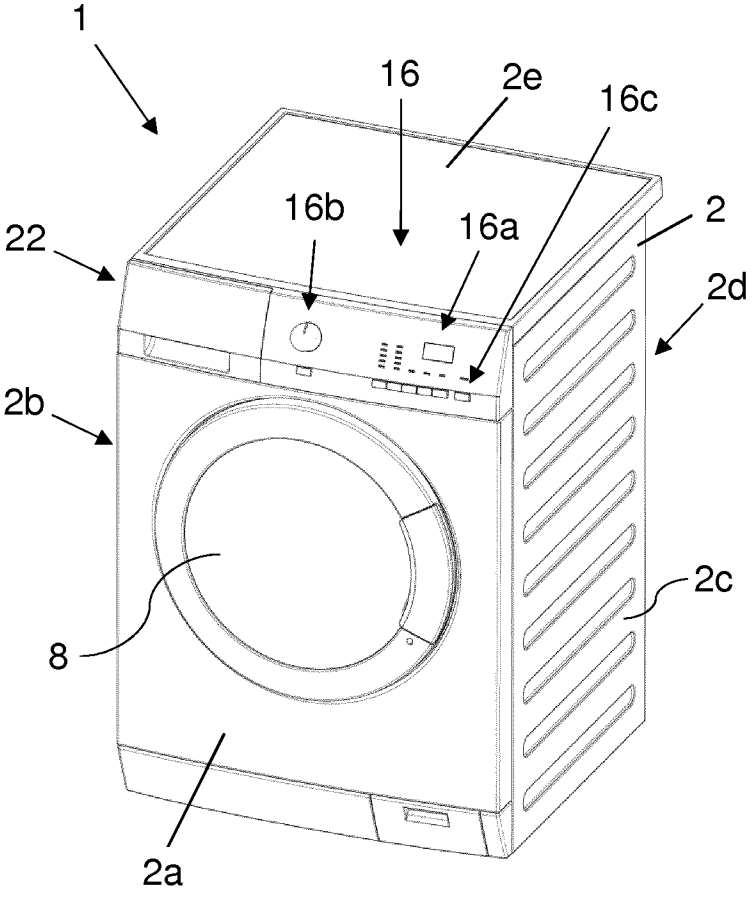
FIG. 1 shows a perspective view of a laundry washing machine in which a method according to a first embodiment of the invention is performed.
Figures 5, 5A, 5B:
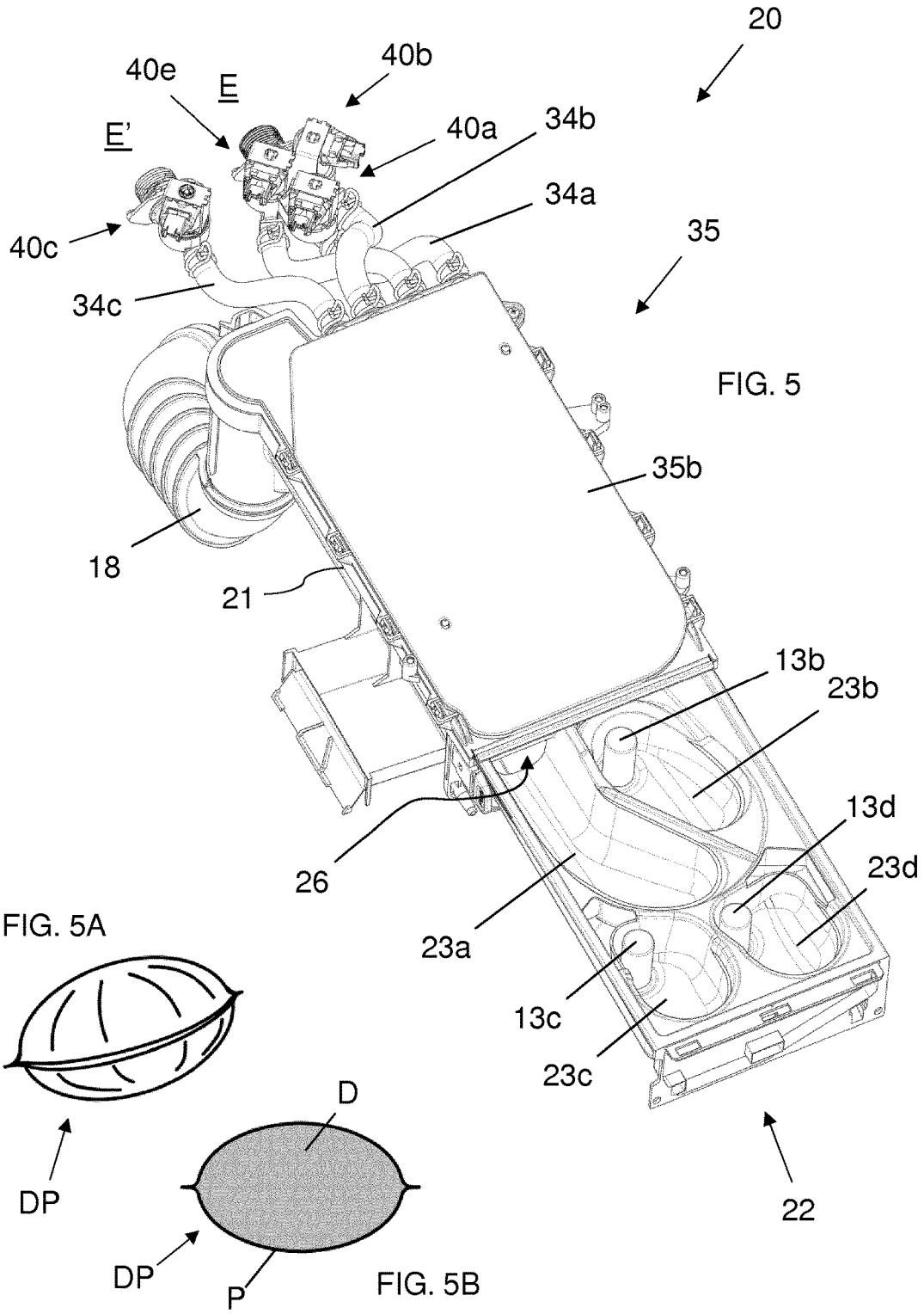
FIG. 5 is a prospective view of the treating agents dispenser, isolated from the rest, of the laundry washing machine represented in FIG. 2 with the drawer in its opened loading position.
FIG. 5A shows a unit dose detergent usable in laundry washing machine represented in FIG. 1 and in the treating agents dispenser represented in FIG. 5.
FIG. 5B is a sectional view of the unit dose detergent of FIG. 5A.
Figure 6:
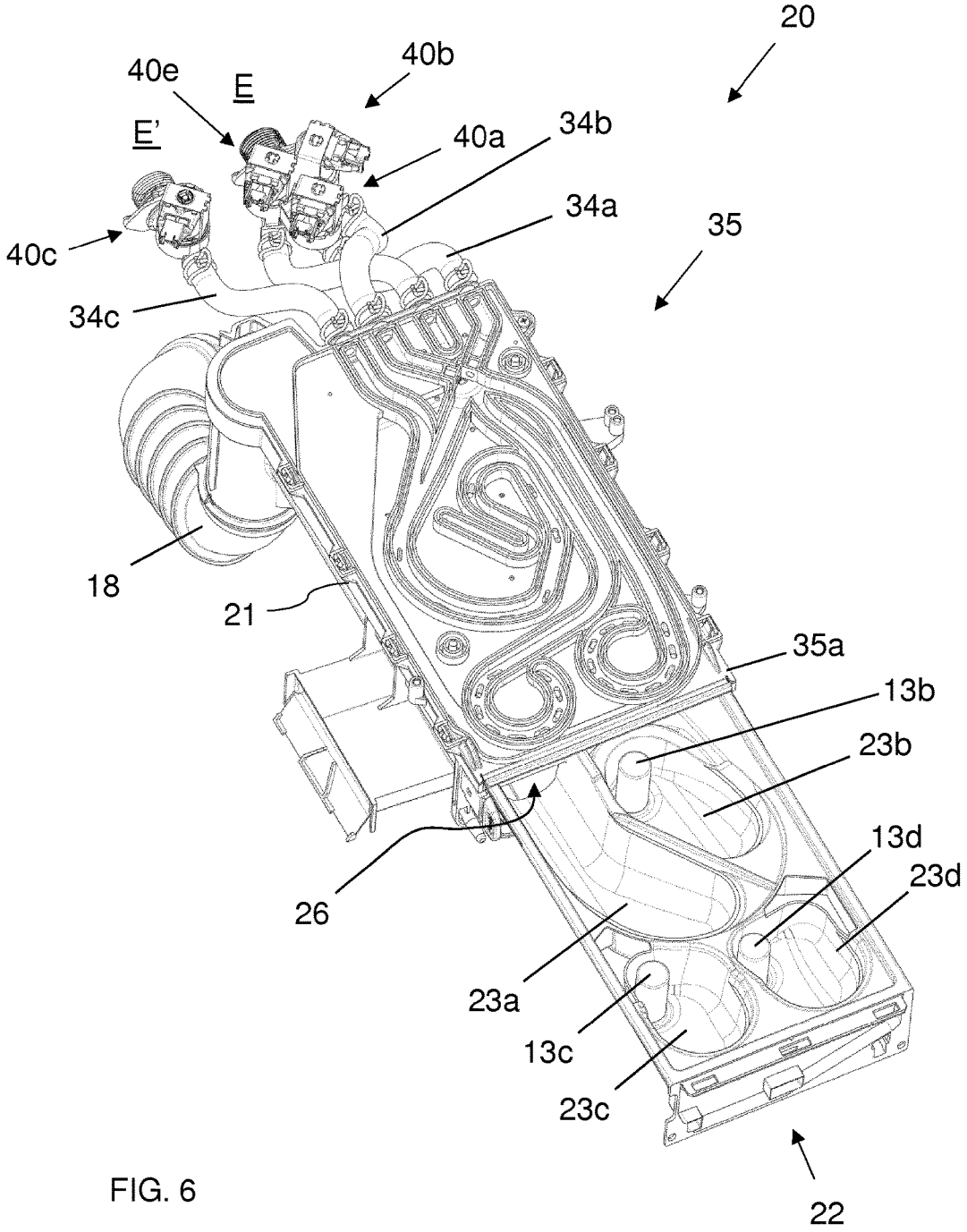
FIG. 6 shows the treating agents dispenser of FIG. 5 with an element removed therefrom.
Figure 7:
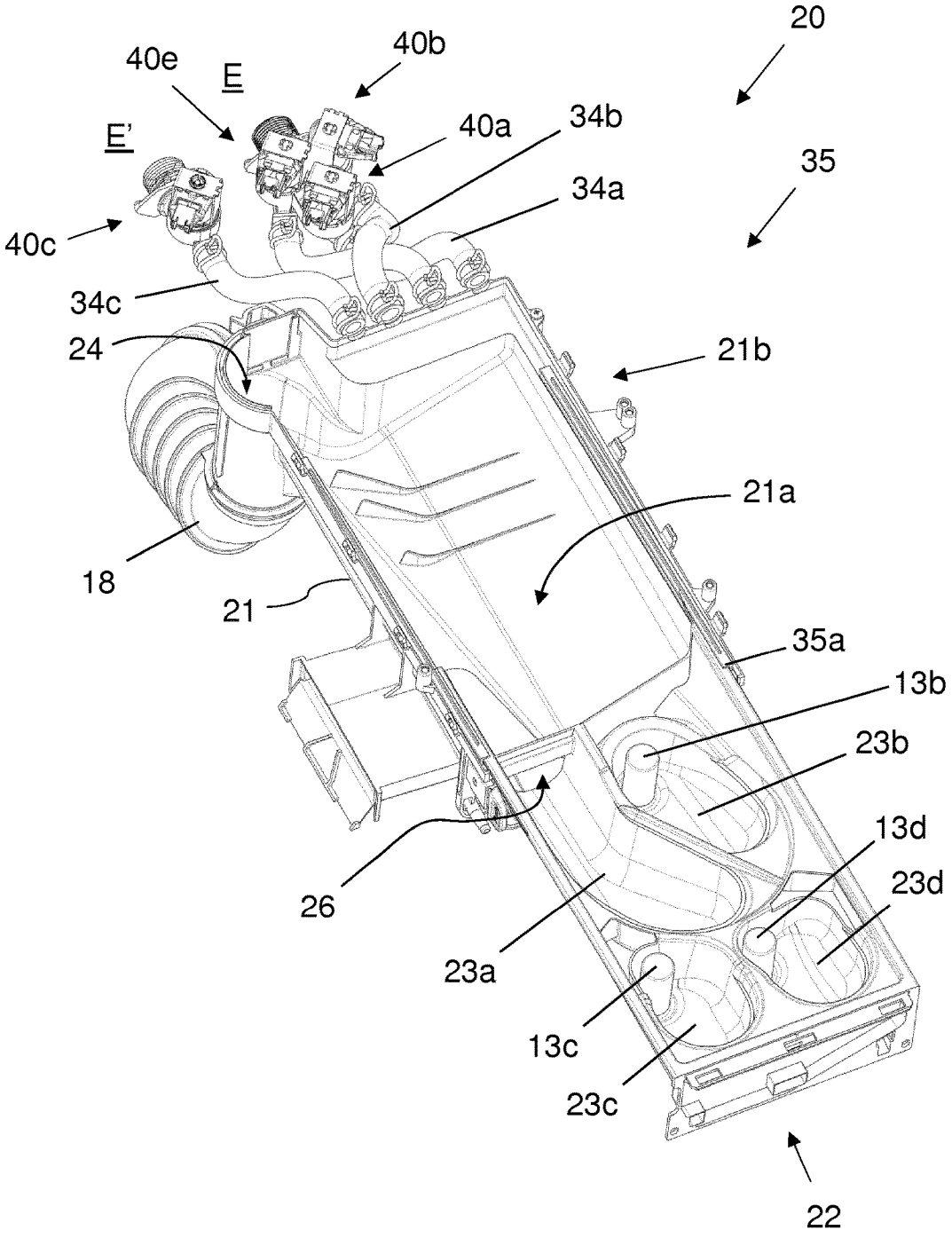
FIG. 7 shows the treating agents dispenser of FIG. 6 with a further element removed therefrom.
Figure 8:
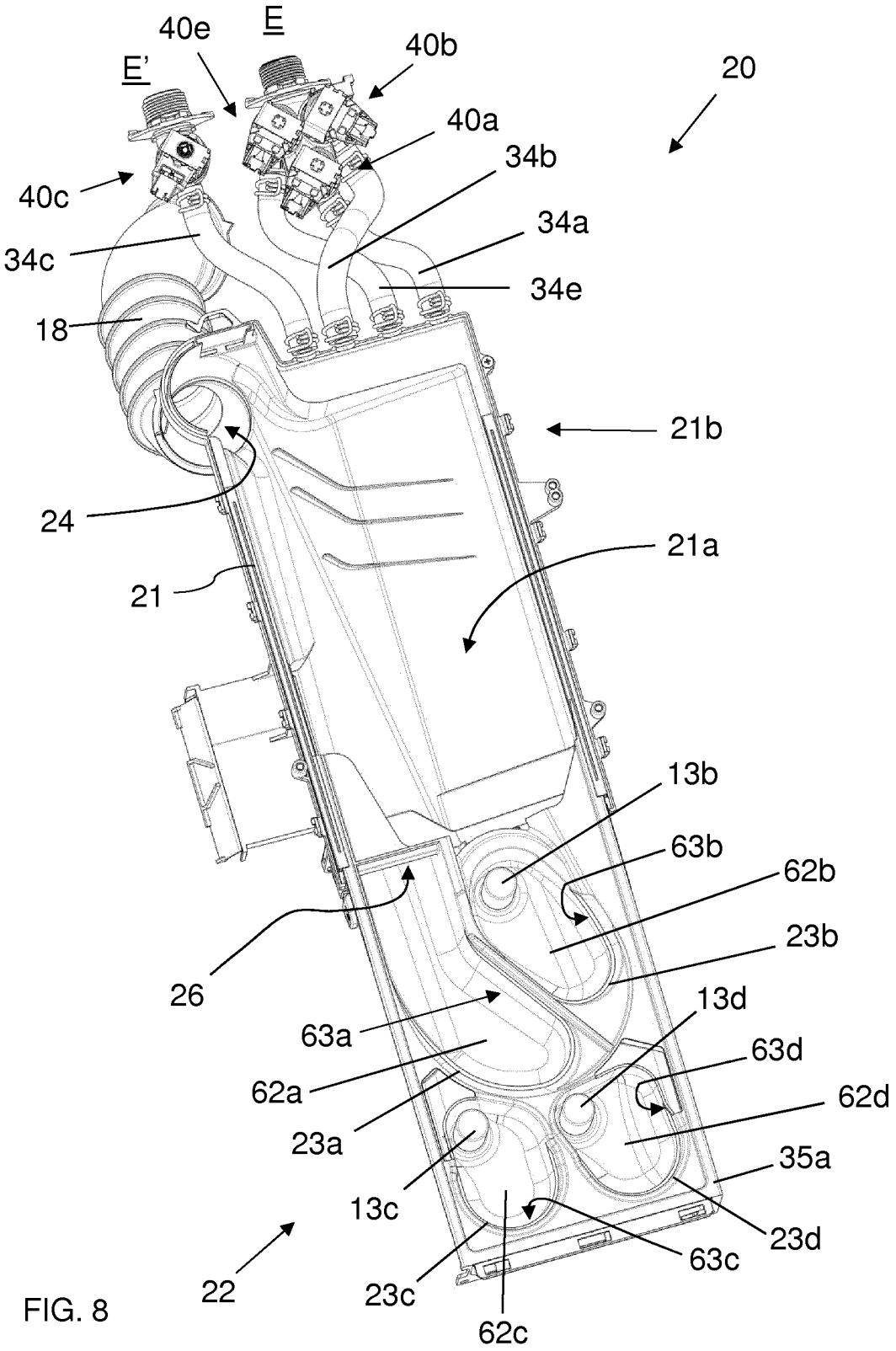
FIG. 8 shows the treating agents dispenser of FIG. 7 from a slightly different point of view.
Figure 9:
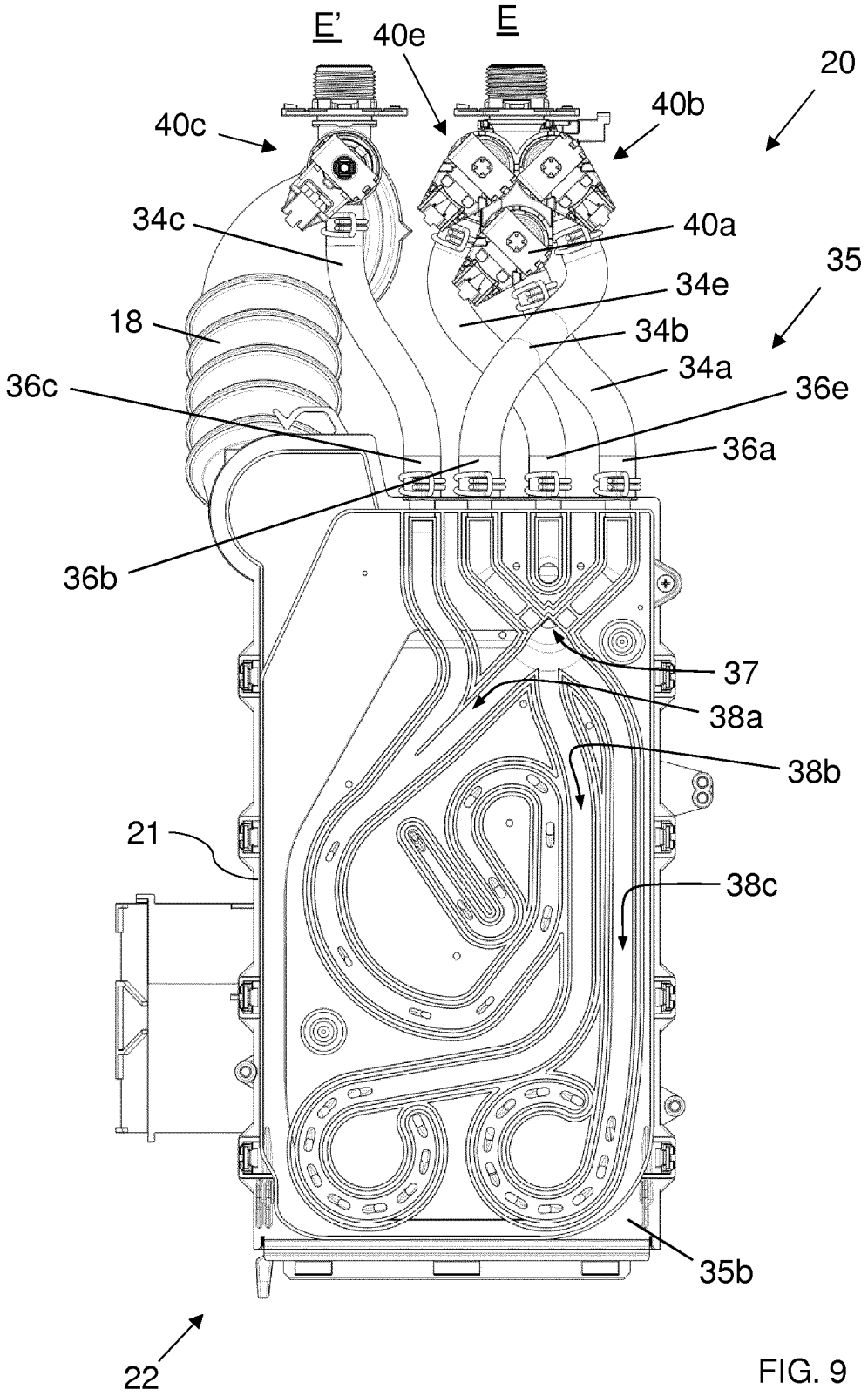
FIG. 9 is a plan view of the treating agents dispenser of FIG. 6 with the drawer in its closed position.

The housing 21 contains a removable drawer 22 which can be extracted from the housing 21, such as to protrude from the external casing 2 in a opened loading position, as illustrated for example in FIGS. 2 and 5, or can be fully inserted into the housing 21 in an operative position, as illustrated for example in FIGS. 1 and 9.

The drawer 22 is provided with one or more compartments 23*a*, 23*b*, 23*c*, 23*d* adapted to be filled with treating agents.

In the embodiment illustrated in the Figures, there are four compartments, 23*a*, 23*b*, 23*c* and 23*d*.

The first compartment 23*a* is preferably adapted for receiving a powder detergent; the second compartment 23*b* is preferably adapted for receiving a quantity of liquid detergent; the third compartment 23*c* is preferably adapted for receiving a softener; the fourth compartment 23*d* is preferably adapted for receiving other treating agents, such as fabric conditioners, waterproofing agents, fabric enhancers, rinse sanitization additives, chlorine-based additives, etc.

According to an advantageous aspect of the present invention, the first compartment 23*a* is preferably adapted for receiving also a unit dose package. With "unit dose package" it is meant a product comprising a pre-measured amount, or single dose, of treating agent incorporated into a water-soluble pouch. In the preferred embodiment here described, the treating agent is detergent D.

Hereinafter, therefore, the unit dose package will be simply indicate as "detergent pod DP".

For example, the detergent pod DP comprises a pre-measured amount, or single dose, of detergent D incorporated into a water-soluble pouch P, as illustrated in FIGS. 5A and 5B.

Detergent D may comprise any type of detergent, for example powder, liquid, paste, waxy or gel compositions.

The pouch P preferably comprises a water-soluble film. In some examples, the liquid detergent products may be incorporated into a multi-compartment water-soluble pouch.

The pouches may be made of a film material that is soluble or dispersible in water. The pouches have a percentage of water-solubility, for example a water-solubility of at least 50%, preferably of at least 75% or more preferably at least 95%.

Suitable pouch materials may include, but are not limited to, polymeric materials.

In some examples, the polymers are formed into a film or sheet. The pouch material can, for example, be obtained by casting, blow-moulding, extrusion or blown extrusion of the polymeric material, as known in the art.

Other polymers, copolymers or derivatives thereof suitable for use as pouch material may be selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. In some examples, polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. The level of polymer in the pouch material, for example a PVA polymer, may be at least 60%. The polymer can have any weight average molecular weight of from 1000 to 1,000,000, in some examples from 10,000 to 300,000, and in further examples from 20,000 to 150,000.

Mixtures of polymers can also be used as the pouch material. This can be beneficial to control the mechanical and/or dissolution properties of the compartments or pouch, depending on the application thereof and the required needs.

Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of 10,000-40,000, in some examples a weight average molecular weight of about 20,000, and of PVA or copolymer thereof, with a weight average molecular weight of 100,000 to 300,000, in some examples a weight average molecular weight of about 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising 1-35% by weight polylactide and 65% to 99% by weight polyvinyl alcohol. In some examples, polymers for use herein are from 60% to 98% hydrolysed, and in further examples from 80% to 90% hydrolysed, to improve the dissolution characteristics of the material.

It will be obvious according to one skilled in the art that different film materials and/or films of different thickness may be employed in making the compartments. A benefit in selecting different films is that the resulting compartments may exhibit different solubility or release characteristics.

The pouch material herein can comprise one or more additive ingredients. For example, it can be beneficial to add plasticisers, for example glycerol, ethylene glycol, diethyleneglycol, propylene glycol, sorbitol and mixtures thereof.

Other additives include functional detergent additives to be delivered to the wash water, for example organic polymeric dispersants, etc.

For reasons of deformability pouches or pouch compartments containing a component which is liquid will preferably contain an air bubble having a volume of up to 50%, alternatively up to 40%, alternatively up to 30%, alternatively up to 20%, alternatively up to 10% of the volume space of said compartment.

The compartments 23*a*, 23*b*, 23*c* and 23*d* are fluidly connected to the bottom 21*a* of the housing 21, particularly to the rear portion 21*b* of this bottom 21*a*, in which an outlet port 24 is obtained. The outlet port 24 is adapted to allow the flowing of a liquid into a supply pipe 18 fluidly connecting the treating agents dispenser 20 and the tub 3, as visible in FIG. 8.

Figure 4:
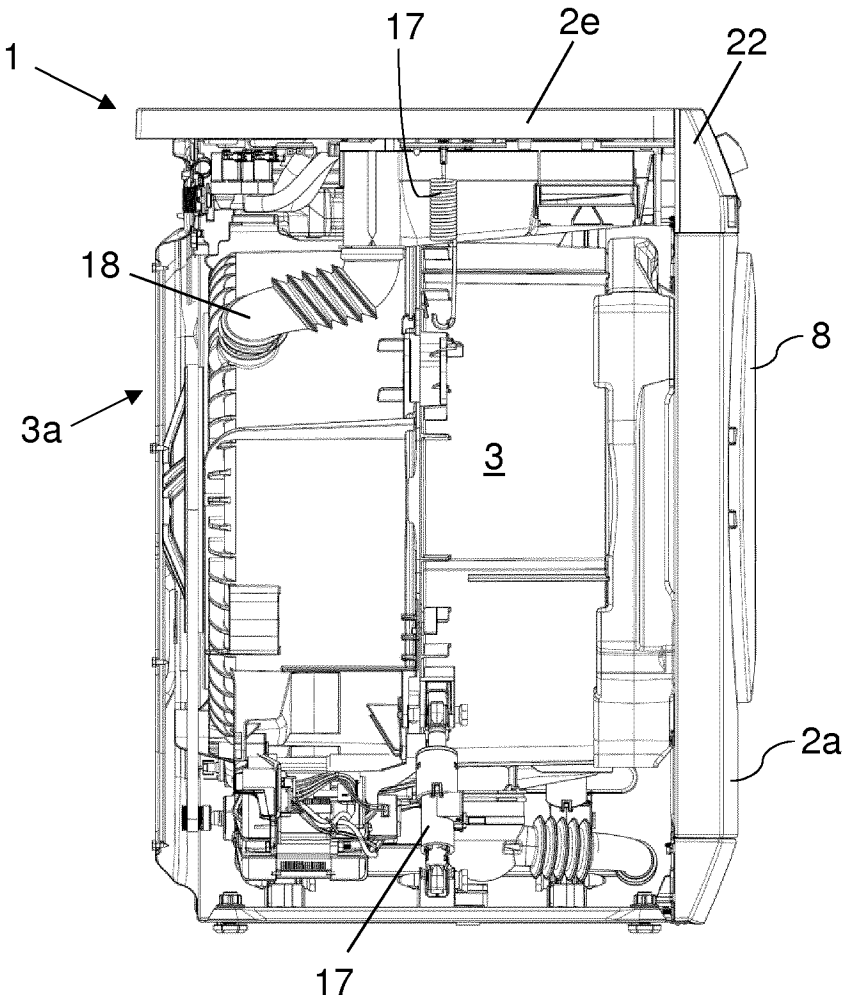
FIG. 4 shows a lateral plan view of the laundry washing machine of FIG. 1 with the left side wall removed.

The supply pipe 18, as illustrated in FIG. 4, is preferably arranged laterally with respect to the tub 3 and preferably terminates at an upper region 3*a* of the tub 3. More preferably, the supply pipe 18 terminates at a rear side of the tub 3. The bottom 21*a* of the housing 21 preferably has a sloped bottom so that a fluid may flow towards the outlet port 24. The outlet port 24 is preferably located at the rear of the sloped bottom wall 21*a*.

It is underlined that in the present application saying that a first component is "fluidly connected" to a second component means that a fluid can flow from the first component to the second component and vice versa; on the contrary, saying that a first component is "fluidly separated" from a second component means that a fluid can't flow from the first component to the second component or vice versa.

The first compartment 23*a* of the drawer 22 is fluidly connected to the bottom 21*a* of the housing 21 through an aperture 26 defined at the rear of the first compartment 23*a*.

The first compartment 23*a* preferably has a sloped bottom wall 62*a* so that a fluid may flow towards the aperture 26. The aperture 26 is located at the rear of the sloped bottom wall 62*a*.

According to an aspect of the invention, the first compartment 23*a* is suited to receive the detergent pod DP.

The other compartments 23*b*, 23*c* and 23*d* of the drawer 22 are preferably fluidly connected to the bottom 21*a* of the housing 21 through respective siphons 13*b*, 13*c*, 13*d*.

Advantageously, the treating agents dispenser 20 comprises a water distributor 35, associated to the housing 21 and placed above the drawer 22 in such a way to allow the flowing of water to one or more of said compartments 23*a*, 23*b*, 23*c*, 23*d*.

The treating agents dispenser 20 comprises one or more water conveying lines adapted for conveying water to one or more of said compartments 23*a*, 23*b*, 23*c*, 23*d*.

The water distributor 35 preferably comprises a lower part 35*a* and an upper closing part 35*b* structured for being reciprocally coupled to form the water distributor 35. The two parts 35*a*, 35*b* are preferably coupled by welding and/or glueing and/or joint.

Advantageously, the water distributor 35 comprises a first and a second inlet connector 36*a*, 36*b* connectable to a water source E which could comprise, for example, the plumbing of the building in which the laundry washing machine 1 is installed, as better visible in FIG. 9.

Advantageously the first and second connectors 36*a*, 36*b* can be connected to the water source E via first and second controllable valves 40*a*, 40*b*, preferably of the electromagnetic type, opportunely controlled by the control unit 11. In the embodiment illustrated in the enclosed Figures, the two inlet connectors 36*a*, 36*b* can be connected via the dedicated controllable valves 40*a*, 40*b*, to the water source E for the adduction of cold water.

Inlets of the two controllable valves 40*a*, 40*b* are connectable to the water source E and outlets of the two controllable valves 40*a*, 40*b* are connected, through respective pipes 34*a*, 34*b*, to the two inlet connectors 36*a*, 36*b* of the water distributor 35.

Preferably, the controllable valves 40*a*, 40*b* above described, and all the valves described hereinafter, comprise a regulator system that automatically cuts off the flow of water flowing therethrough at a certain maximum pressure. Preferably, the maximum pressure is set at a value comprises between 1.7 and 2.4 bar.

In the embodiment illustrated in the enclosed Figures there is also provided a third inlet connector 36*c* connectable, via a third controllable valve 40*c*, to a warm or hot water source E' (as visible in FIG. 9); the further inlet connector 36*c* can be fed with warm or hot water, for example obtained by a solar thermal collector; in a further embodiment, not illustrated, there could be more than one further inlet connectors, connected to one or more water sources.

Inlet of the third controllable valve 40*c* is connectable to the water source E' and outlet of the third controllable valve 40*c* is connected, through a respective pipe 34*c*, to the third inlet connector 36*c* of the water distributor 35.

Three ducts 38*a*, 38*b*, 38*c* are fluidly connected to the inlet connectors 36*a*, 36*b*. Each one of said three ducts 38*a*, 38*b*, 38*c* fluidly communicates with a different region 25*a*, 25*b*, 25*c*, 25*d* of the water distributor 35. Each region 25*a*, 25*b*, 25*c*, 25*d* is positioned in such a way to be placed above a respective compartment 23*a*, 23*b*, 23*c*, 23*d* of the drawer 22 when the latter is placed in its closed operative position.

Preferably, the inlet connectors 36*a*, 36*b* and the three ducts 38*a*, 38*b*, 38*c* are connected through a so called "air-break" 37, that is a safety system comprising an opening obtained in the water path in such a way to ensure that a stream of water can flow from the inlet connectors 36*a*, 36*b* to the three ducts 38*a*, 38*b*, 38*c* due to the water source pressure, while water can't flow from the ducts 38*a*, 38*b*, 38*c* to the inlet connectors 36*a*, 36*b*. In the embodiment illustrated, the "air-break" 37 advantageously comprises a lower opening 37*a*, better visible in FIG. 11.

The regions 25*a*, 25*b*, 25*c* and 25*d* of the water distributor 35 are provided with one or more outlets 29 that allow the passage of the water from the ducts 38*a*, 38*b*, 38*c* to the underlying compartments 23*a*, 23*b*, 23*c*, 23*d*.

Outlets 29 are preferably arranged in the water distributor 35 so that the water falling into the underlying compartments 23*a*, 23*b*, 23*c*, 23*d* hits the lateral side walls 63*a*, 63*b*, 63*c*, 63*d* of the respective compartment 23*a*, 23*b*, 23*c*, 23*d* and then flows towards the bottom side 62*a*, 62*b*, 62*c*, 62*d* of the respective compartment 23*a*, 23*b*, 23*c*, 23*d*.

Figure 12:
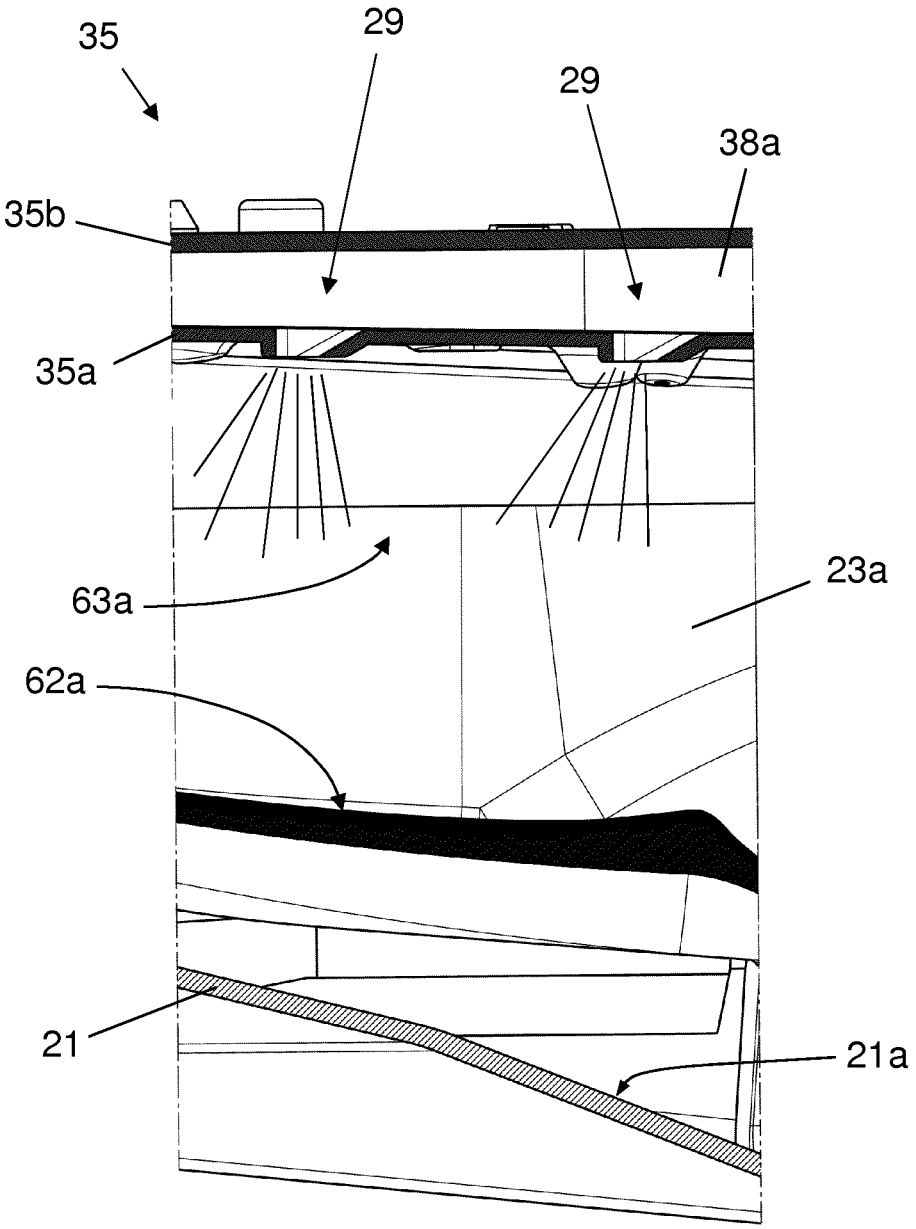
FIG. 12 shows a plan view of the treating agents dispenser of FIG. 10 sectioned along line XII°-XII°.

FIG. 12 illustrates a section view of two of said outlets 29.

Outlets 29 here illustrated allow the passage of water from the first duct 38*a* to the underlying first compartment 23*a*. Water spreading out from the outlets 29 hits the lateral side wall 63*a* of the first compartment 23*a* and falls down by gravity into the bottom 62*a* of the same. Advantageously, when the first compartment 23*a* is filled with powder detergent, the water drags the detergent towards the rear aperture 26 of the first compartment 23*a*. Furthermore, once all the detergent has been conveyed towards the rear aperture 26, the water hitting the lateral side wall 63*a* advantageously clean the first compartment 23*a*. Analogously, the same cleaning effect for the other compartments 23*b*, 23*c*, 23*d* is obtained through outlets 29.

With reference to ducts 38*a*, 38*b*, 38*c*, they are advantageously defined between lower part 35*a* and the upper closing part 35*b* of the water distributor 35.

In particular, as will be better explained in the following, by acting on the controllable valves 40*a*, 40*b* and 40*c*, it is possible to selectively feed one of the ducts 38*a*, 38*b* and 38*c* and one or more compartments 23*a*, 23*b*, 23*c*, 23*d* with water coming from the water source E or E'.

Figure 9B:
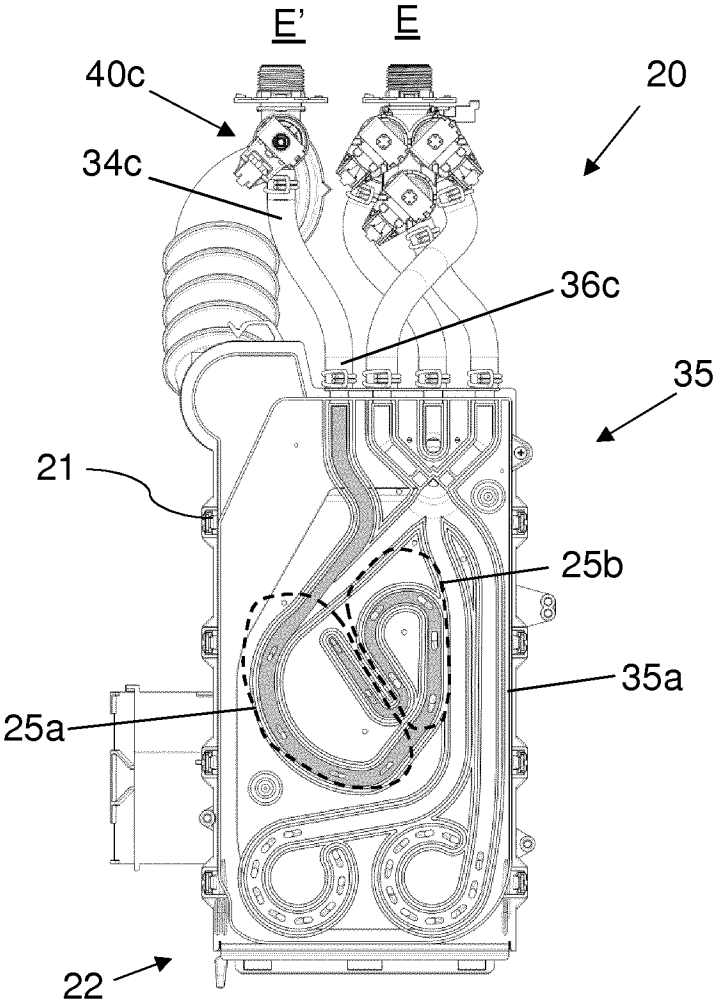
FIGS. 9A to 9D schematically illustrate different working conditions of the treating agents dispenser of FIG. 9.
Figure 9A:
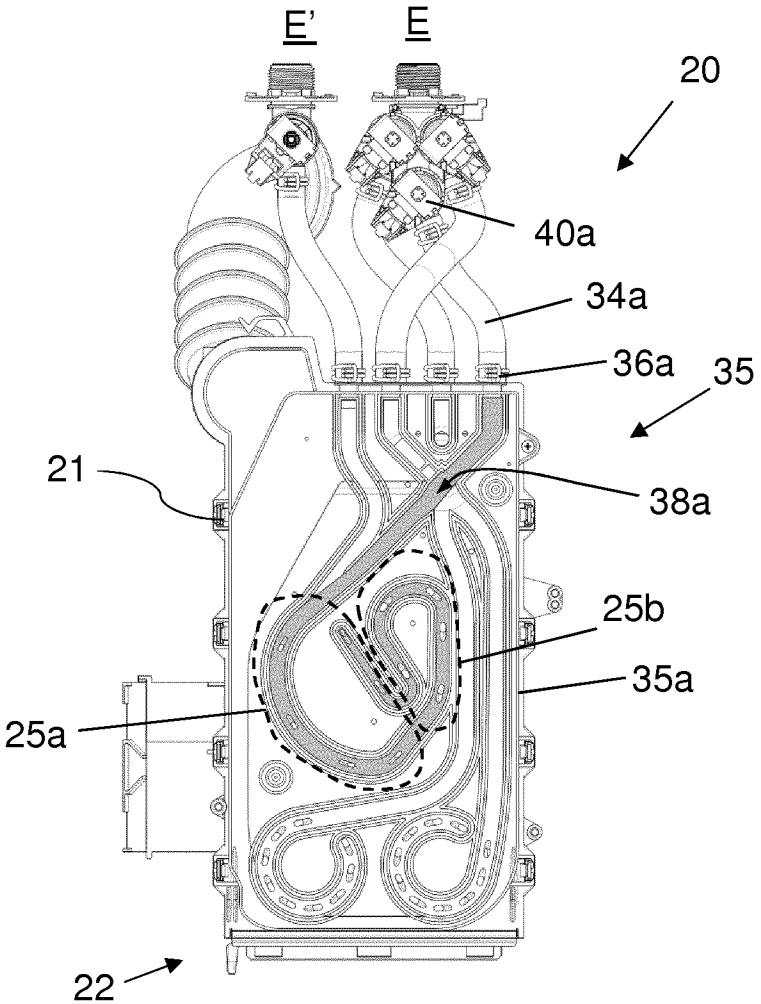

More in particular, the first duct 38*a* communicates with two regions 25*a*, 25*b* of the water distributor 35 which are positioned above the first and second compartments 23*a*, 23*b*, as indicated in FIG. 9A.

Water is conveyed to the two compartments 23*a*, 23*b* of the drawer 22 by activating the first valve 40*a* and making the water flowing through the first duct 38*a* up to the regions 25*a*, 25*b*, as schematically indicated in FIG. 9A with grey path.

In the embodiment illustrated in the enclosed Figures also the further connector 36*c*, which can be fed with warm or hot water, is fluidly connected to the two regions 25*a*, 25*b* of the water distributor 35, in such a way to adduct also warm or hot water in the underlying first and second compartments 23*a*, 23*b*, as schematically indicated in FIG. 9B.

In a further preferred embodiment, not illustrated, the water distributor may comprise a dedicated duct and valve for each compartment, i.e. a duct communicating with the first region and another duct communicating with the second region.

The second duct 38*b* communicates with the third region 25*c* of the water distributor 35 which is positioned above the third compartment 23*c*.

Figure 9D:
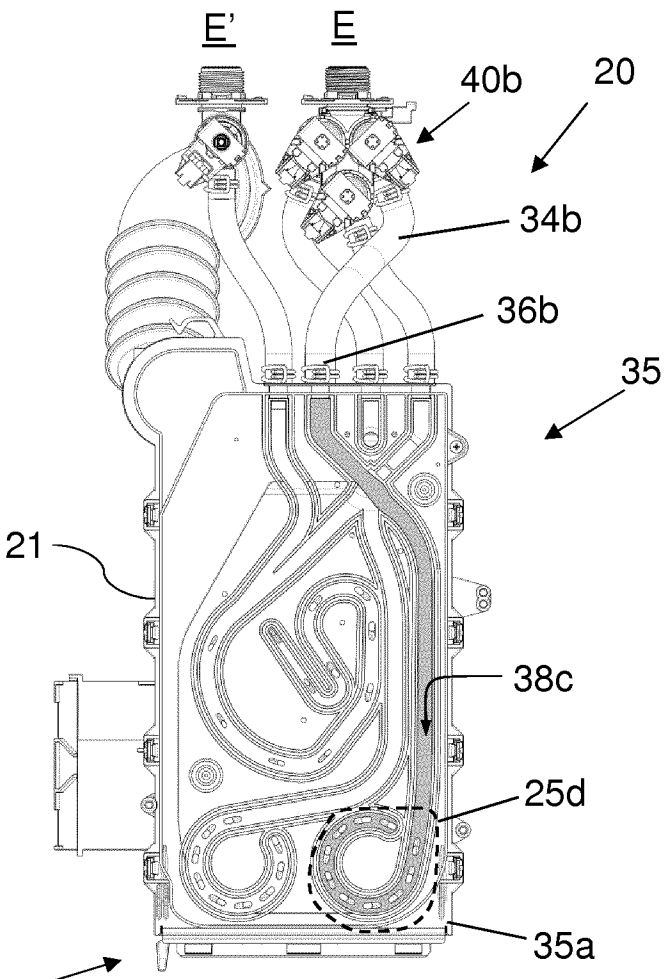
Figure 9C:
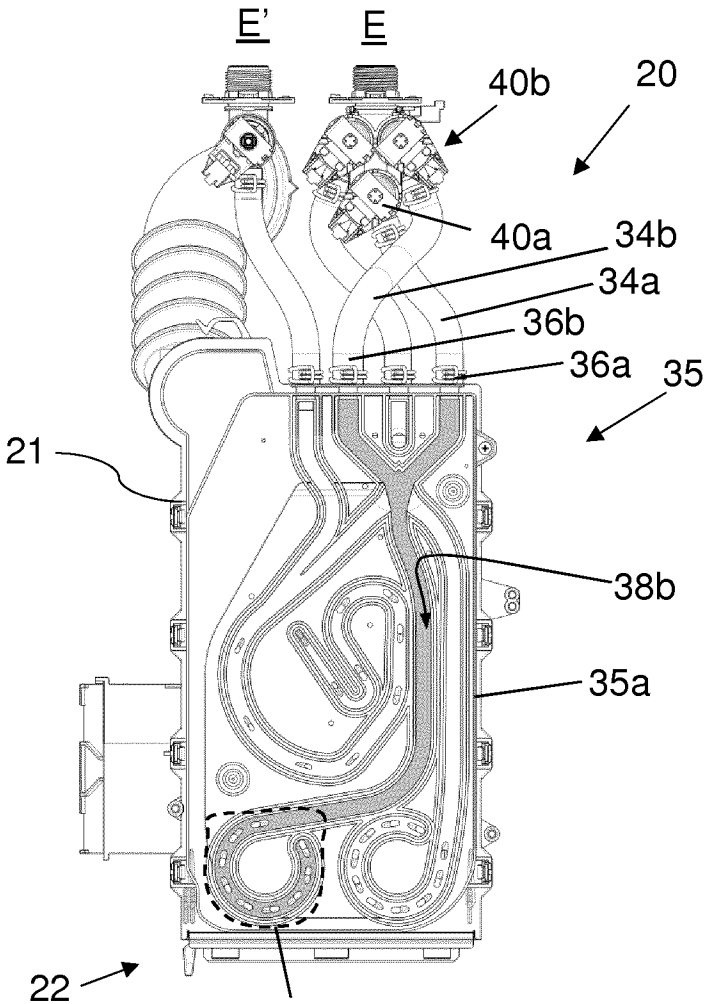
Figure 10:
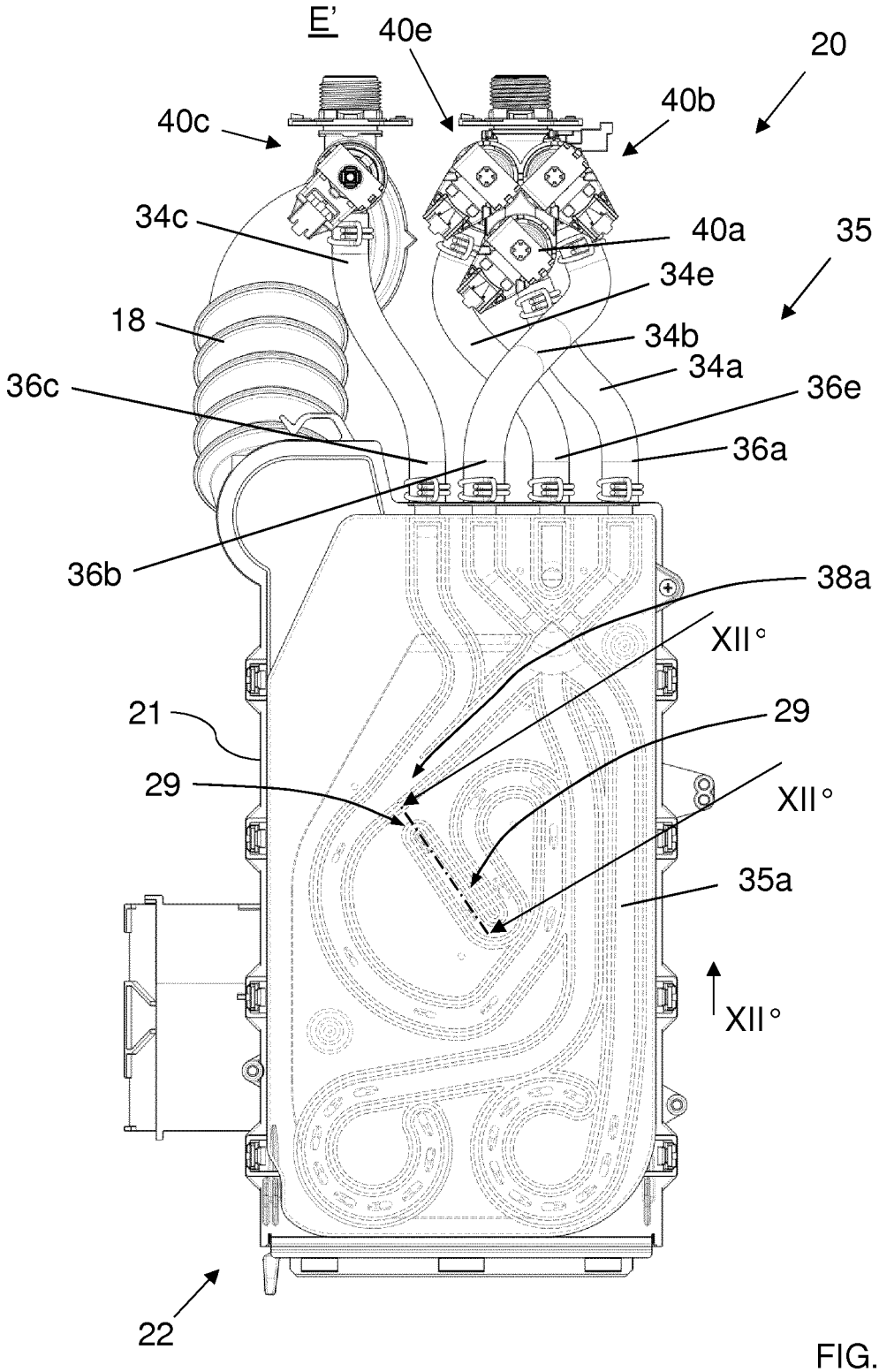
FIG. 10 is a plan view of the treating agents dispenser of FIG. 5 with the drawer in its closed position in which the underlying not visible components have been represented in dotted lines.

Water is conveyed to the third compartment 23*c* of the drawer 22 by activating simultaneously the first and second valves 40*a*, 40*b* and making the water flowing through the second duct 38*b* up to the third region 25*c*, as schematically indicated in FIG. 9C.

The third duct 38*c* communicates with the fourth region 25*d* of the water distributor 35 which is positioned above the fourth compartment 23*d*.

Water is conveyed to the fourth compartment 23*d* of the drawer 22 by activating the second valve 40*b* and making the water flowing through the third duct 38*c* up to the fourth region 25*d*, as schematically indicated in FIG. 9D.

In another embodiment, not illustrated, in the drawer there can be more than four compartments, and in the water distributor there can be more than three ducts, each one fluidly communicating with a different region of the water distributor which is positioned in such a way to be placed above a different compartment of the drawer when the latter is placed in its closed operative position; also in this case, by acting on the controllable valves, it is possible to selectively feed a desired duct with water coming from the water source.

In further embodiments, not illustrated, in the drawer there can be less than four compartments, even just one, and in the water distributor there can be less than three ducts, each one fluidly communicating with a different region of the water distributor which is positioned in such a way to be placed above a different compartment of the drawer when the latter is placed in its closed operative position; also in this case, by acting on the controllable valves, it is possible to selectively feed a desired duct with water coming from the water source.

Figure 11:
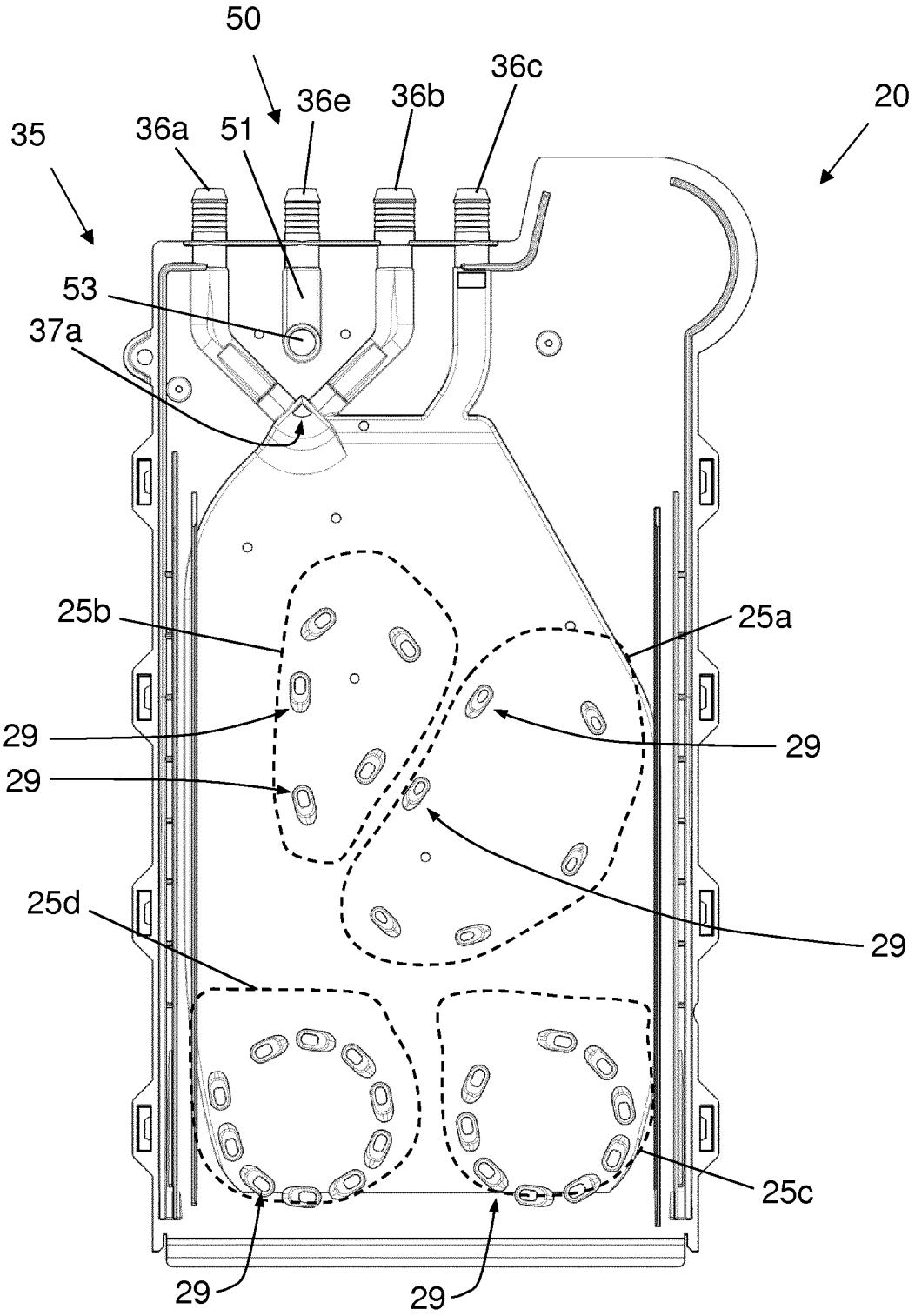
FIG. 11 shows a plan view, from below, of the upper part of the treating agents dispenser of FIG. 5.

Advantageously the treating agents dispenser 20 also preferably comprises a by-pass line 50, better visible in FIG. 11.

The by-pass line 50 comprises a conduit portion 51, obtained in a region of the water distributor 35 not interested by the ducts 38*a*, 38*b* and 38*c*. The conduit portion 51 is opportunely fluidly separated from the compartments 23*a*, 23*b*, 23*c* e 23*d* and terminates with an opening 53, shown in FIG. 11, facing the underlying housing 21. The opening 53 is placed above the drawer 22 in such a way to allow the flowing of water directly to the bottom 21*a* of the housing 21 and outside the compartments 23*a*, 23*b*, 23*c*, 23*d* without entering the compartments 23*a*, 23*b*, 23*c*, 23*d*.

The conduit portion 51 communicates with an inlet connector 36*e* of the water distributor 35. The inlet connector 36*e* is fluidly connected, via a controllable valve 40*e*, to the water source E.

Inlet of the controllable valve 40*e* is connectable to the water source E and outlet of the controllable valve 40*e* is connected, through a respective pipe 34*e*, to the inlet connector 36*e*.

The by-pass line 50 is adapted to allow the passage of clean (or fresh) water from the water source E directly to the washing tub 3 by-passing the compartments 23*a*, 23*b*, 23*c*, 23*d* of the water distributor 35.

In different embodiments the by-pass line may not be present.

In an embodiment of the invention, the laundry washing cycle is advantageously carried out using powder or liquid detergent as known in the art. In this case, the first compartment 23*a* of the treating agents dispenser 20 is filled with powder detergent or the second compartment 23*b* is filled with liquid detergent. Then, advantageously, the third compartment 23*c* may be filled with a softener and/or the fourth compartment 23*d* may be filled with other treating agents, such as fabric conditioners, waterproofing agents, fabric enhancers, rinse sanitization additives, chlorine-based additives, etc. By operating on the interface unit 16 the user selects the desired washing program. The control unit 11 controls the laundry washing machine 1 so that it may start the washing program and dispensing, when required, the proper treating agent from the treating agents dispenser 20 to the washing tub 3.

The treating agent is dispensed from the treating agents dispenser 20 to the washing tub 3 by making flow an amount of flushing water into the proper compartment so as to flush out the treating agent contained therein and convey it into the washing tub 3 through the outlet port 24 and the supply pipe 18.

For example, the powder detergent is dispensed from the treating agents dispenser 20 to the washing tub 3 by making flow an amount of flushing water into the first compartment 23*a* so as to flush out the powder detergent contained therein and convey it into the washing tub 3 through the outlet port 24 and the supply pipe 18.

The washing cycle may then proceed with the following phases, such as water heating, drum rotation, draining phases, spinning cycles, etc., or further water loads.

According to a preferred aspect of the invention, the laundry washing cycle is advantageously carried out introducing a detergent pod DP inside the first compartment 23*a*. The third compartment 23*c* may be filled with a softener and the fourth compartment 23*d* may be filled with other treating agents, such as fabric conditioners, waterproofing agents, fabric enhancers, rinse sanitization additives, chlorine-based additives, etc.

In this case, the initial phase of the washing cycle is carried out using water and the detergent D of the detergent pod DP. The detergent D of the detergent pod DP is dispensed from the first compartment 23*a* to the washing tub 3, as will be described in the following.

The detergent pod DP is placed inside the first compartment 23*a* by the user and the drawer 22 is positioned in its closed operating position.

The method according to the invention comprises a step of conveying water, when required, to the first compartment 23*a* by activating the first valve 40*a* and making the water flowing through the first duct 38*a* and the first region 25*a*, as explained above and shown in FIG. 9A. In a different embodiment, the step of conveying warm or hot water, instead of cold water, to the first compartment 23*a* is carried out activating the third valve 40*c* and making the warm or hot water flowing through the first duct 38*a* and the first region 25*a*, as shown in FIG. 9B.

The water introduced inside the first compartment 23*a* through the outlets 29 advantageously pushes the detergent pod DP towards the aperture 26 of the first compartment 23*a* and then towards the outlet port 24 and the supply pipe 18.

The detergent pod DP then reaches the washing tub 3.

The washing cycle may then proceed with the following phases, such as water heating, drum rotation, draining phases, spinning cycles, etc., or further loads of water.

Tests carried out by the applicant have proved that placing the detergent pod DP inside the first compartment 23*a* of the drawer 22 leads to a more efficient washing cycle and to overcome drawbacks of the known art.

Advantageously and according to the method of the invention it is guaranteed that the detergent pod DP is conveyed into the washing tub 3 only at the correct time required by the washing cycle.

This solves the several drawbacks posed by the known art due to the insertion of the detergent pod inside the washing drum before starting of the washing cycle.

In particular, the risk of undesired spots or stains on the laundry is limited. Also there is no risk that the detergent is drained to the outside in case the washing cycle starts with a draining phase.

Furthermore, during its movement from the first compartment 23*a* to the washing tub 3, advantageously, the water-soluble pouch P of the detergent pod DP starts to dissolve. The detergent pod DP is therefore broken and the detergent D is released before it reaches the washing tub 3 and the laundry contained therein. The dose of released detergent D previously contained in the detergent pod DP is therefore at least partially mixed with water before it reaches the laundry and it is more uniformly distributed over the laundry.

Advantageously with the method of the invention it is guaranteed that all the detergent D of the detergent pod DP is used during the laundry washing cycle and the whole cleaning effect of the unit dose detergent is therefore achieved.

Furthermore, with the method of the invention the breakage of the detergent pod PD may advantageously happen before it reaches the laundry inside the washing drum. Therefore residual of the detergent pod DP in the laundry or inside the laundry washing machine, for example inside the bellows, is avoided.

This firstly further reduces risks of spots or stains on the laundry. The risk of presence of residual detergent in a successive rinsing phase is also reduced and the same rinsing is not negatively affected.

Advantageously, the indeterminateness of the effective time of breakage of the pod and the effective time of release of the detergent contained therein is eliminated and the performance of the washing cycle selected by the user is guaranteed.

Still advantageously, as described above, in the same laundry washing machine it is possible to perform either a washing program as known in the art, i.e. using powder or liquid detergent, or a washing program using a unit dose detergent.

Figure 13:
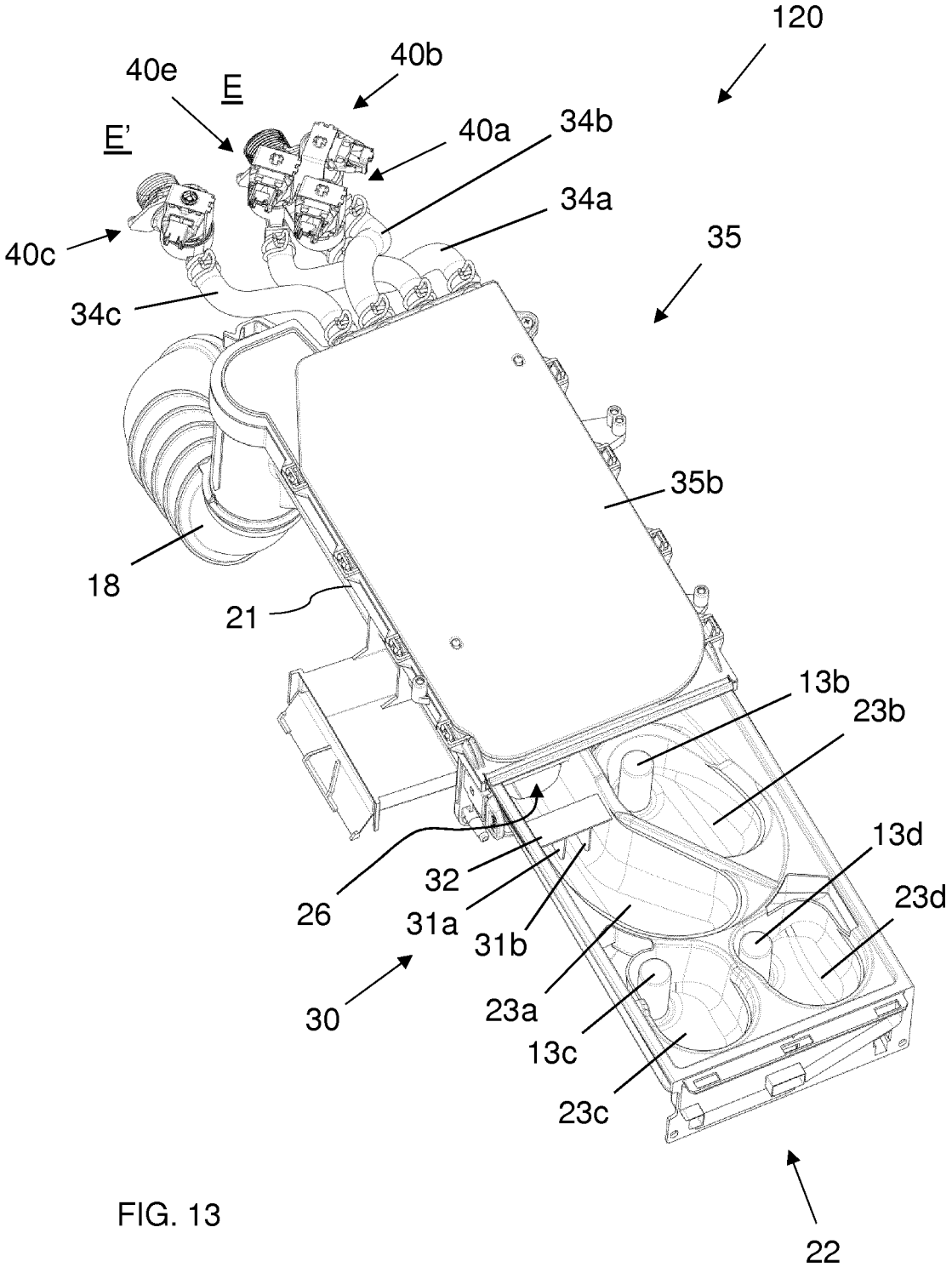
FIG. 13 illustrates another embodiment of the treating agents dispenser of FIG. 5.
Figure 14:
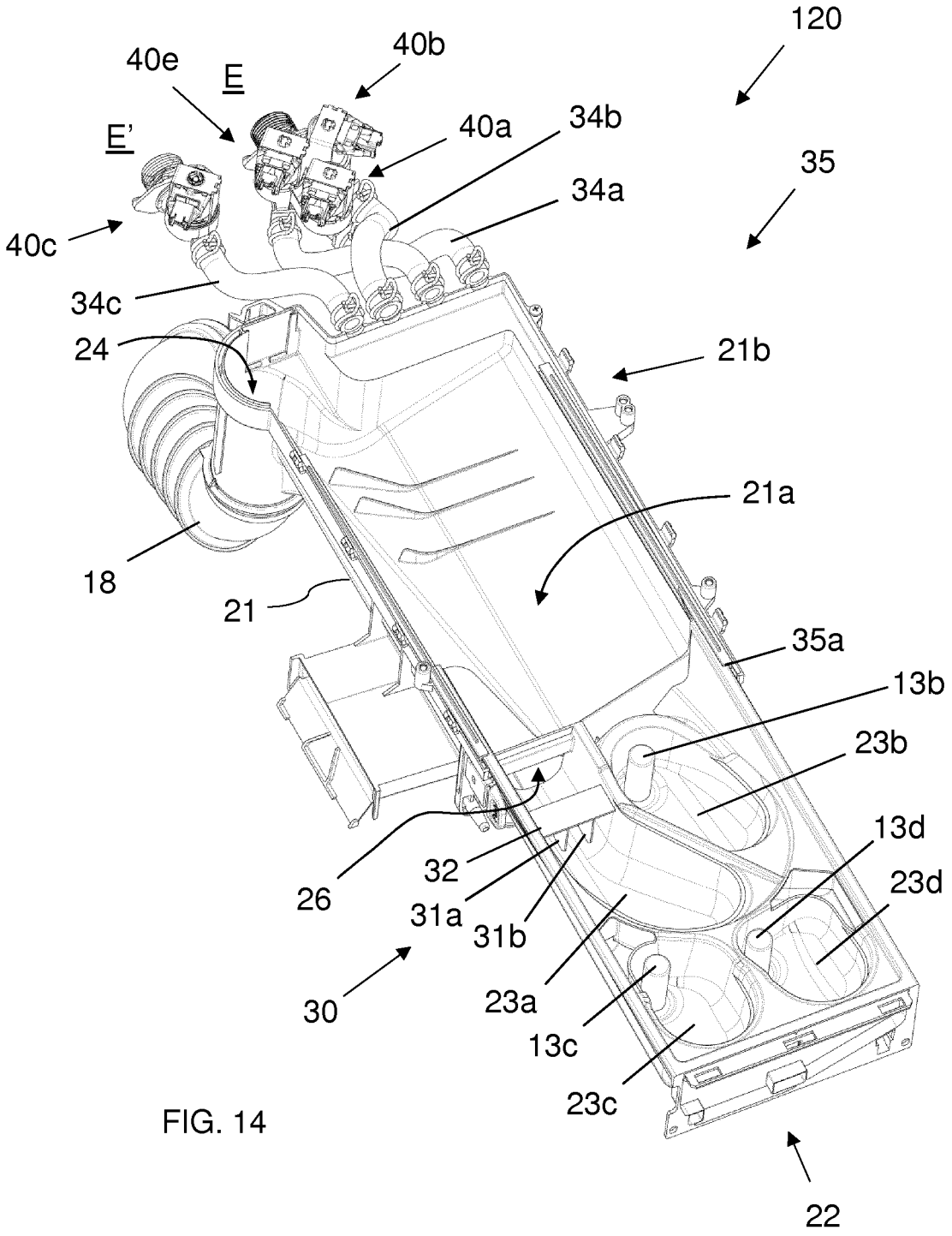
FIG. 14 shows the treating agents dispenser of FIG. 13 with some elements removed therefrom.

FIGS. 13 and 14 illustrate a further embodiment of a treating agents dispenser 120 of a laundry washing machine where a method according to the present invention may be performed.

In the drawings, corresponding characteristics and/or components of the first embodiment previously described are identified by the same reference numbers.

The treating agents dispenser 120 here illustrated and described differs from the treating agents dispenser 20 previously described in that the first compartment 23*a* preferably comprises a stopping device 30.

The stopping device 30 is adapted for stopping the detergent pod DP and preventing it reaching the rear aperture 26 of the first compartment 23*a*. The stopping device 30 is suited to stop the detergent pod DP when the detergent pod DP is intact while it is configured to allow the passage of detergent D which exits the detergent pod DP after its breakage, as will be better described later.

In the embodiment illustrated, the stopping device 30 preferably comprises two ribs 31*a*, 31*b*, vertically arranged in the first compartment 23*a*. An horizontal element 32 connects the ribs 31*a*, 31*b* to lateral side walls of the first compartment 23*a*.

In different embodiments, not illustrated, the stopping device may be differently realized. In a particular case, the compartment itself may be properly shaped so that it accomplishes the function of stopping the detergent pod DP inserted therein, as described later with reference to FIG. 27.

In the preferred embodiment of the invention using this treating agents dispenser 120 with the stopping device 30, the detergent pod DP is placed inside the first compartment 23*a* by the user and the drawer 22 is positioned in its closed operating position.

The method according to the invention comprises a step of conveying water, when required, to the first compartment 23*a* by activating the first valve 40*a*, or the third valve 30*c*, and making the water flowing through the first duct 38*a* and the first region 25*a*, as explained above and shown in FIGS. 9A and 9B.

The water introduced inside the first compartment 23*a* through the outlets 29 preferably pushes the detergent pod DP towards the ribs 31*a*, 31*b* and/or the detergent pod DP itself slips towards the ribs 31*a*, 31*b* along the bottom of the first compartment 23*a*. Slippage of the detergent pod DP along the bottom of the first compartment 23*a* may be caused by the softening effect of water on the external pouch P of the detergent pod DP.

The stopping device 30, and in particular the ribs 31*a*, 31*b*, stops the detergent pod DP and the action of water leads to the dissolution of the external pouch P of the detergent pod DP. The detergent pod D is opened with release of detergent D contained therein. The detergent D is therefore released inside the first compartment 24*a*. The detergent D together with water is then advantageously conveyed towards the aperture 26, the outlet port 24 and the supply pipe 18. The detergent D at the end reaches the washing tub 3.

The washing cycle may then proceed with the following phases, such as water heating, drum rotation, draining phases, spinning cycles, etc., or further water loads.

All the advantages above-mentioned with reference to the first embodiment are achieved.

Tests carried out by the applicant have proved that providing said stopping device 30 leads to a more efficient breakage of the detergent pod D inside the first compartment 23*a* of the drawer 22.

Furthermore, the stopping device 30 guarantees that the dose of detergent D contained in the detergent pod DP is released from the detergent pod DP inside the first compartment 24*a* and before it reaches the laundry.

Advantageously, the detergent D is also at least partially mixed with water before it reaches the laundry and therefore it is more uniformly distributed over the laundry.

FIGS. 15 to 23 illustrate a further embodiment of a treating agents dispenser 220 of a laundry washing machine where a method according to the present invention may be performed.

In the drawings, corresponding characteristics and/or components previously described are identified by the same reference numbers.

The treating agents dispenser 220 comprises a box-shaped housing 21, connected to the external casing 2, internally to the latter, preferably by suitable fixing means, comprising, for example, screws or rivets, not illustrated, or also glue, or welding.

In the enclosed Figures, the housing 21 is advantageously substantially parallelepiped, and it is connected to the frontal side wall 2*a* of the external casing 2, opportunely in an upper region of the latter, positioned above the tub 3.

Figure 15:
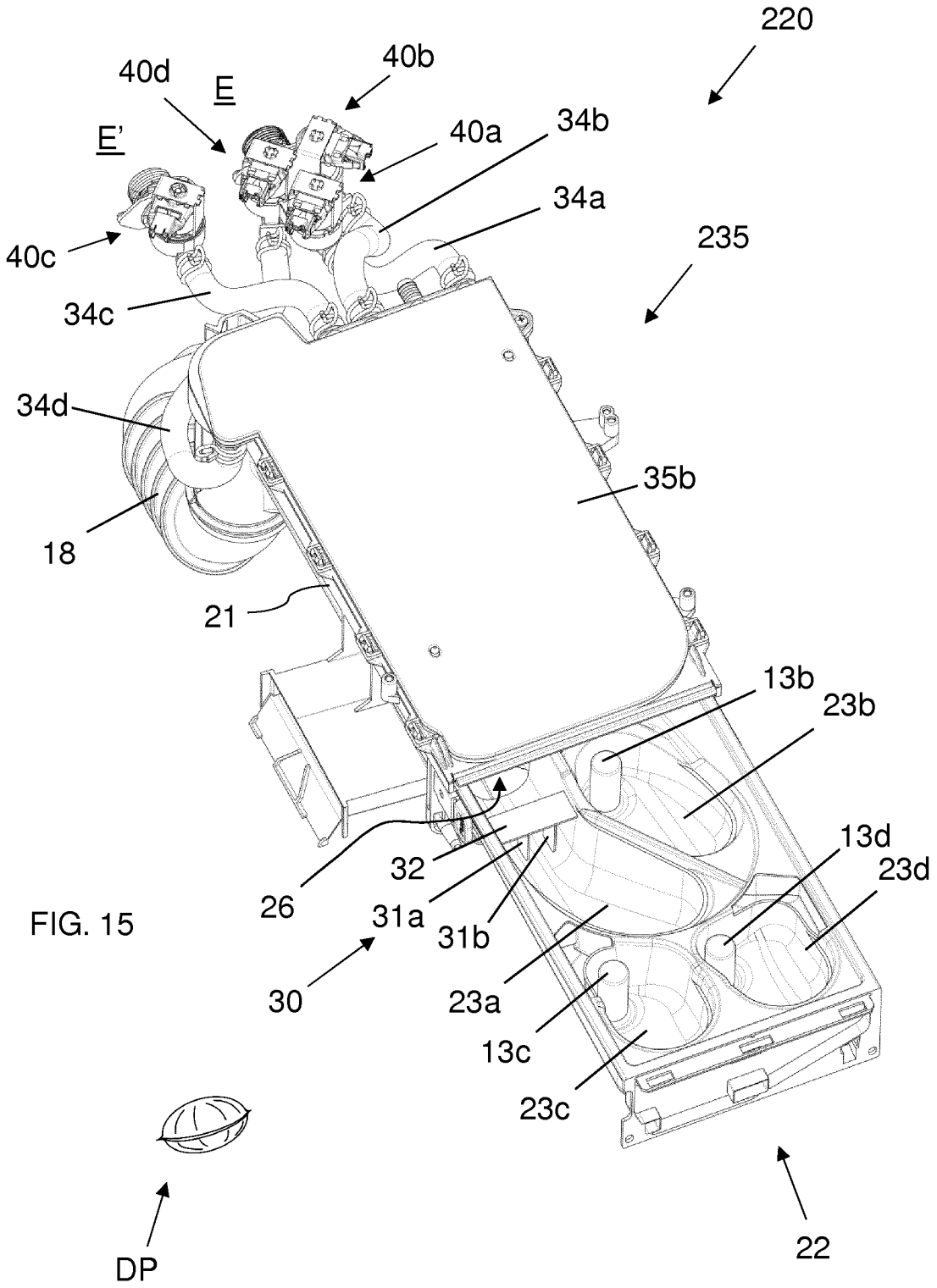
FIG. 15 illustrates a further embodiment of the treating agents dispenser of FIG. 5.
Figure 16:
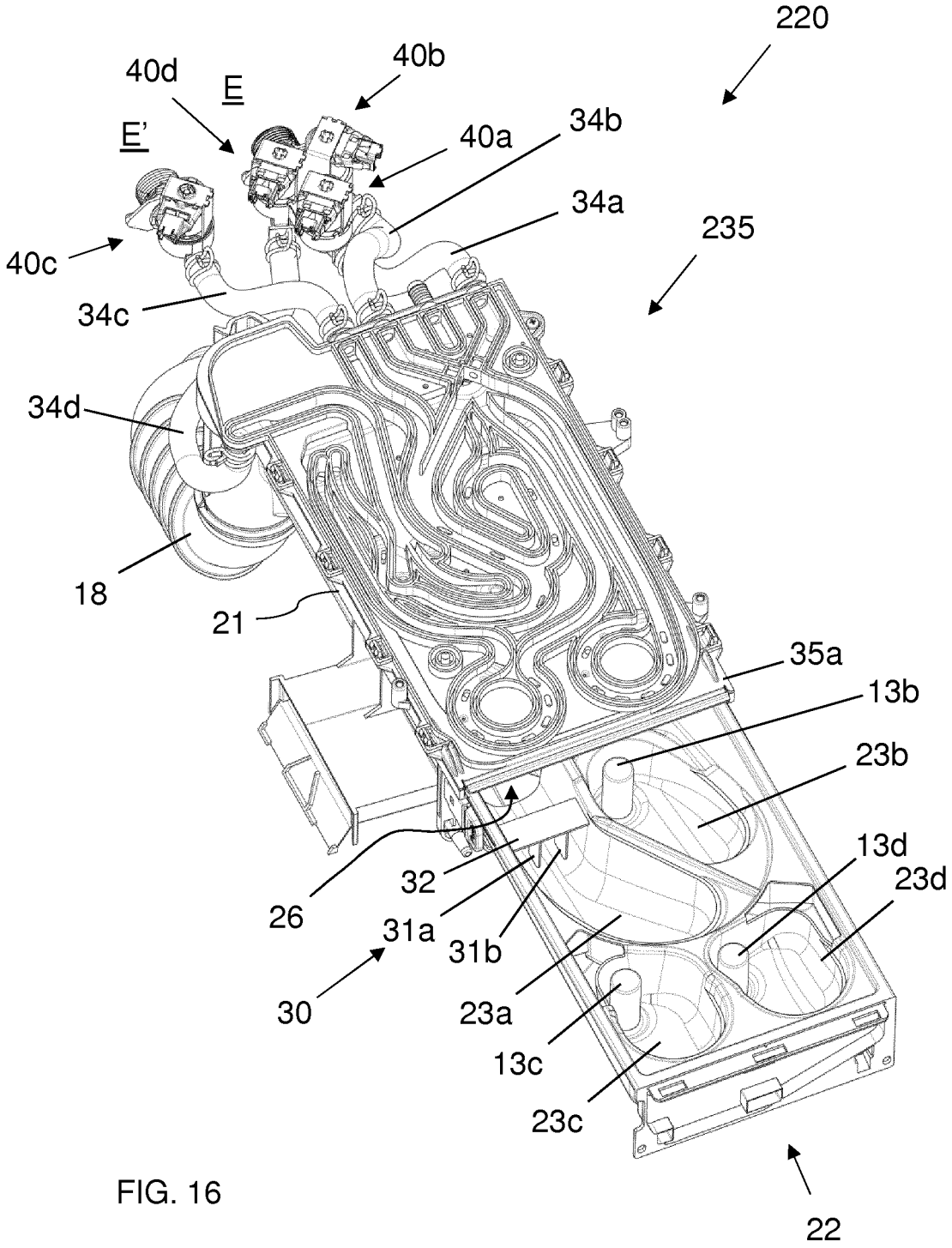
FIG. 16 shows the treating agents dispenser of FIG. 15 with an element removed therefrom.
Figure 17:
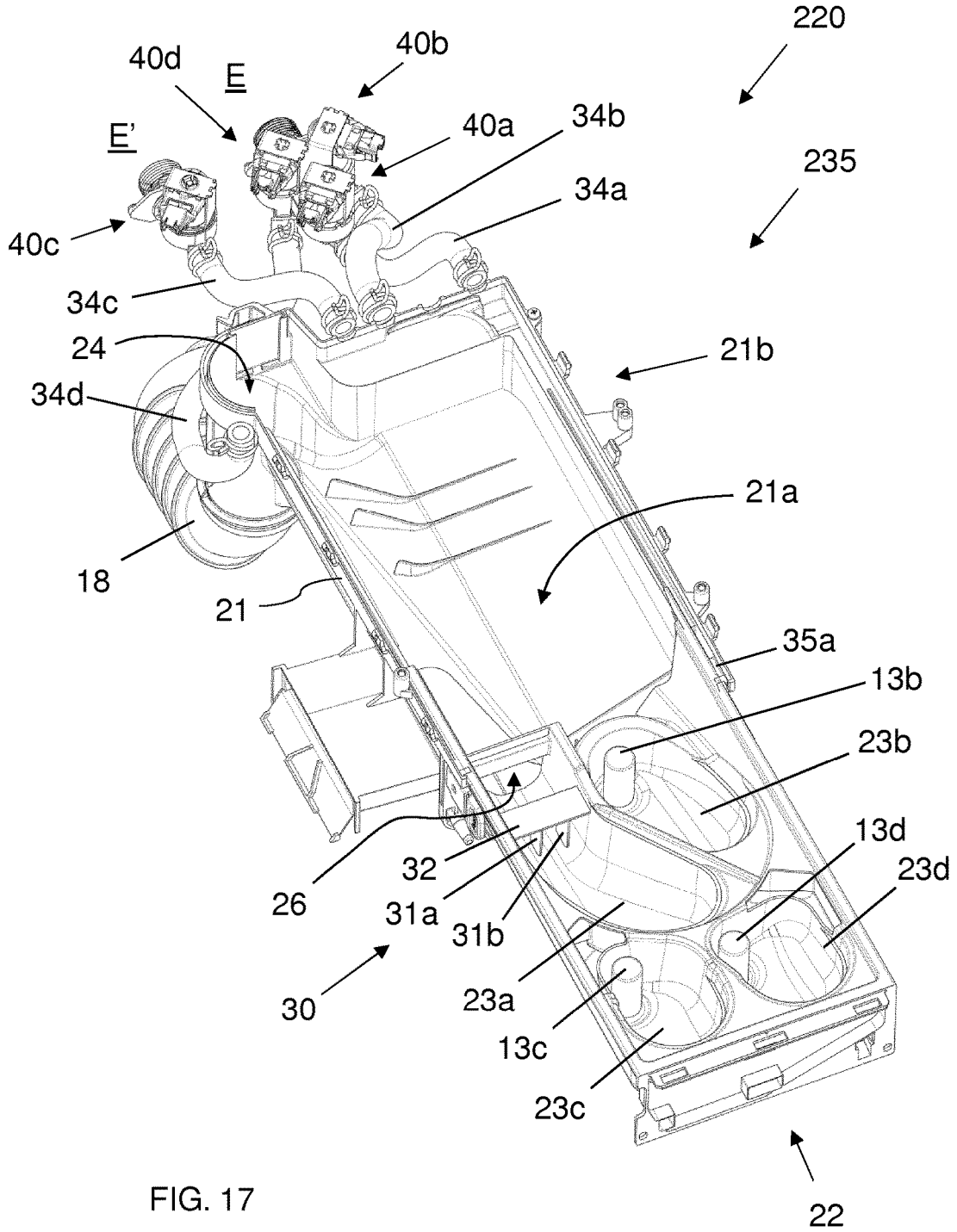
FIG. 17 shows the treating agents dispenser of FIG. 16 with a further element removed therefrom.
Figure 18:
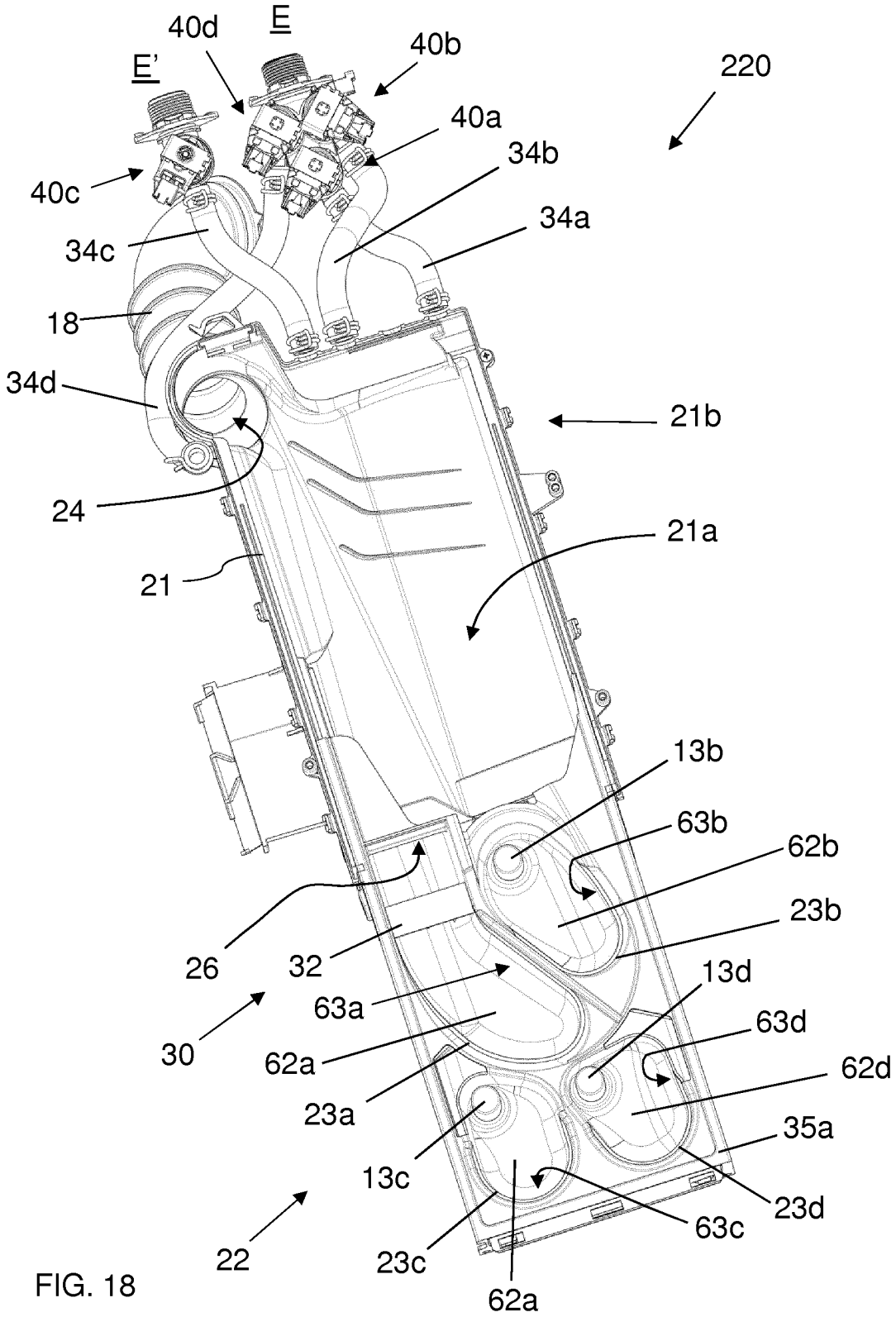
FIG. 18 shows the treating agents dispenser of FIG. 17 from a slightly different point of view.
Figure 19:
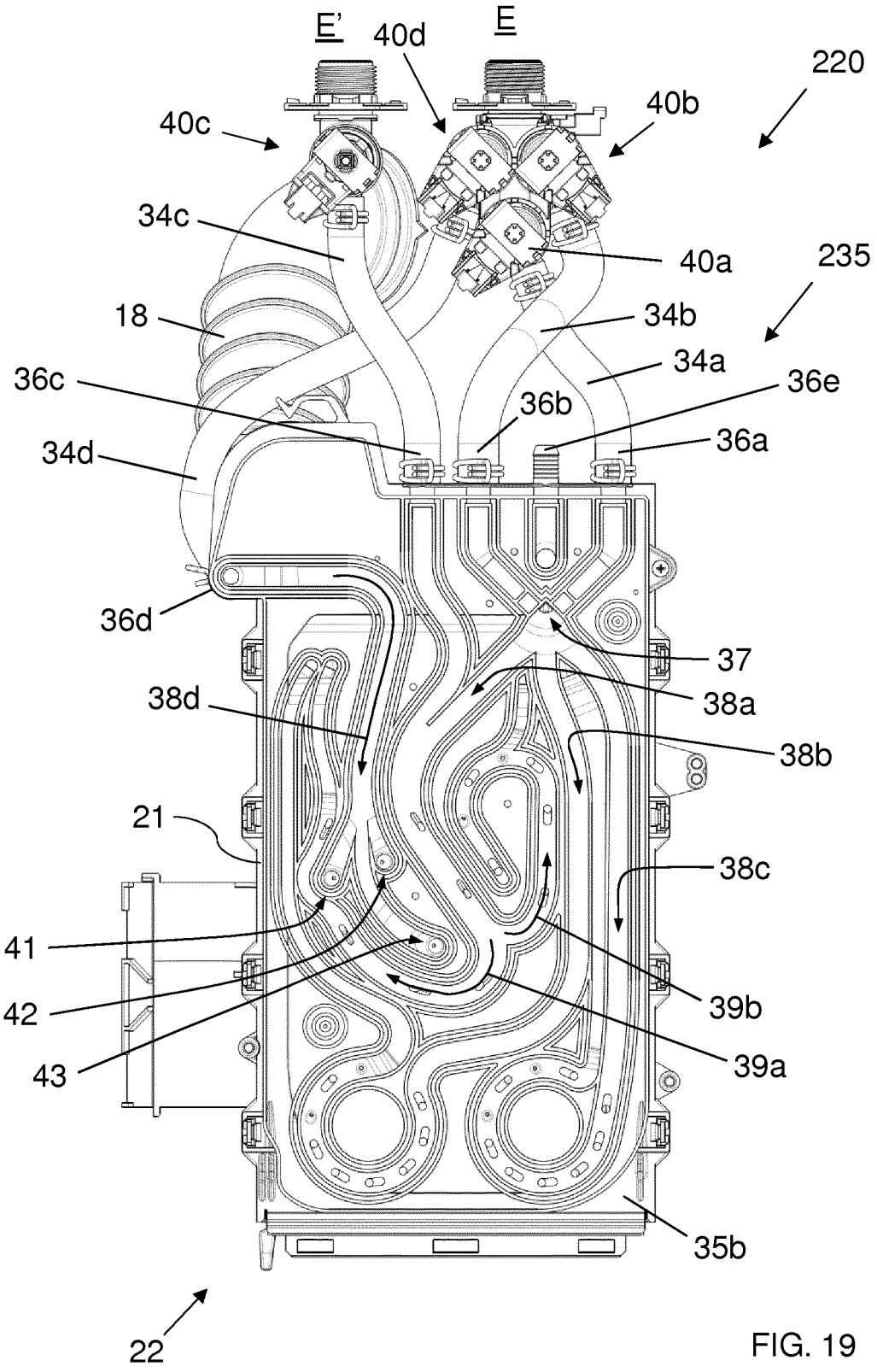
FIG. 19 is a plan view of the treating agents dispenser of FIG. 16 with the drawer in its closed position.

The housing 21 contains a removable drawer 22 which can be extracted from the housing 21, such as to protrude from the external casing 2 in a opened loading position, as illustrated for example in FIG. 15, or can be fully inserted into the housing 21 in an operative position, as illustrated for example in FIG. 19.

The drawer 22 is provided with one or more compartments 23*a*, 23*b*, 23*c*, 23*d* adapted to be filled with treating agents.

In the embodiment illustrated in the Figures, there are four compartments, 23*a*, 23*b*, 23*c* and 23*d*.

The first compartment 23*a* is preferably adapted for receiving a powder detergent; the second compartment 23*b* is preferably adapted for receiving a quantity of liquid detergent; the third compartment 23*c* is preferably adapted for receiving a softener; the fourth compartment 23*d* is preferably adapted for receiving other treating agents, such as fabric conditioners, waterproofing agents, fabric enhancers, rinse sanitization additives, chlorine-based additives, etc.

According to an advantageous aspect of the present invention, the first compartment 23*a* is preferably adapted for receiving also a detergent pod DP.

The detergent pod DP comprises a pre-measured amount, or single dose, of detergent D incorporated into a water-soluble pouch P, as described above.

The compartments 23*a*, 23*b*, 23*c* and 23*d* are fluidly connected to the bottom 21*a* of the housing 21, particularly to the rear portion 21*b* of this bottom 21*a*, in which an outlet port 24 is obtained. The outlet port 24 is adapted to allow the flowing of a liquid into a supply pipe 18 fluidly connecting the treating agents dispenser 220 and the tub 3, as visible in FIG. 18.

The bottom 21*a* of the housing 21 preferably has a sloped bottom so that a fluid may flow towards the outlet port 24. The outlet port 24 is preferably located at the rear of the sloped bottom wall 21*a*.

The first compartment 23*a* of the drawer 22 is fluidly connected to the bottom 21*a* of the housing 21 through an aperture 26 defined at the rear of the first compartment 23*a*.

The first compartment 23*a* preferably has a sloped bottom wall 62*a* so that a fluid may flow towards the aperture 26. The aperture 26 is located at the rear of the sloped bottom wall 62*a*.

According to an aspect of the invention, the first compartment 23*a* then preferably comprises a stopping device 30 adapted for stopping the detergent pod DP and preventing it reaching the rear aperture 26 of the first compartment 23*a*. The stopping device 30 is suited to stop the detergent pod DP when the detergent pod DP is intact while it is configured to allow the passage of detergent D which exits the detergent pod DP after its breakage, as will be better described later.

In the embodiment illustrated, the stopping device 30 preferably comprises two ribs 31*a*, 31*b*, vertically arranged in the first compartment 23*a*. An horizontal element 32 connects the ribs 31*a*, 31*b* to lateral side walls of the first compartment 23*a*.

According to an aspect of the invention, therefore, the first compartment 23*a* is suited to receive the detergent pod DP.

The other compartments 23*b*, 23*c* and 23*d* of the drawer 22 are preferably fluidly connected to the bottom 21*a* of the housing 21 through respective siphons 13*b*, 13*c*, 13*d*.

Advantageously, the treating agents dispenser 220 comprises a water distributor 235, associated to the housing 21 and placed above the drawer 22 in such a way to allow the flowing of water to one or more of said compartments 23*a*, 23*b*, 23*c*, 23*d*.

The treating agents dispenser 220 comprises one or more water conveying lines adapted for conveying water to one or more of said compartments 23*a*, 23*b*, 23*c*, 23*d*.

The water distributor 235 preferably comprises a lower part 35*a* and an upper closing part 35*b* structured for being reciprocally coupled to form the water distributor 235. The two parts 35*a*, 35*b* are preferably coupled by welding and/or glueing and/or joint.

Advantageously, the water distributor 235 comprises a first and a second inlet connector 36*a*, 36*b*, connectable to a water source E which could comprise, for example, the plumbing of the building in which the laundry washing machine is installed, as better visible in FIG. 19.

Advantageously the first and second connectors 36*a*, 36*b* can be connected to the water source E via first and second controllable valves 40*a*, 40*b*, preferably of the electromagnetic type, opportunely controlled by the control unit 11. In the embodiment illustrated in the enclosed Figures, the two inlet connectors 36*a*, 36*b* can be connected via the dedicated controllable valves 40*a*, 40*b*, to the water source E for the adduction of cold water.

Inlets of the two controllable valves 40*a*, 40*b* are connectable to the water source E and outlets of the two controllable valves 40*a*, 40*b* are connected, through respective pipes 34*a*, 34*b*, to the two inlet connectors 36*a*, 36*b* of the water distributor 235.

There is also provided a third inlet connector 36*c* connectable, via a third controllable valve 40*c*, to a warm or hot water source E' (as visible in FIG. 19); the further inlet connector 36*c* can be fed with warm or hot water, for example obtained by a solar thermal collector; in a further embodiment, not illustrated, there could be more than one further inlet connectors, connected to one or more water sources.

Inlet of the third controllable valve 40*c* is connectable to the water source E' and outlet of the third controllable valve 40*c* is connected, through a respective pipe 34*c*, to the third inlet connector 36*c* of the water distributor 235.

Three ducts 38*a*, 38*b*, 38*c* are fluidly connected to the inlet connectors 36*a*, 36*b*. Each one of said three ducts 38*a*, 38*b*, 38*c* fluidly communicates with a different region 25*a*, 25*b*, 25*c*, 25*d* of the water distributor 235. Each region 25*a*, 25*b*, 25*c*, 25*d* is positioned in such a way to be placed above a respective compartment 23*a*, 23*b*, 23*c*, 23*d* of the drawer 22 when the latter is placed in its closed operative position.

Preferably, the inlet connectors 36*a*, 36*b* and the three ducts 38*a*, 38*b*, 38*c* are connected through a so called "air-break" 37, that is a safety system comprising an opening obtained in the water path in such a way to ensure that a stream of water can flow from the inlet connectors 36*a*, 36*b* to the three ducts 38*a*, 38*b*, 38*c* due to the water source pressure, while water can't flow from the ducts 38*a*, 38*b*, 38*c* to the inlet connectors 36*a*, 36*b*. In the embodiment illustrated, the "air-break" 37 advantageously comprises a lower opening 37*a*, better visible in FIG. 21.

The regions 25*a*, 25*b*, 25*c* and 25*d* of the water distributor 235 are provided with one or more outlets 29 that allow the passage of the water from the ducts 38*a*, 38*b*, 38*c* to the underlying compartments 23*a*, 23*b*, 23*c*, 23*d*.

Outlets 29 are preferably arranged in the water distributor 235 so that the water falling into the underlying compartments 23*a*, 23*b*, 23*c*, 23*d* hits the lateral side walls 63*a*, 63*b*, 63*c*, 63*d* of the respective compartment 23*a*, 23*b*, 23*c*, 23*d* and then flows towards the bottom side 62*a*, 62*b*, 62*c*, 62*d* of the respective compartment 23*a*, 23*b*, 23*c*, 23*d*.

Figure 23:
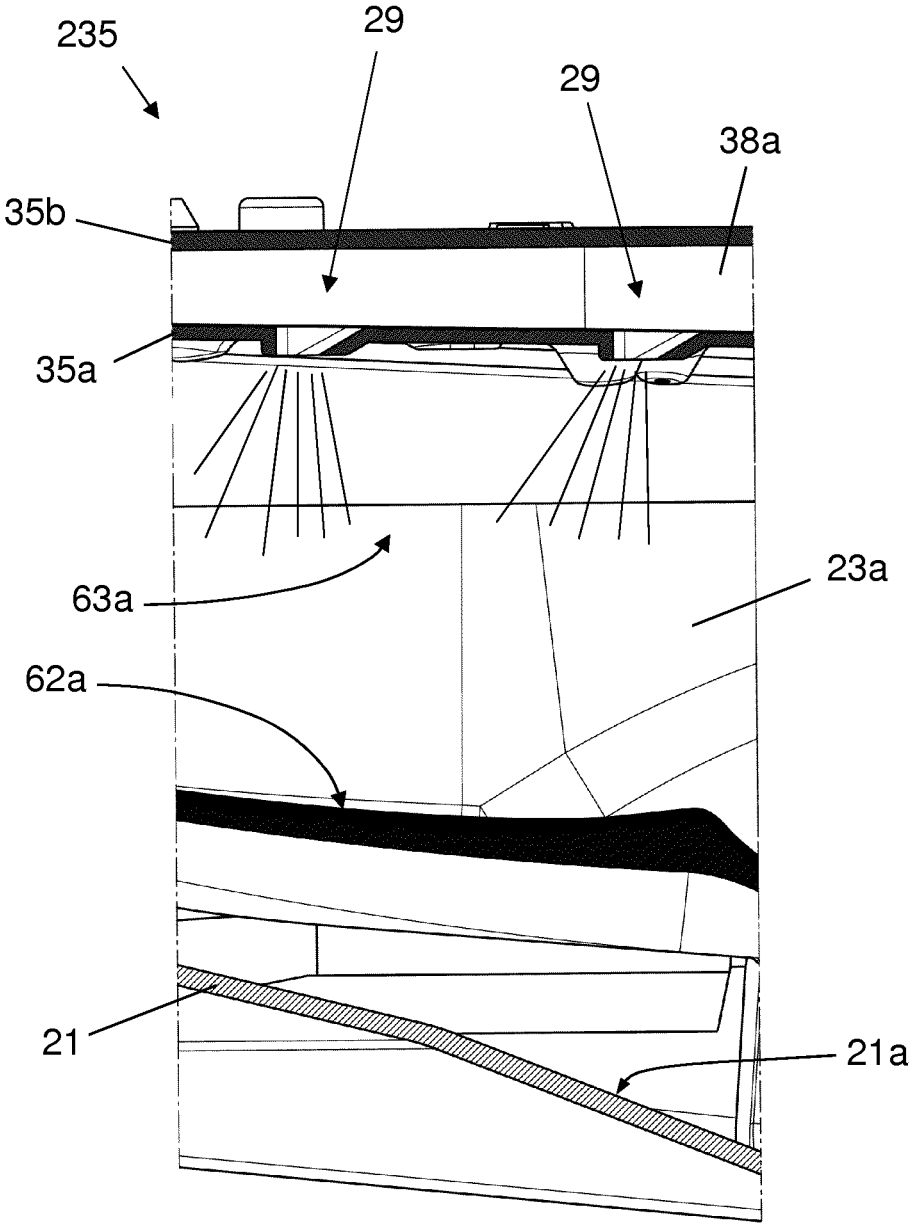
FIG. 23 shows a plan view of the treating agents dispenser of FIG. 20 sectioned along line XXIII°-XXIII°.

FIG. 23 illustrates a section view of two of said outlets 29.

Outlets 29 here illustrated allow the passage of water from the first duct 38*a* to the underlying first compartment 23*a*. Water spreading out from the outlets 29 hits the lateral side wall 63*a* of the first compartment 23*a* and falls down by gravity into the bottom 62*a* of the same. Advantageously, when the first compartment 23*a* is filled with powder detergent, the water drags the detergent towards the rear aperture 26 of the first compartment 23*a*. Furthermore, once all the detergent has been conveyed towards the rear aperture 26, the water hitting the lateral side wall 63*a* advantageously clean the first compartment 23*a*. Analogously, the same cleaning effect for the other compartments 23*b*, 23*c*, 23*d* is obtained through outlets 29.

With reference to ducts 38*a*, 38*b*, 38*c*, they are advantageously defined between lower part 35*a* and the upper closing part 35*b* of the water distributor 235.

In particular, as will be better explained in the following, by acting on the controllable valves 40*a*, 40*b* and 40*c*, it is possible to selectively feed one of the ducts 38*a*, 38*b* and 38*c* and one or more compartments 23*a*, 23*b*, 23*c*, 23*d* with water coming from the water source E or E'.

Figure 19B:
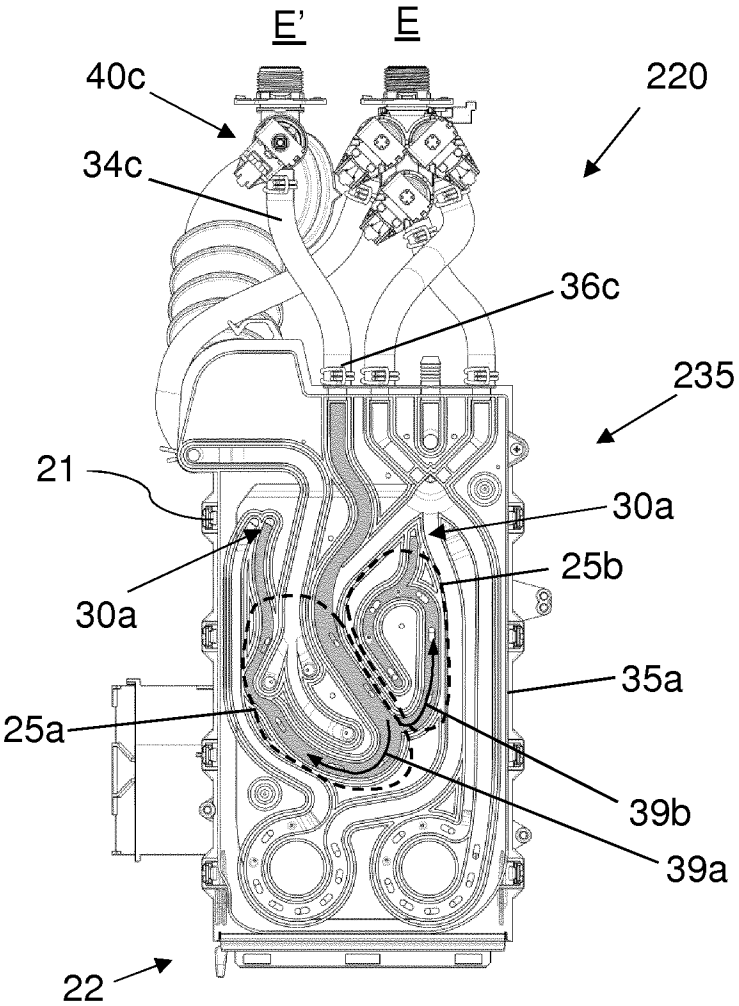
FIGS. 19A to 19E schematically illustrate different working conditions of the treating agents dispenser of FIG. 19.
Figure 19A:
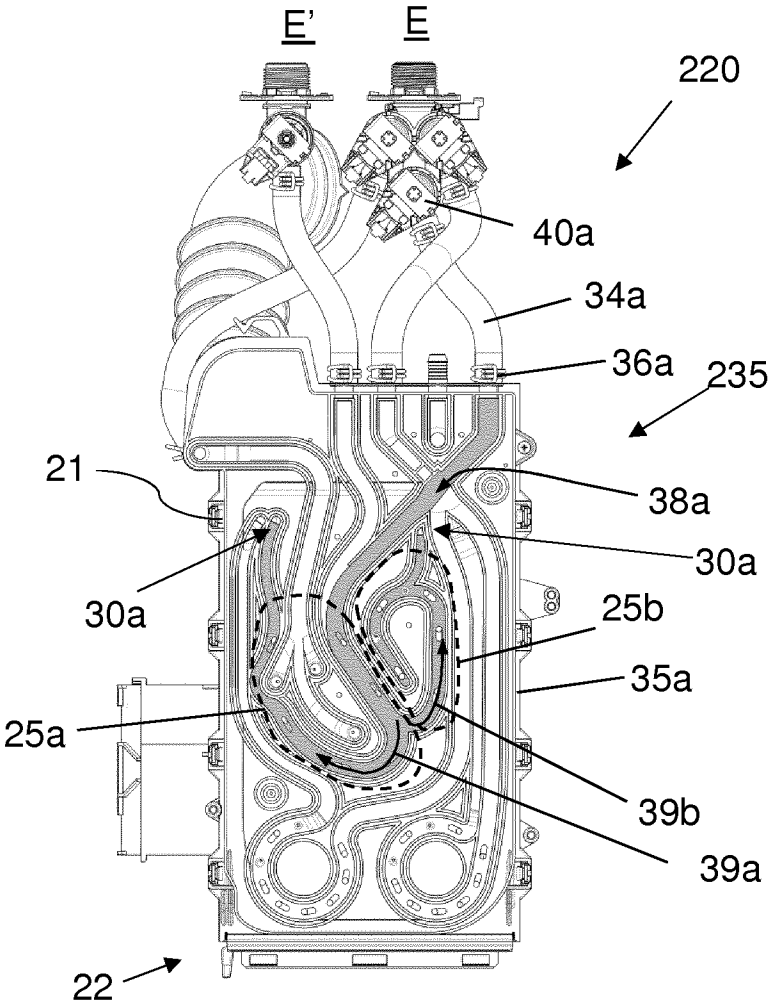

More in particular, the first duct 38*a* communicates with two regions 25*a*, 25*b* of the water distributor 235 which are positioned above the first and second compartments 23*a*, 23*b*, as indicated in FIG. 19A.

At this purpose, the first duct 38*a* bifurcates into two branches 39*a*, 39*b* communicating with the two regions 25*a*, 25*b*.

Water is conveyed to the two compartments 23*a*, 23*b* of the drawer 22 by activating the first valve 40*a* and making the water flowing through the first duct 38*a* and its branches 39*a*, 39*b* up to the regions 25*a*, 25*b*, as schematically indicated in FIG. 19A with grey path.

In the embodiment illustrated in the enclosed Figures also the further connector 36*c*, which can be fed with warm or hot water, is fluidly connected to the two regions 25*a*, 25*b* of the water distributor 235, in such a way to adduct also warm or hot water in the underlying first and second compartments 23*a*, 23*b*, as schematically indicated in FIG. 19B.

In a further preferred embodiment, not illustrated, the water distributor may comprise a dedicated duct and valve for each compartment, i.e. a duct communicating with the first region and another duct communicating with the second region.

The second duct 38*b* communicates with the third region 25*c* of the water distributor 235 which is positioned above the third compartment 23*c*.

Figure 19D:
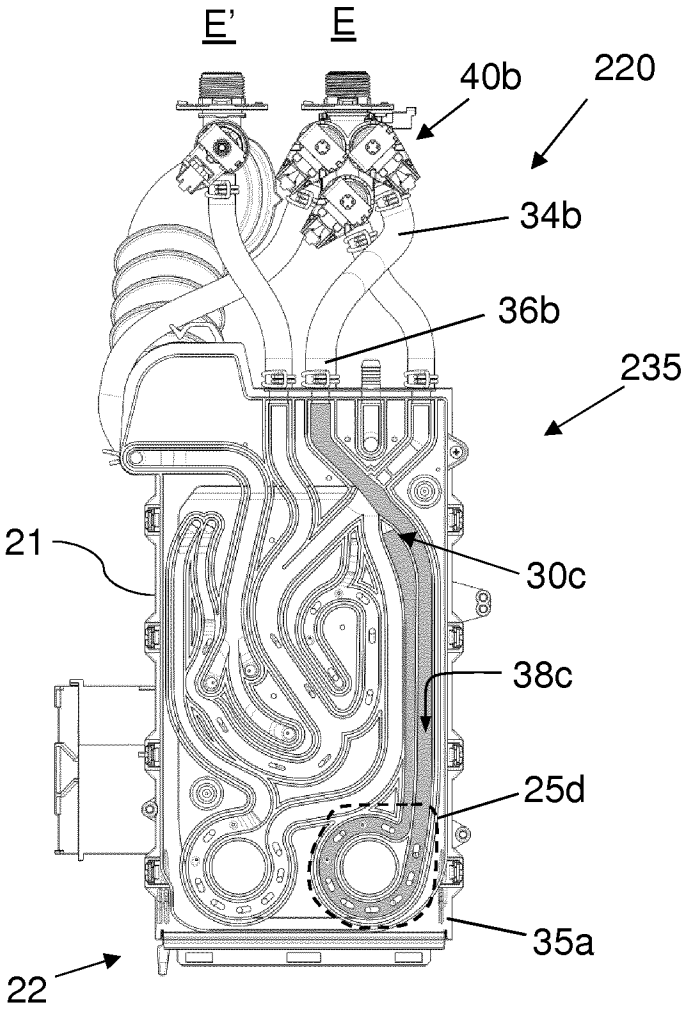
Figure 19C:
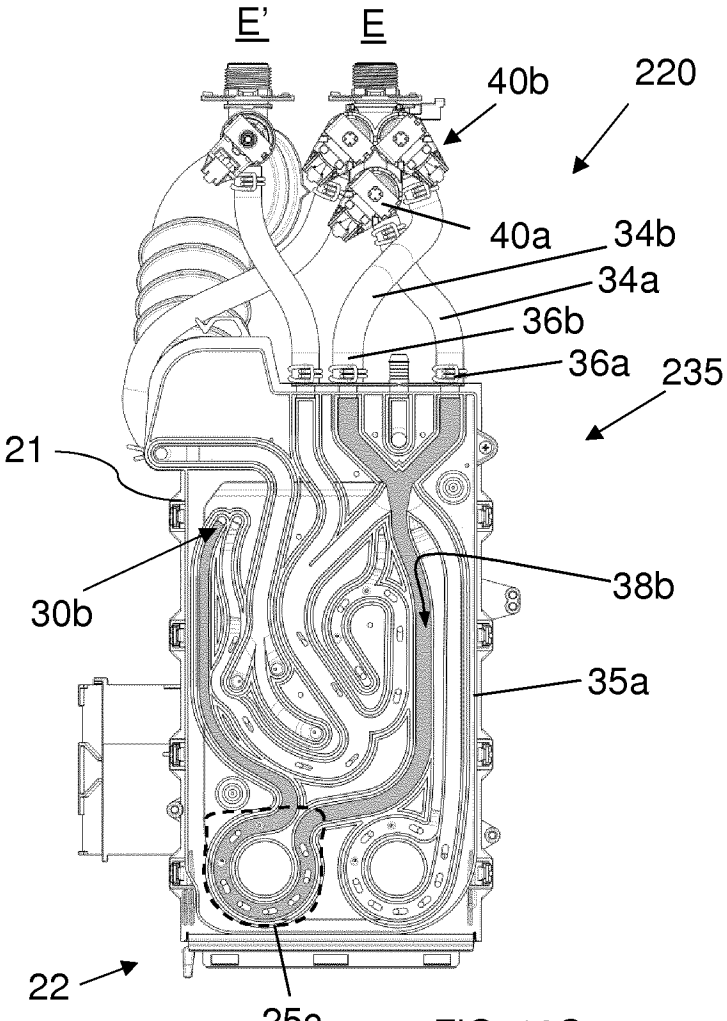

Water is conveyed to the third compartment 23*c* of the drawer 22 by activating simultaneously the first and second valves 40*a*, 40*b* and making the water flowing through the second duct 38*b* up to the third region 25*c*, as schematically indicated in FIG. 19C.

The third duct 38*c* communicates with the fourth region 25*d* of the water distributor 235 which is positioned above the fourth compartment 23*d*.

Water is conveyed to the fourth compartment 23*d* of the drawer 22 by activating the second valve 40*b* and making the water flowing through the third duct 38*c* up to the fourth region 25*d*, as schematically indicated in FIG. 19D.

In another embodiment, not illustrated, in the drawer there can be more than four compartments, and in the water distributor there can be more than three ducts, each one fluidly communicating with a different region of the water distributor which is positioned in such a way to be placed above a different compartment of the drawer when the latter is placed in its closed operative position; also in this case, by acting on the controllable valves, it is possible to selectively feed a desired duct with water coming from the water source.

In further embodiment, not illustrated, in the drawer there can be less than four compartments, even just one, and in the water distributor there can be less than three ducts, each one fluidly communicating with a different region of the water distributor which is positioned in such a way to be placed above a different compartment of the drawer when the latter is placed in its closed operative position; also in this case, by acting on the controllable valves, it is possible to selectively feed a desired duct with water coming from the water source.

Preferably, branches 39*a*, 39*b* of the first duct 38*a* are also provided with terminal outlets 30*a* which are placed above the drawer 22 in such a way to allow the flowing of water directly to the bottom 21*a* of the housing 21 and outside the compartments 23*a*, 23*b*, 23*c*, 23*d* without entering the compartments 23*a*, 23*b*, 23*c*, 23*d*.

Also, second and third ducts 38*b*, 38*c* are preferably provided with terminal outlets 30*b*, 30*c* which are placed above the drawer 22 in such a way to allow the flowing of water directly to the bottom 21*a* of the housing 21 and outside the compartments 23*a*, 23*b*, 23*c*, 23*d* without entering the compartments 23*a*, 23*b*, 23*c*, 23*d*.

Terminal outlets 30*a*, 30*b*, 30*c* allow the flowing of exceeding water (overflow) of the respective duct 38*b*, 38*c* directly to the bottom 21*a* of the housing 21.

All the above mentioned terminal outlets 30*a*, 30*b*, 30*c*, as known in the art, are outlets which allows the water falling down by gravity to the underlying area/s.

Figure 22:
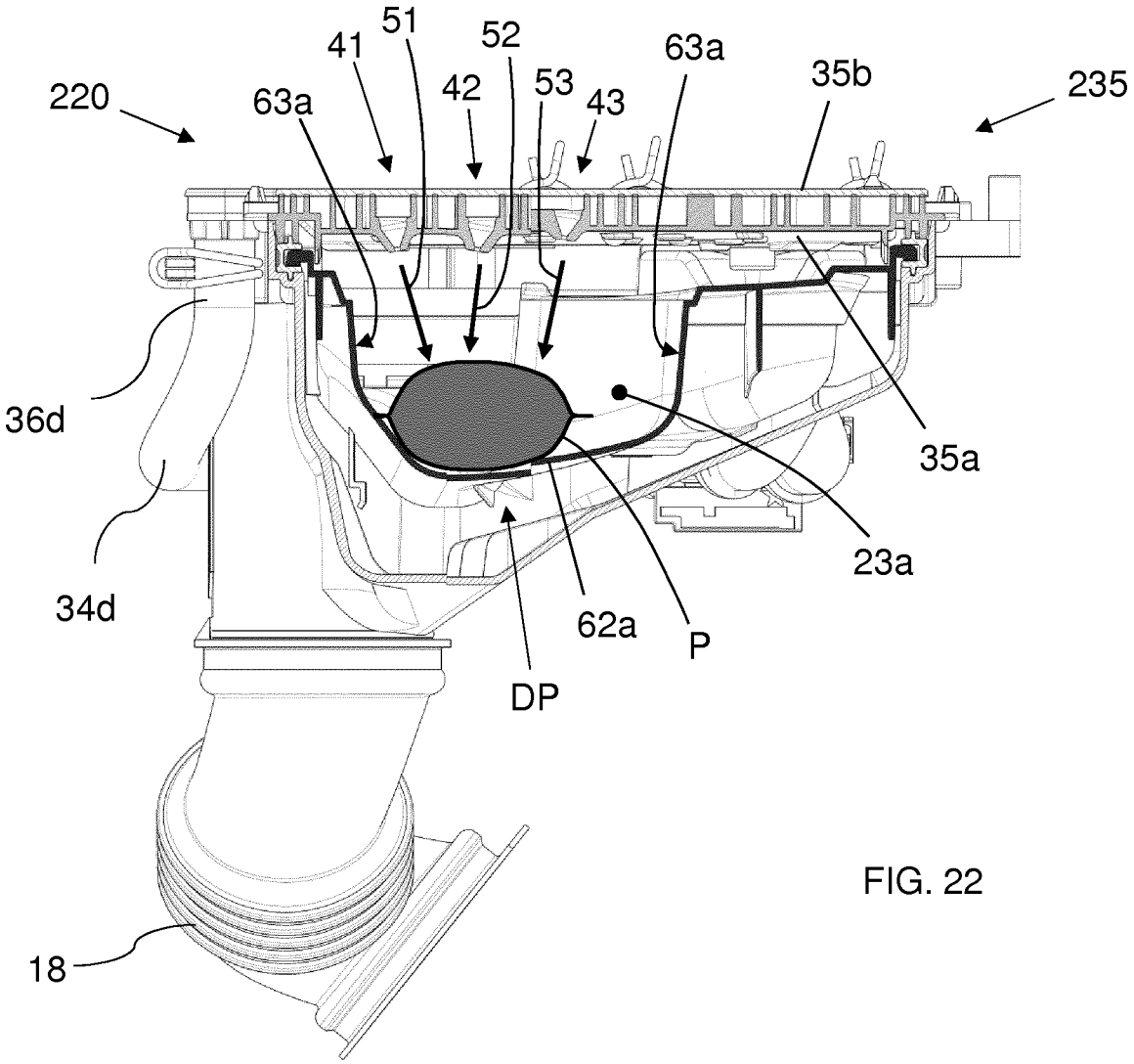
FIG. 22 shows a plan view of the treating agents dispenser of FIG. 20 sectioned along line XXII°-XXII° with a unit dose detergent inserted therein.

According to an aspect of the present invention, there is also provided a water conveying line for generating one or more water jets, schematically indicated with arrows 51, 52, 53 in FIG. 22, directed into the first compartment 23*a* which receives the detergent pod DP. The water jets 51, 52, 53, as illustrated in FIG. 22, are suited to hit the detergent pod DP and to break/perforate/cut its water-soluble pouch P.

For simplicity's sake, hereinafter we will use the sole term "break" to indicate the action of perforating or cutting the water-soluble pouch P of the detergent pod DP. The action of breaking or perforating or cutting the pouch has to be intended as an action of breaking the pouch by a mechanical action of the water jet and not exclusively by dissolution of the pouch in contact with water.

At this purpose, the water distributor 235 comprises a fourth inlet connector 36*d* connectable, via a dedicated fourth controllable valve 40*d*, to the water source E; the fourth inlet connector 36*d* can be fed with cold or warm or hot water.

Inlet of the fourth controllable valve 40*d* is connectable to the water source E and outlet of the fourth controllable valve 40*d* is connected, through a respective pipe 34*d*, to the fourth inlet connector 36*d* of the water distributor 235.

Figure 19E:
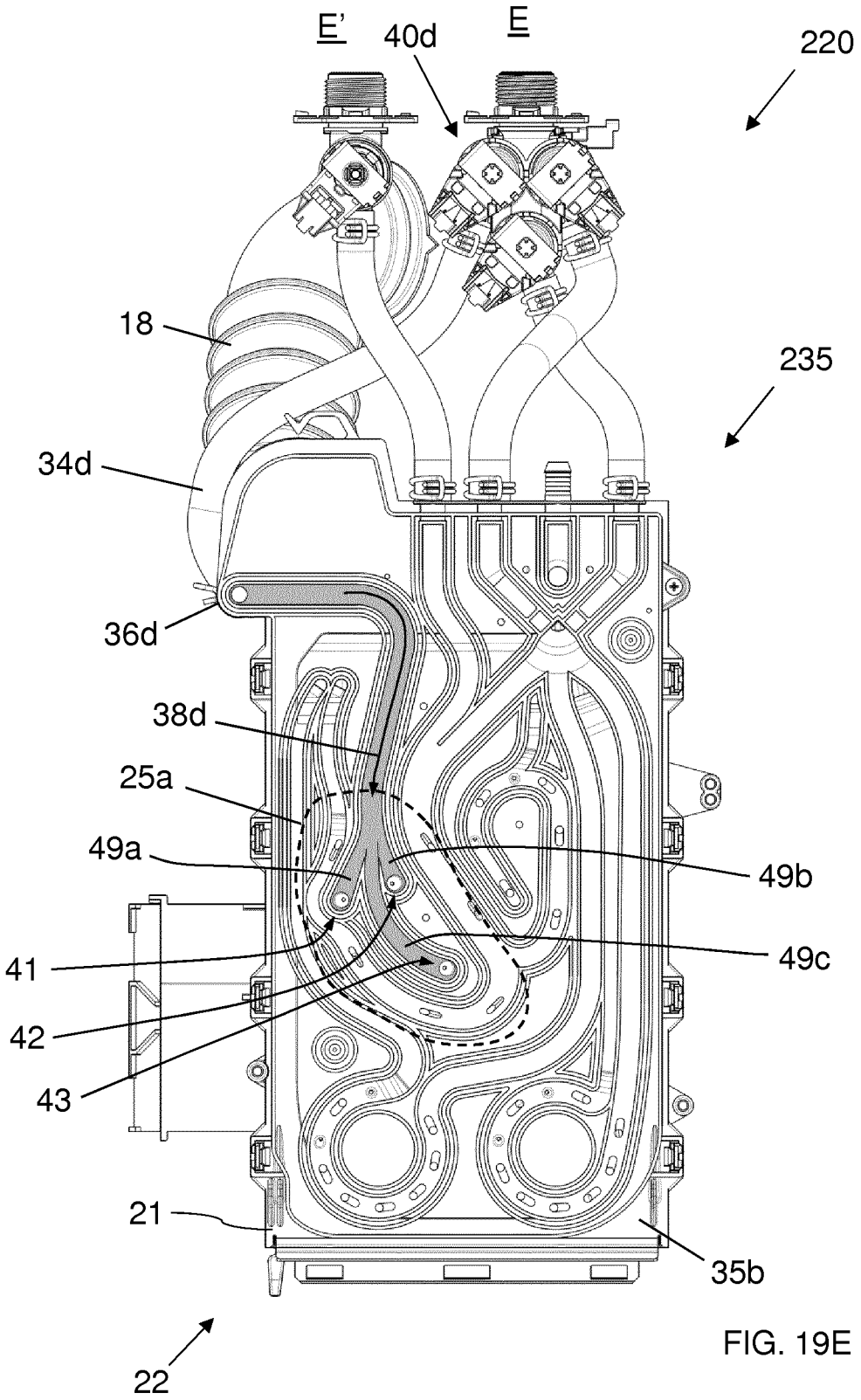
Figure 20:
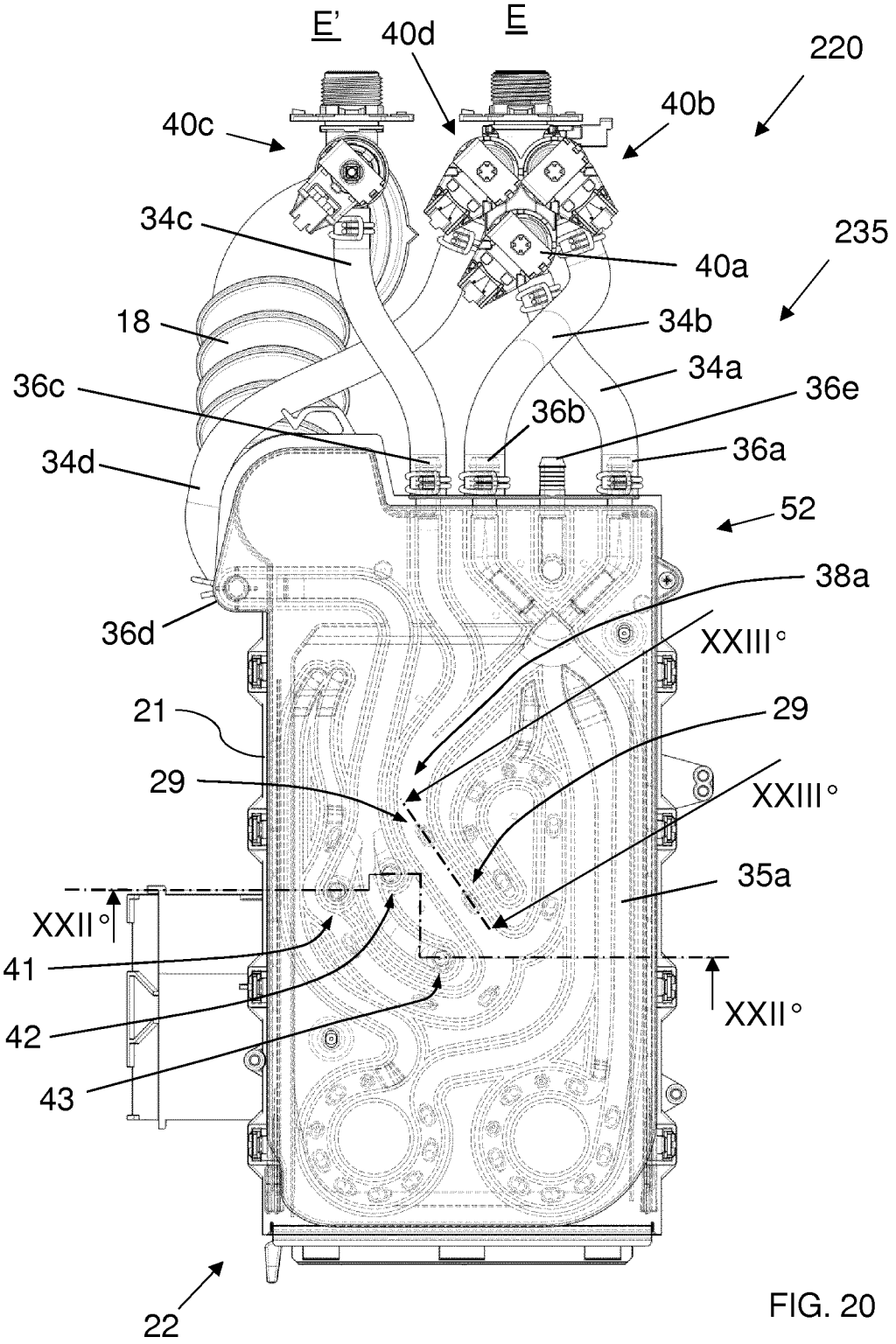
FIG. 20 is a plan view of the treating agents dispenser of FIG. 15 with the drawer in its closed position in which the underlying not visible components have been represented in dotted lines.
Figure 21:
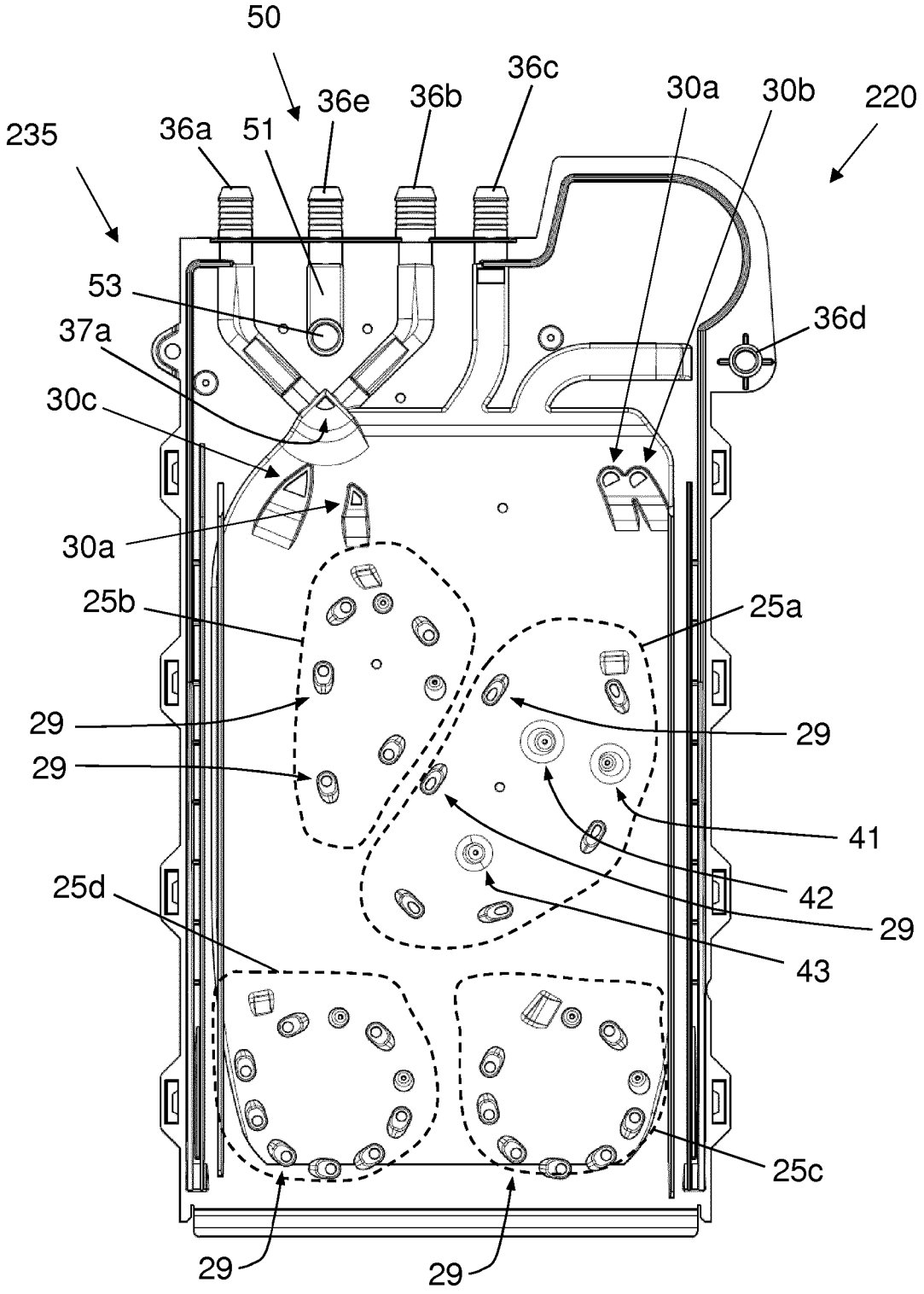
FIG. 21 shows a plan view, from below, of the upper part of the treating agents dispenser of FIG. 15.

Preferably a fourth duct 38*d* is fluidly connected to the fourth connector 36*d* and communicates with the first region 25*a* of the wash dispenser 235 which is, as said above, positioned above the first compartment 23*a* of the drawer 22, as better illustrated in FIG. 19E.

Water is conveyed to the first compartment 23*a* of the drawer 22 by activating the fourth valve 40*d* and making the water flowing through the fourth duct 38*d* up to the first region 25*a*.

The fourth duct 38*d* is preferably provided with nozzles 41, 42 and 43 adapted to allow the passage of the water from the fourth duct 38*d* to the underlying first compartment 23*a* and adapted for generating said water jets 51, 52, 53. As said above, the impact of the water jets against the detergent pod DP breaks its water-soluble pouch P.

Tests carried out by the applicant have proved that nozzles 41, 42 and 43 opportunely shaped, as described in the following, generate water jets suitable to break water-soluble pouch P.

Figure 22A:
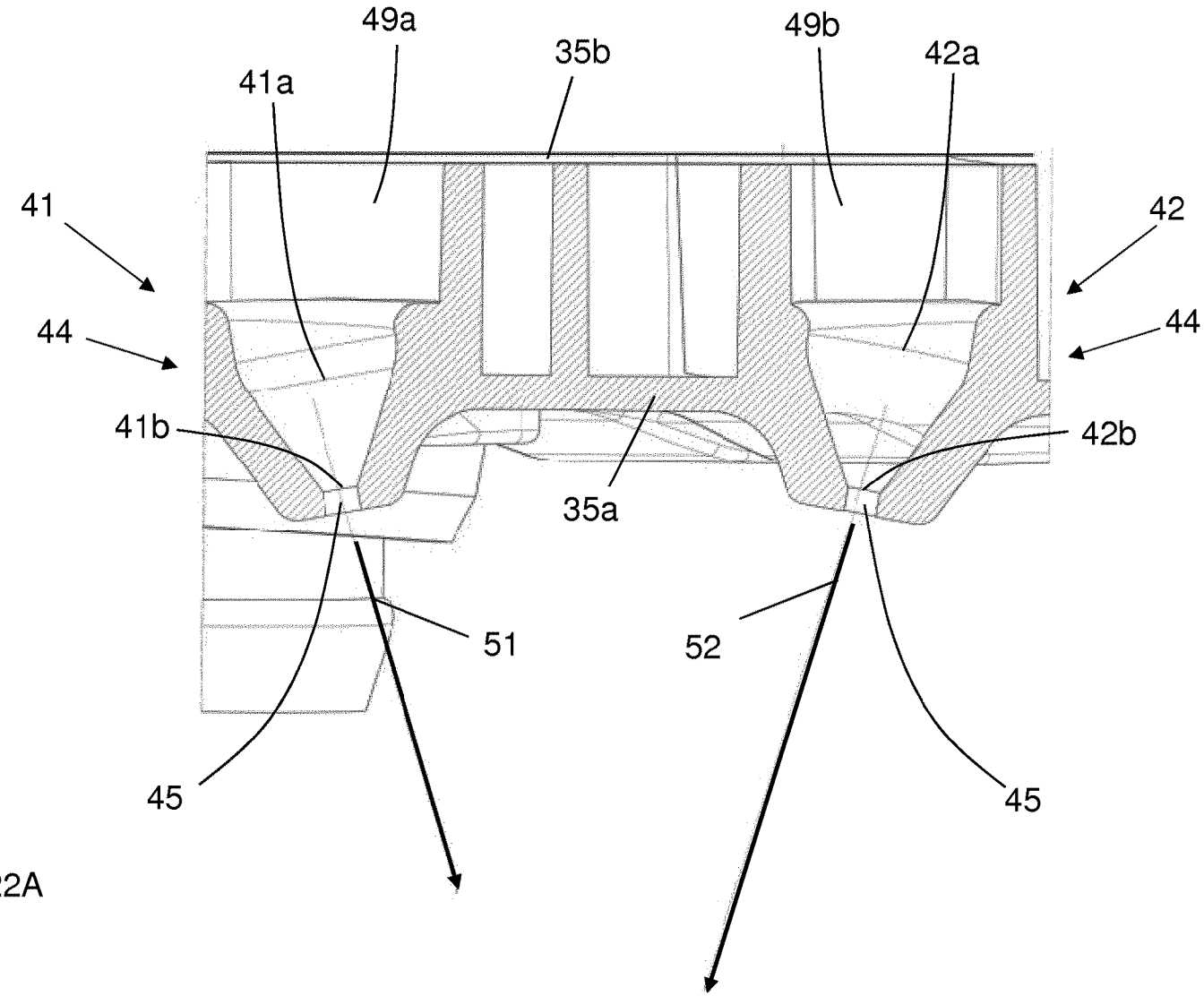
FIG. 22A shows an enlarged view of a detail of FIG. 22.

The nozzles 41, 42 and 43, two of these depicted in FIG. 22A, preferably have a first portion 44 and a second terminal portion 45. The first portion 44 preferably has a substantially frustum conical shape with a larger top section 41*a* (large section) and a smaller bottom section 41*b* (small section). The second terminal portion 45 preferably has a cylindrical shape.

In the first portion 44 the water is forced from the larger section 41*a* to the smaller section 41*b* of the frustum and the water speed in increased. The second terminal portion 45 keeps the water speed and generates at its output the water jet 51, 52 with the required direction. Furthermore, the shape of the second terminal portion 45 guarantees that the water jet 51, 52 is a laminar-flow water jet.

As a result, the water jet 51, 52 doesn't spread out and every part of the flow travels in a substantially straight line. The nozzles 41, 42 and 43 represent, therefore, laminar-flow nozzles.

When the detergent pod DP is received in the first compartment 23*a*, the water jets 51, 52, 53 hit the water-soluble pouch P of the detergent pod DP and breaks it.

While the nozzles 41, 42 and 43 here described preferably have the first portion substantially frustum conical shaped, it is clear that in different embodiments the nozzles may be differently shaped.

In general, the first portion of the nozzle preferably comprises a larger section and a smaller section through which the water is forced so that the water speed is increased and then it is conveyed to the second terminal portion.

Alternatively, the first portion of the nozzle can be described as convergent, i.e. narrowing down from a larger section to a smaller section in the direction of the flow. In particular, the first portion of the nozzle can be described as convergent, i.e. (narrowing down from a wide diameter to a smaller diameter in the direction of the flow if it has a conical shape.

Alternatively, the first portion of the nozzle can be described as tapered, i.e. gradual thinning or narrowing towards is smaller bottom section.

For example, the first portion may preferably have a substantially pyramidal frustum shape.

Furthermore, while the nozzles 41, 42 and 43 here described preferably have the second terminal portion substantially cylindrical, it is clear that in different embodiments the nozzles may be differently shaped. In general, the second terminal portion of the nozzle preferably comprises a portion having a constant, or substantially constant, cross section in the direction of the flow.

For example, the second terminal portion may be prism-shaped.

With laminar-flow water jet it has to be intended that the water is ejected from the nozzle 41, 42 in a coherent stream. The coherent stream substantially maintains its shape from the nozzle to the target, in the present case the target is the detergent pod DP.

The laminar-flow water jet, therefore, is a flow which substantially maintains its shape (or cross section) throughout its extension.

The shape of the stream is determined by the shape of the second terminal portion of the nozzle or, in other words, the second terminal portion of the nozzle is shaped to produce a stream that is of a particular shape.

For example, a second terminal portion cylindrically shaped produces a laminar-flow water jet which is substantially constituted of a cylindrical water column or a second terminal portion prism-shaped produces a laminar-flow water jet which is substantially constituted of a prism-shaped water column.

Preferably, the output water jets 51, 52, 53 are generated to be directed in an area of the first compartment 23*a*, as illustrated in FIG. 22, so that the output water jets 51, 52, 53 hit in different points the water-soluble pouch P received therein. Preferably, the output water jets 51, 52, 53 are generated to be directed towards the bottom 62*a* of the first compartment 23*a*.

In the embodiment here illustrated there are three nozzles. Nevertheless, in different embodiments, the duct may be preferably provided with a different number of nozzles, even just one.

The fourth duct 38*d* is exclusively provided with said nozzles 41, 42 and 43, i.e. without any other openings than said nozzles.

Furthermore, in the embodiment illustrated in the enclosed Figures, the nozzles 41, 42 and 43 are preferably arranged at the end of a respective branch 49*a*, 49*b* and 49*c* of the fourth duct 38*d*.

Advantageously, the fourth duct 38*d* is fluidly connected to the inlet connector 36*c* without "air-break". More preferably, the paths from the fourth controllable valve 40*d* to the nozzles 41, 42 and 43 do not comprise any "air-break".

The water from the fourth controllable valve 40*d*, therefore, flows to the nozzles 41, 42 and 43 through water tight paths.

Advantageously, the water pressure is maintained from the water source E to the nozzles 41, 42 and 43.

Advantageously the treating agents dispenser 220 also preferably comprises a by-pass line 50.

The by-pass line 50 comprises a conduit portion 51, obtained in a region of the water distributor 235 not interested by the ducts 38*a*, 38*b* and 38*c*. The conduit portion 51 is opportunely fluidly separated from the compartments 23*a*, 23*b*, 23*c* e 23*d* and terminates with an opening 53, shown in FIG. 21, facing the underlying housing 21. The opening 53 is placed above the drawer 22 in such a way to allow the flowing of water directly to the bottom 21*a* of the housing 21 and outside the compartments 23*a*, 23*b*, 23*c*, 23*d* without entering the compartments 23*a*, 23*b*, 23*c*, 23*d*.

The conduit portion 51 communicates with an inlet connector 36*e* of the water distributor 235. The inlet connector 36*e* is fluidly connectable, via a proper controllable valve, to the water source E. In the embodiment here illustrated, the controllable valve is not illustrated.

The by-pass line 50 is adapted to allow the passage of clean (or fresh) water from the water source E directly to the washing tub 3 by-passing the compartments 23*a*, 23*b*, 23*c*, 23*d* of the water distributor 235.

In an embodiment of the invention, the laundry washing cycle is advantageously carried out using powder or liquid detergent as known in the art. In this case, the first compartment 23*a* of the treating agents dispenser 220 is filled with powder detergent or the second compartment 23*b* is filled with liquid detergent. Then, advantageously, the third compartment 23*c* may be filled with a softener and/or the fourth compartment 23*d* may be filled with other treating agents, such as fabric conditioners, waterproofing agents, fabric enhancers, rinse sanitization additives, chlorine-based additives, etc. By operating on the interface unit 16 the user selects the desired washing program. The control unit 11 controls the laundry washing machine 1 so that it may start the washing program and dispensing, when required, the proper treating agent from the treating agents dispenser 220 to the washing tub 3.

The treating agent is dispensed from the treating agents dispenser 220 to the washing tub 3 by making flow an amount of flushing water into the proper compartment so as to flush out the treating agent contained therein and convey it into the washing tub 3 through the outlet port 24 and the supply pipe 18.

For example, the powder detergent is dispensed from the treating agents dispenser 220 to the washing tub 3 by making flow an amount of flushing water into the first compartment 23*a* so as to flush out the powder detergent contained therein and convey it into the washing tub 3 through the outlet port 24 and the supply pipe 18.

The washing cycle then continues with the following phases, draining phases, spinning cycles, rinsing phases, etc., or further water loads.

According to a preferred aspect of the invention, the laundry washing cycle is advantageously carried out introducing a detergent pod DP inside the first compartment 23*a*. The third compartment 23*c* may be filled with a softener and the fourth compartment 23*d* may be filled with other treating agents, such as fabric conditioners, waterproofing agents, fabric enhancers, rinse sanitization additives, chlorine-based additives, etc.

In this case, the initial phase of the washing cycle is carried out using water and the detergent D of the detergent pod DP. The detergent D of the detergent pod DP is dispensed from the first compartment 23*a* to the washing tub 3, as will be described in the following.

In a preferred embodiment of the invention, a washing program wherein the initial phase is carried out using the detergent pod DP is opportunely selected by the user by operating the "Pods cycle" button on the interface unit 16. In different embodiments, the washing program which uses a detergent pod DP may be select in a appropriate menu selectable through the display of the interface unit 16.

In a further preferred embodiment of the invention, a washing program wherein the washing phase is carried out using the detergent pod DP may be automatically set by the laundry washing machine thanks to a sensor, not illustrated, associated to the treating agents dispenser 220 which is able to detect the presence of a detergent pod DP inside the first compartment 23*a*.

For example, the sensor may be an optical sensor or a coductivity sensor.

The functioning of the laundry washing machine 1 according to the invention is the following.

The detergent pod DP is placed inside the first compartment 23*a* by the user and the drawer 22 is positioned in its closed operating position.

The detergent pod DP is advantageously maintained inside the first compartment 23*a* by means of the stopping device 30 which prevents the detergent pod DP slipping towards the rear aperture 26 of the first compartment 23*a*. The detergent pod DP advantageously abuts against the ribs 31*a*, 31*b*. The method according to the invention comprises a detergent pod breakage step of breaking the pouch P of the detergent pod DP. By opening the fourth controllable valve 40*d*, clean or fresh water, coming from the water source E, enters the water distributor 235 and flows into the fourth duct 38*d* up to the nozzles 41, 42 and 43. Water jets 51, 52, 53 generated by the nozzles 41, 42 and 43 are directed towards the detergent pod DP, in particular the external pouch P of the detergent pod DP, as illustrated in FIG. 22.

The water jets 51, 52, 53 substantially define a perforating/cutting system for the detergent pod DP. The water penetrates into the external pouch P and breaks open the detergent pod D with release of detergent D contained therein.

The fourth controllable valve 40*d* is preferably kept activated for a proper period of time which is considered sufficient to break the detergent pouch P.

Advantageously, water jets guarantee breakage of the detergent pouch P in a predetermined period of time. More advantageously, breakage of the external pouch P occurs in a predetermined period of time which is considerably shorter than the time required to dissolve the external pouch P by leaving it to soak in water, as it happens for example in the treating agents dispenser 120 previously described.

Once the external pouch P has been broken, the dose of released detergent D previously contained in the detergent pod DP is ready to be conveyed into the washing tub 3. An amount of flushing water is made to flow into the first compartment 23*a* so as to flush out the detergent D contained therein and convey it into the washing tub 3.

In a first preferred embodiment of the invention, said amount of flushing water is made to flow into the first compartment 23*a* from the same fourth duct 38*d* by keeping the fourth controllable valve 40*d* opened for a proper period of time, i.e. a period of time longer than the time which is considered sufficient to break out the detergent pod DP.

In a further preferred embodiment of the invention, said amount of flushing water is made to flow into the first compartment 23*a* activating the first valve 40*a* and making the water flowing through the first duct 38*a* and the first region 25*a*, as explained above. Preferably, during the flushing the fourth controllable valve 40*d* is deactivated.

In a further preferred embodiment of the invention, an amount of warm or hot flushing water is made to flow into the first compartment 23*a* activating the third valve 40*c* and making the water flowing through the first duct 38*a* and the first region 25*a*, as explained above. Preferably, during the flushing the fourth controllable valve 40*d* is deactivated.

By activating the first valve 40*a*, or the third valve 40*c*, water is conveyed also to the second compartment 23*b* from the second branch 39*b* of the first duct 38*a*. From the second compartment 23*b*, water then reaches anyway the washing tub 3 through the siphon 13*b*.

In a further preferred embodiment of the invention, said detergent pod breakage step and said flushing water adduction may be carried out simultaneously, being clear that the detergent will be flush out from the first compartment 23*a* once the detergent pod DP has been broken.

In a preferred embodiment of the invention, before the detergent pod breakage step, as described above, the method further comprises a step of positioning the detergent pod DP in a predefined zone inside the first compartment 23*a*.

Preferably, before the detergent pod breakage step a predetermined quantity of water is introduced inside the first compartment 23*a* with the aim of positioning the detergent pod DP in abutment to the ribs 31*a*, 31 *b* of the stopping device 30. The predefined zone inside the first compartment 23*a* substantially corresponds, therefore, with the area close to the ribs 31*a*, 31*b* of the stopping device 30.

In a preferred embodiment of the invention, the water is introduced inside the first compartment 23*a* through the outlets 29 by activating the first valve 40*a* for a short period of time. The water introduced inside the first compartment 23*a* through the outlets 29 preferably pushes the detergent pod DP towards the ribs 31*a*, 31*b* and/or the detergent pod DP itself slips towards the ribs 31*a*, 31*b* along the bottom 62*a* of the first compartment 23*a*. Slippage of the detergent pod DP along the bottom 62*a* of the first compartment 23*a* may be caused by the softening effect of water on the external pouch P of the detergent pod DP. By means of said positioning step, it is assured that the detergent pod DP is in a favorable position under the water jets 51, 52, 53 which are successively generated in the pod breakage step.

In a further preferred embodiment of the invention, the water for positioning the detergent pod DP may be introduced inside the first compartment 23*a* through the nozzles 41, 42 and 43 by activating the fourth valve 40*d* for a short period of time.

The step of positioning the detergent pod DP may be performed as a consequence of the user's selection of the washing program which uses detergent pods (for example through the "Pods cycle" button 16*c* of the interface unit 16) or because the laundry washing machine automatically detects the presence of the detergent pod DP inside the first compartment 23*a*.

An illustrative example of a preferred embodiment of the method for dispensing a dose of detergent D and water into the washing tub 3 is described in the following:

- a detergent pod DP in inserted into the first compartment 23*a* of the drawer 22 and the drawer 22 is closed;
- the user selects the washing program which uses detergent pods (for example through the "Pods cycle" button 16*c* of the interface unit 16) or the laundry washing machine automatically detects the presence of the detergent pod DP inside the first compartment 23*a;*
- the first valve 40*a* is activated (opened) for a predetermined period of time, for example 5 sec, so that a first a preliminary quantity of water is introduced inside the first and second compartments 23*a* and 23*b*, for example 0.5 liter, and the detergent pod DP is thus positioned in abutment with the ribs 31*a*, 31*b* of the stopping device 30;
- the fourth valve 40*d* is activated (opened) for a predetermined period of time, for example 60 sec, so that water jets 51, 52, 53 are generated by the nozzles 41, 42 and 43 and the detergent pod DP, in particular the pouch P of the detergent pod DP, is broken;
- the first valve 40*a* is activated again for a predetermined period of time, for example 50 sec, so that a quantity of flushing water, for example 5 liters is introduced inside the first and second compartments 23*a* and 23*b* and the detergent D contained in the first compartment 23*a* is conveyed into the washing tub 3 together with the flushing water;
- the first valve 40*a* is keep activated for a predetermined period of time to complete the filling of water into the tub 3, preferably according to the amount of load.

During said last step of filling water into the tub 3, the water ejected from outlets 29 hits the lateral side wall 63*a* of the first compartment 23*a* also advantageously clean the first compartment 23*a* itself.

The washing cycle may then proceed with the following phases, such as water heating, drum rotation, draining phases, spinning cycles, etc., or further water loads.

It is clear that times and liters expressed above are only indicative and depend on various parameters, and in particular on the pressure of the water coming from the water source E, which may typically vary over time or from a house to another where the laundry washing machine is installed.

All the advantages above-mentioned with reference to the previous embodiments are therefore achieved.

Furthermore, the pod breakage step of the detergent pod PD guarantees that the detergent D is released before it reaches the laundry inside the washing drum. Therefore residual of the detergent pod DP in the laundry or inside the laundry washing machine, for example inside the bellows, is avoided.

This firstly reduces risks of spots or stains on the laundry. It is also reduced the risk of presence of residual detergent in a successive rinsing phase, which may cause insufficient rinsing.

Advantageously, breakage of the detergent pouch P is guaranteed in a predetermined period of time, which is considerably shorter than the time required to dissolve the external pouch P by leaving it to soak in water.

Still advantageously, as described above, in the same laundry washing machine it is possible to perform either a washing program as known in the art, i.e. using powder or liquid detergent, or a washing program using a unit dose detergent.

Figure 24:
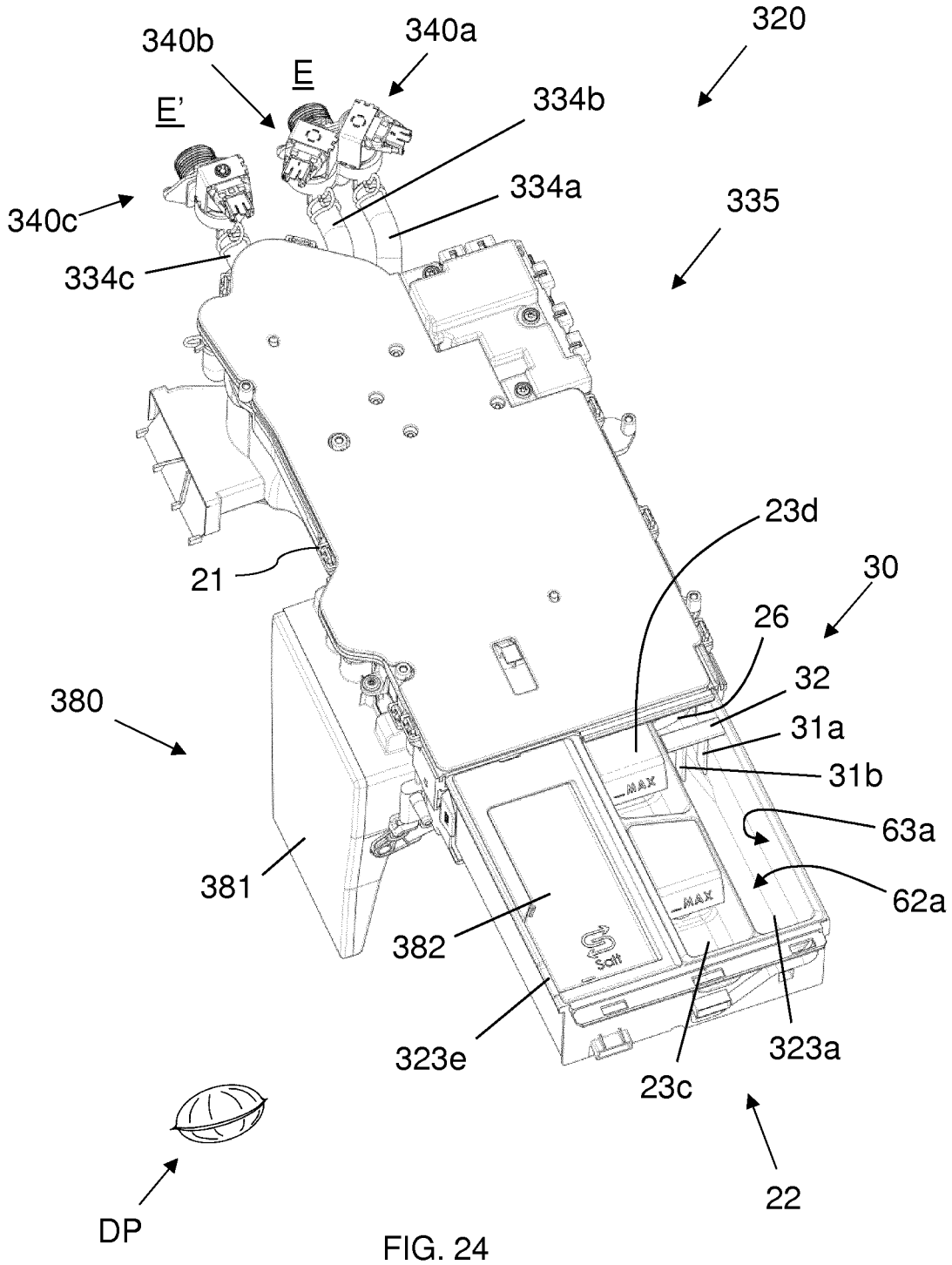
FIG. 24 illustrates a further embodiment of the treating agents dispenser of FIG. 5.
Figure 25:
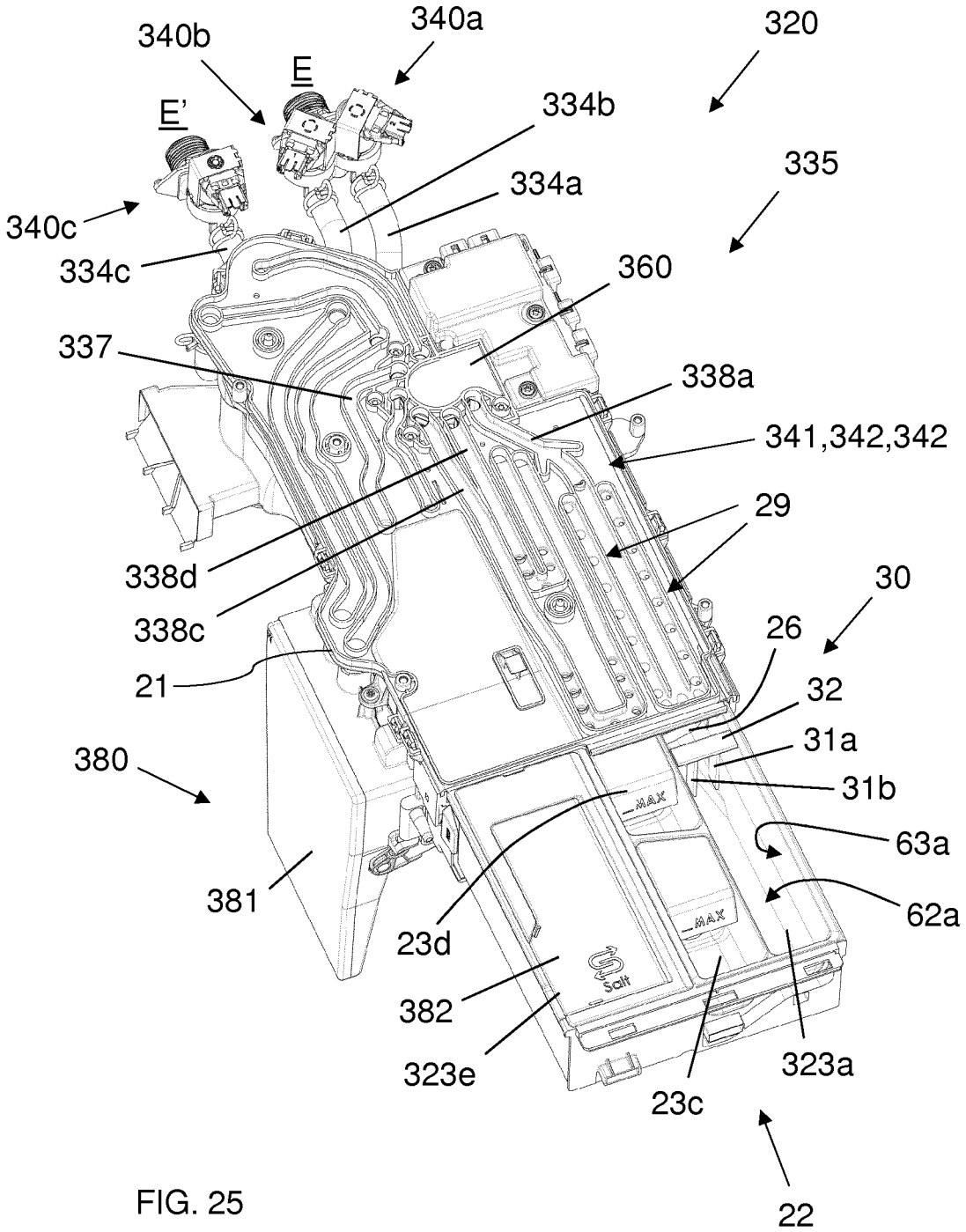
FIG. 25 shows the treating agents dispenser of FIG. 24 with an element removed therefrom.
Figure 26:
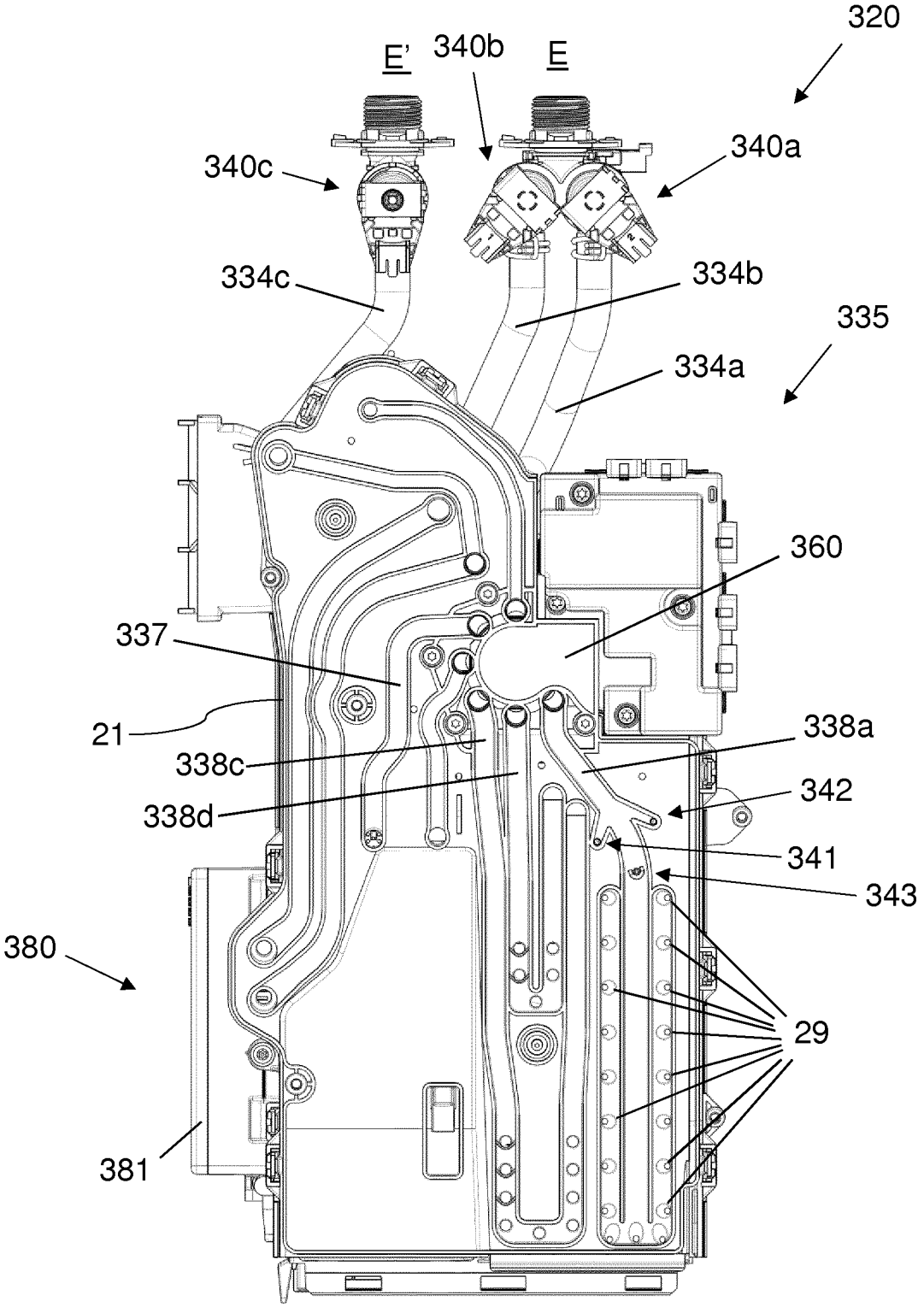
FIG. 26 is a plan view of the treating agents dispenser of FIG. 25 with the drawer in its closed position.

FIGS. 24 to 26 illustrate a further embodiment of a treating agents dispenser 320 of a laundry washing machine where a method according to the present invention may be performed.

In the drawings, corresponding characteristics and/or components previously described are identified by the same reference numbers.

Some elements and/or components of the treating agents dispenser 320 here illustrated are well known in the art, and therefore will not be described in detail.

The treating agents dispenser 320 comprises a box-shaped housing 21, connected to the external casing 2, internally to the latter, preferably by suitable fixing means, comprising, for example, screws or rivets, not illustrated, or also glue, or welding.

The treating agents dispenser 320 here illustrated and described, preferably also comprises a water softening device 380 for removal of calcium, magnesium and/or certain other metal cations in hard water before entering the washing tub 3. The water softening device 380 advantageously comprises water softening agents for reducing the hardness degree of the water to be supplied to the washing tub 3. The water softening device 380 basically comprises a water-softening agent container 381 and a regeneration-agent reservoir 382. The water-softening agent container 381 is crossed by the fresh water arriving from the water source E. The water-softening agent container 381 is filled with a water softening agent able to reduce the hardness degree of the fresh water flowing through the same water-softening agent container 381. The regeneration-agent reservoir 382 instead is fluidly connected to the water-softening agent container 381 and is structured for receiving a given quantity of salt or other regeneration agent which is able to regenerate the water softening function of the water softening agent stored inside the water-softening agent container 381.

An electrically-powered circulating pump (not illustrated) is advantageously interposed between the water-softening agent container 381 and the regeneration-agent reservoir 382 and is structured for transferring/moving the brine (i.e. the salt water) from the regeneration-agent reservoir 382 to the water-softening agent container 381.

In the enclosed figures, the housing 21 contains a removable drawer 22 which can be extracted from the housing 21, such as to protrude from the external casing 2 in a opened loading position, as illustrated for example in FIG. 24, or can be fully inserted into the housing 21 in an operative position, as illustrated for example in FIG. 26.

The drawer 22 is provided with one or more compartments 323*a*, 23*c*, 23*d* adapted to be filled with treating agents.

Furthermore, the drawer 22 is provided with a compartment 323*e* adapted to receive the regeneration-agent reservoir 382.

The compartments 323*a*, 23*c*, 23*d*, 323*e* preferably have a substantially rectangular shape.

The first compartment 323*a* is preferably adapted for receiving a quantity of powder or liquid detergent; the second compartment 23*c* is preferably adapted for receiving a softener; the third compartment 23*d* is preferably adapted for receiving other treating agents, such as fabric conditioners, waterproofing agents, fabric enhancers, rinse sanitization additives, chlorine-based additives, etc.

According to an advantageous aspect of the present invention, the first compartment 323*a* is preferably adapted for receiving also a detergent pod DP.

The detergent pod DP comprises a pre-measured amount, or single dose, of detergent D incorporated into a water-soluble pouch P, as described above.

The compartments 323*a*, 23*c* and 23*d* are fluidly connected to the bottom of the housing 21 in which an outlet port is obtained (not illustrated in the figures). The outlet port is adapted to allow the flowing of a liquid into a supply pipe (not illustrated) fluidly connecting the treating agents dispenser 320 and the tub.

The bottom 21*a* of the housing 21 preferably has a sloped bottom so that a fluid may flow towards the outlet port. The outlet port is preferably located at the rear of the sloped bottom wall 21*a*.

The first compartment 323*a* of the drawer 22 is fluidly connected to the bottom 21*a* of the housing 21 through an aperture 26 defined at the rear of the first compartment 323*a*.

The first compartment 323*a* preferably has a sloped bottom wall 62*a* so that a fluid may flow towards the aperture 26. The aperture 26 is located at the rear of the sloped bottom wall 62*a*.

The first compartment 323*a* then preferably comprises a stopping device 30 adapted for stopping the detergent pod DP and preventing it reaching the rear aperture 26. The stopping device 30 is suited to stop the detergent pod DP when the detergent pod DP is intact while it is configured to allow the passage of detergent D which exits the detergent pod DP after its breakage, as will be better described later.

In the embodiment illustrated, the stopping device 30 preferably comprises two ribs 31*a*, 31*b*, vertically arranged in the first compartment 323*a*. An horizontal element 32 connects the ribs 31*a*, 31*b* to lateral side walls of the first compartment 323*a*.

According to an aspect of the invention, therefore, the first compartment 323*a* is suited to receive the detergent pod DP.

Advantageously, the treating agents dispenser 320 comprises a water distributor 335, associated to the housing 21 and placed above the drawer 22 in such a way to allow the flowing of water to one or more of said compartments 323*a*, 23*c*, 23*d* and 323*e*.

The treating agents dispenser 320 comprises one or more water conveying lines adapted for conveying water to one or more of said compartments 323*a*, 23*c*, 23*d* and 323*e*.

Advantageously, the water distributor 335 is connectable to a cold water source E or to a warm or hot water source E' via controllable valves 340*a*, 340*b*, 340*c*, preferably of the electromagnetic type, opportunely controlled by the control unit 11.

The first controllable valve 340*a* allows adduction of cold water directly to an electrically-controlled flow diverter 360 through a pipe 334*a*. The flow diverter 360, well known in the art, has a number of water outlets for selectively and alternatively channelling the water arriving from the water source E towards the regeneration-agent reservoir 382 and compartments 323*a*, 23*c*, 23*d* by means of respective ducts 337, 338*a*, 338*c* and 338*d*.

The second controllable valve 340*b* allows adduction of cold water to the water-softening agent container 381 through a pipe 334*b*. The water treated by the softening agent is then conveyed from the to the softening agent container 381 to the flow diverter 360 which selectively and alternatively channels the water towards the compartments 323*a*, 23*c*, 23*d*.

The third controllable valve 340*c* allows adduction of warm or hot water directly to the electrically-controlled flow diverter 360 through a pipe 334*c*.

According to an aspect of the present embodiment of the invention, the duct 338*a* which supplies water to the first compartment 323*a* is structured for generating one or more water jets directed into the first compartment 323*a* which receives the detergent pod DP.

The water jets, not explicitly illustrated in the figures but substantially corresponding to water jets 51, 52, 53 previously described, are suited to hit the detergent pod DP and to break its water-soluble pouch P. The water jets are, preferably, laminar-flow water jets.

At this purpose, the duct 338*a* is preferably provided with nozzles 341, 342 and 343 adapted to allow the passage of the water from the duct 338*a* to the underlying first compartment 323*a* and adapted for generating said water jets. Water jets are directed into the first compartment 323*a* so that the water jets hit in different points the detergent pod DP which is positioned therein. The impact of the water jets against the detergent pod DP breaks its water-soluble pouch P.

The shape of the nozzles 341, 342 and 343 is not explicitly illustrated here but they can be realized as previously described and illustrated with reference to nozzles 41, 42 and 43.

Preferably, the output water jets are generated to be directed in an area of the first compartment 323*a* so that the output water jets hits the water-soluble pouch P received in the first compartment 323*a*. Preferably, the output water jets are generated to be directed towards the bottom 62*a* of the first compartment 323*a*.

In the embodiment here illustrated there are three nozzles. Nevertheless, in different embodiments, the duct may be preferably provided with a different number of nozzles, even just one.

According to another aspect of the present embodiment of the invention, the duct 338*a* which supplies water to the first compartment 323*a* comprises also one or more outlets 29. Here again, said outlets 29 are not explicitly illustrated here but they can be realized as previously described and illustrated.

Outlets 29 allow the passage of the water from the duct 338*a* to the underlying first compartment 323*a* and are preferably arranged in the water distributor 335 so that the water falling into the underlying first compartments 323*a* hits the lateral side walls 63*a* of the same first compartment 323*a*.

As already explained, water spreading out from the outlets 29 hits the lateral side wall 63*a* of the first compartment 323*a* and falls down by gravity into the bottom 62*a* of the same. Advantageously, when the first compartment 323*a* is filled with powder detergent, the water drags the detergent towards the rear aperture 26 of the first compartment 323*a*. Furthermore, once all the detergent has been conveyed towards the rear aperture 26, the water hitting the lateral side wall 63*a* advantageously clean the first compartment 323*a*.

The duct 338*d*, according to this preferred embodiment, is fluidly connected to the flow diverter 360 without "air-break". More preferably, the paths from the controllable valves 340*a*, 340*b* and 340*c* to the nozzles 341, 342 and 343 do not comprise any "air-break".

The water from the controllable valves 340*a*, 340*b* and 340*c*, therefore, flows to the nozzles 341, 342 and 343 through water tight paths.

In an embodiment of the invention, the laundry washing cycle is advantageously carried out using powder or liquid detergent as known in the art. In this case, the first compartment 323*a* of the treating agents dispenser 320 is filled with powder or liquid detergent. Then, advantageously, the second compartment 23*c* may be filled with a softener and/or the third compartment 23*d* may be filled with other treating agents, such as fabric conditioners, waterproofing agents, fabric enhancers, rinse sanitization additives, chlorine-based additives, etc. By operating on the interface unit 16 the user selects the desired washing program. The control unit 11 controls the laundry washing machine so that it may start the washing program and dispensing, when required, the proper treating agent from the treating agents dispenser 320 to the washing tub 3.

The treating agent is dispensed from the treating agents dispenser 320 to the washing tub 3 by making flow an amount of flushing water into the proper compartment so as to flush out the treating agent contained therein and convey it into the washing tub 3 through the outlet port and the supply pipe 18.

For example, the powder detergent is dispensed from the treating agents dispenser 320 to the washing tub 3 by making flow an amount of flushing water into the proper first compartment 323*a* so as to flush out the powder detergent contained therein and convey it into the washing tub 3 through the outlet port and the supply pipe.

The washing cycle then continues with the following phases, draining phases, spinning cycles, rinsing phases, etc., or further water loads.

According to a preferred aspect of the invention, the laundry washing cycle is advantageously carried out introducing a detergent pod DP inside the first compartment 223*a*. The second compartment 23*c* may be filled with a softener and the third compartment 23*d* may be filled with other treating agents, such as fabric conditioners, waterproofing agents, fabric enhancers, rinse sanitization additives, chlorine-based additives, etc.

In this case, the initial phase of the washing cycle is carried out using water and the detergent D of the detergent pod DP. The detergent D of the detergent pod DP is dispensed from the first compartment 323*a* to the washing tub 3, as will be described in the following.

In a preferred embodiment of the invention, a washing program wherein the initial phase is carried out using the detergent pod DP is opportunely selected by the user by operating the "Pods cycle" button on the interface unit 16. In different embodiments, the washing program which uses a detergent pod DP may be select in a appropriate menu selectable through the display of the interface unit 16.

In a further preferred embodiment of the invention, a washing program wherein the washing phase is carried out using the detergent pod DP may be automatically set by the laundry washing machine thanks to a sensor, not illustrated, associated to the treating agents dispenser 320 which is able to detect the presence of a detergent pod DP inside the first compartment 323*a*.

The functioning of the laundry washing machine according to the invention is the following.

The detergent pod DP is placed inside the first compartment 323*a* by the user and the drawer 22 is positioned in its closed operating position.

The detergent pod DP is advantageously maintained inside the first compartment 323*a* by means of the stopping device 30 which prevents the detergent pod DP slipping towards the rear aperture 26 of the first compartment 323*a*. The detergent pod DP advantageously abuts against the ribs 31*a*, 31*b*. The method according to the invention comprises a detergent pod breakage step of breaking the pouch P of the detergent pod DP. By opening one of the controllable valves 340*a*, 340*b*, 340*c* and by properly operating the flow diverter 360, clean or fresh water flows into the duct 338*a* up to the nozzles 341, 342 and 343. Water jets generated by the nozzles 341, 342 and 343 are directed towards the detergent pod DP, in particular the external pouch P of the detergent pod DP.

The water jets substantially define a perforating/cutting system for the detergent pod DP. The water penetrates into the external pouch P and breaks open the detergent pod D with release of detergent D contained therein.

The controllable valve 340*a*, 340*b* or 340*c* is preferably kept activated for a proper period of time which is considered sufficient to break the detergent pouch P.

During this period of time, water is also conveyed into the first compartment 323*a* by means of outlets 29.

Once the external pouch P has been broken, the dose of released detergent D previously contained in the detergent pod DP is ready to be conveyed into the washing tub 3. An amount of flushing water is made to flow into the first compartment 323*a* so as to flush out the detergent D contained therein and convey it into the washing tub 3.

In a preferred embodiment of the invention, said amount of flushing water is made to flow into the first compartment 323*a* from the same duct 338 by keeping the controllable valve 340*a*, 340*b* or 340*c* opened for a proper period of time, i.e. a period of time longer than the time which is considered sufficient to break out the detergent pod DP. During this period of time, water is also conveyed into the first compartment 323*a* by means of outlets 29.

In a preferred embodiment of the invention, before the detergent pod breakage step, the method further comprises a step of positioning the detergent pod DP in a predefined zone inside the first compartment 323*a*.

Preferably, before the detergent pod breakage step a predetermined quantity of water is introduced inside the first compartment 323*a* with the aim of positioning the detergent pod DP in abutment to the ribs 31*a*, 31 *b* of the stopping device 30. The predefined zone inside the first compartment 323*a* substantially corresponds, therefore, with the area close to the ribs 31*a*, 31*b* of the stopping device 30

In a preferred embodiment of the invention, the water is introduced inside the first compartment 323*a* by activating one of the controllable valve 340*a*, 340*b* or 340*c* for a short period of time. The water introduced inside the first compartment 323*a* through the outlets 29 preferably pushes the detergent pod DP towards the ribs 31*a*, 31*b* and/or the detergent pod DP itself slips towards the ribs 31*a*, 31*b* along the bottom of the first compartment 323*a*. Slippage of the detergent pod DP along the bottom of the first compartment 323*a* may be caused by the softening effect of water on the external pouch P of the detergent pod DP.

By means of said positioning step, it is assured that the detergent pod DP is in a favorable position under the water jets which are generated in the pod breakage step.

The step of positioning the detergent pod DP may be performed as a consequence of the user's selection of the washing program which uses detergent pods (for example through the "Pods cycle" button 16*c* of the interface unit 16) or because the laundry washing machine automatically detects the presence of the detergent pod DP inside the first compartment 323*a*.

An illustrative example of a preferred embodiment of the method for dispensing a solution comprising a dose of detergent D and water into the washing tub is described in the following:

- a detergent pod DP in inserted into the first compartment 323*a* of the drawer 22 and the drawer 22 is closed;
- the user selects the washing program which uses detergent pods (for example through the "Pods cycle" button 16*c* of the interface unit 16) or the laundry washing machine automatically detects the presence of the detergent pod DP inside the first compartment 323*a;*
- the first valve 340*a* is activated (opened) for a predetermined period of time, for example 5 sec, so that a first a preliminary quantity of water is introduced inside the first compartments 323*a*, for example 0.5 liter, and the detergent pod DP is thus positioned in abutment with the ribs 31*a*, 31*b* of the stopping device 30;
- after a pause, the first valve 340*a* is activated again for a predetermined period of time, for example 60 sec, so that water jets are generated by the nozzles 341, 342 and 343 and the detergent pod DP, in particular the pouch P of the detergent pod DP, is broken;
- the first valve 340*a* is keep activated for a predetermined period of time to complete the filling of water into the tub 3, preferably according to the amount of load.

The washing cycle may then proceed with the following phases, such as water heating, drum rotation, draining phases, spinning cycles, etc., or further water loads.

It is clear that times and liters expressed above are only indicative and depend on various parameters, and in particular on the pressure of the water coming from the water source E, which may typically vary over time or from a house to another where the laundry washing machine is installed.

All the advantages above-mentioned with reference to the previous embodiments are therefore achieved.

Advantageously, the method of the invention guarantees that the detergent pod DP is conveyed into the washing tub 3 only at the correct time required by the washing cycle.

This solves the several drawbacks posed by the known art due to the insertion of the detergent pod inside the washing drum before starting of the washing cycle.

In particular, the risk of undesired spots or stains on the laundry is limited. Also there is no risk that the detergent is drained to the outside in case the washing cycle starts with a draining phase.

Advantageously the detergent pod DP is broken and the detergent D is released before it reaches the washing tub 3 and the laundry contained therein. The dose of released detergent D previously contained in the detergent pod DP is therefore at least partially mixed with water before it reaches the laundry and it is more uniformly distributed over the laundry.

Advantageously with the method of the invention it is guaranteed that all the detergent D of the detergent pod DP is used during the laundry washing cycle and the whole cleaning effect of the unit dose detergent is therefore achieved.

Furthermore, with the method of the invention the breakage of the detergent pod PD is guaranteed before it reaches the laundry inside the washing drum. Therefore residual of the detergent pod DP in the laundry or inside the laundry washing machine, for example inside the bellows, is avoided.

This firstly further reduces risks of spots or stains on the laundry. The risk of presence of residual detergent in a successive rinsing phase is also reduced and the same rinsing is not negatively affected.

Advantageously, the indeterminateness of the effective time of breakage of the pod and the effective time of release of the detergent contained therein is eliminated and the performance of the washing cycle selected by the user is guaranteed.

Still advantageously, as described above, in the same laundry washing machine it is possible to perform either a washing program as known in the art, i.e. using powder or liquid detergent, or a washing program using a unit dose detergent.

Figure 27:
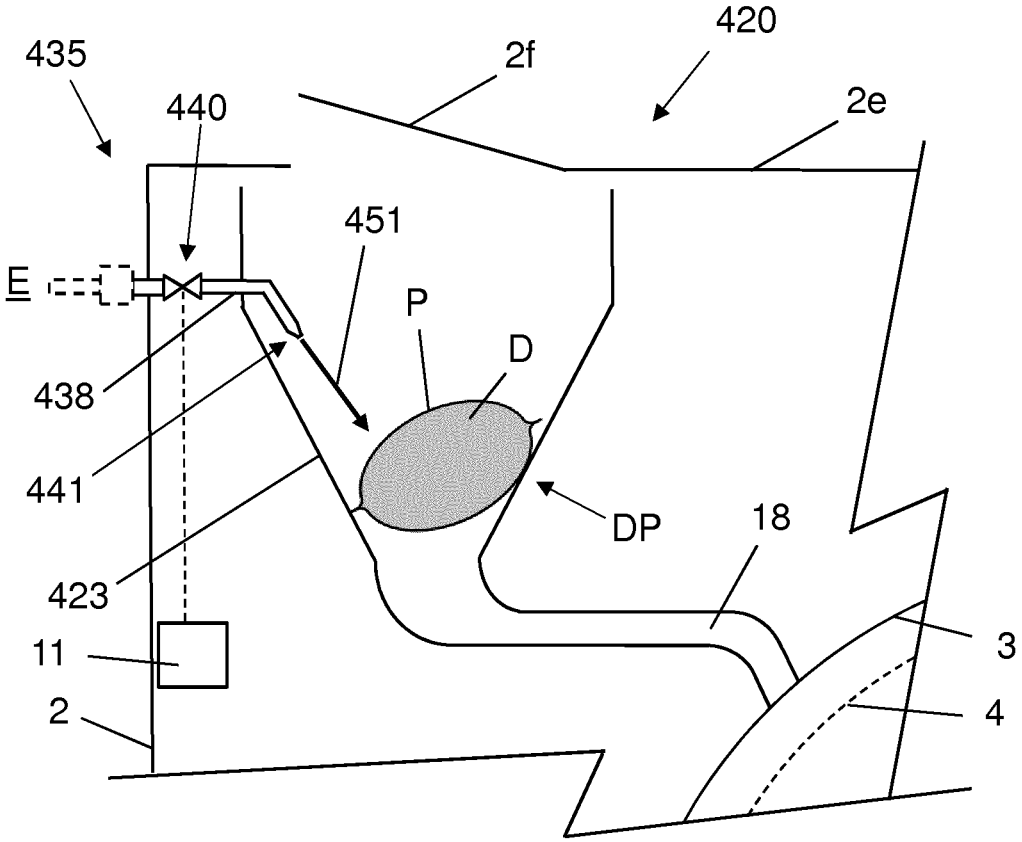
FIG. 27 illustrates a further embodiment of a wash products dispenser according to the present invention.
Figure 27A:
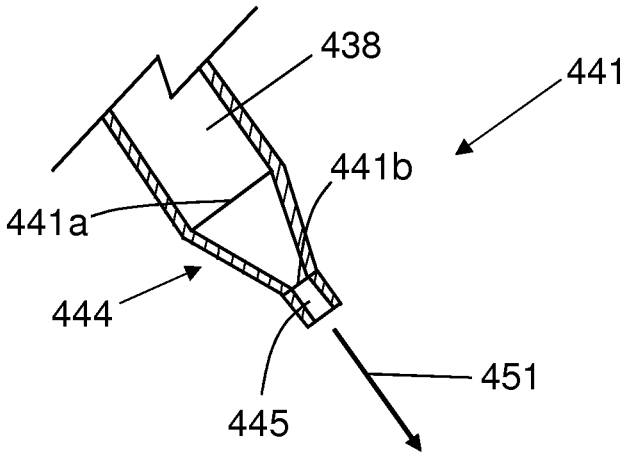
FIG. 27A shows an enlarged view of a detail of FIG. 27.

FIGS. 27 and 27A schematically illustrate a further embodiment of a treating agents dispenser 420 of a laundry washing machine where a method according to the present invention may be performed.

The treating agents dispenser 420 comprises a compartment 423 adapted to be filled with treating agents. The compartment 423 is preferably adapted for receiving a powder detergent. According to an aspect of the invention, the compartment 423 is also suited to receive a unit dose treating agent, or detergent pod DP, of the type above described.

A lid 2*f* arranged on the upper side wall 2*e* of the laundry washing machine ensures access to the compartment 423.

The compartment 423 is fluidly connected to the supply pipe 18 which fluidly connects the treating agents dispenser 420 and the tub 3.

The compartment 423 is preferably funnel-shaped so that it accomplishes the function of stopping the detergent pod DP inserted therein, as illustrated in FIG. 27.

Advantageously, the treating agents dispenser 420 comprises a water distributor 435, associated to the compartment 423, in such a way to allow the flowing of water to the compartment 423.

The treating agents dispenser 420 comprises a water conveying line adapted for conveying water to said compartment 423.

Advantageously, the water distributor 435 comprises a duct 438 which can be connected to the water source E via a controllable valve 440, preferably of the electromagnetic type, opportunely controlled by the control unit 11.

Inlet of the controllable valve 440 is connectable to the water source E and outlet of the controllable valve 440 is connected to the duct 438.

In further embodiments the duct may be fed with warm or hot water.

According to a preferred aspect of the present invention, the water conveying line generates a water jet 451 directed into the compartment 423. The water jet 451 is suited to hit the detergent pod DP and to break its water-soluble pouch P.

The duct 438 is preferably provided with a nozzle 441, adapted to allow the passage of the water from the duct 438 to the compartment 423 and adapted for generating said water jet 451 directed into the compartment 423 so that the water jet 451 hits the detergent pod DP which is positioned therein, as said above. The impact of the water jet 451 against the detergent pod DP breaks its water-soluble pouch P.

The nozzle 441, as illustrated in FIG. 27A, preferably have a first portion 444 and a second terminal portion 445. The first portion 444 preferably has a substantially frustum conical shape with a larger top section 441*a* (large section) and a smaller bottom section 441*b* (small section). The second terminal portion 445 preferably has a cylindrical shape.

In the first portion 444 the water is forced from the larger section 441*a* to the smaller section 441*b* of the frustum and the water speed is increased. The second terminal portion 445 keeps the water speed and generates at its output the water jet 451 with the required direction. Furthermore, the shape of the second terminal portion 445 guarantees that the water jet 451 is a laminar-flow water jet.

As a result, the water jet 451 doesn't spread out and that every part of the flow travels in a substantially straight line. The nozzle 441 represents, therefore, a laminar-flow nozzle.

When the detergent pod DP is received in the compartment 423, the water jet hits the water-soluble pouch P and breaks it.

In the illustrated embodiment the duct 438 has just one nozzle. Nevertheless, in different embodiments, the duct may be preferably provided with two or more nozzles.

The duct 438 is exclusively provided with said nozzle 441, i.e. without any other openings than said nozzle. Preferably, the nozzle 441 is arranged at the end of the duct 438.

Advantageously, the fourth duct 438 is fluidly connected to the controllable valve 440 without "air-break". The water from the controllable valve 440, therefore, flows to the nozzle 441 through a water tight path.

Advantageously, the water pressure is maintained from the water source E to the nozzle 441.

In an embodiment of the invention, the laundry washing cycle is advantageously carried out according to the known art, i.e. filling the compartment 423 with powder detergent. By operating on the interface unit 16 the user selects the desired washing program. The control unit 11 controls the laundry washing machine so that it may start the washing program and dispensing, when required, the powder detergent from the compartment 423 to the washing tub 3.

In particular, during the initial phase of the washing cycle the laundry is treated by means of a solution of water and detergent dispensed from the compartment 423.

According to a preferred aspect of the invention, the laundry washing cycle is advantageously carried out introducing a detergent pod DP inside the compartment 423.

The detergent D of the detergent pod DP is dispensed from the compartment 423 to the washing tub 3 as will be described in the following.

In a preferred embodiment of the invention, a washing program wherein the initial phase is carried out using the detergent pod DP is opportunely selected by the user by operating the "Pods cycle" button on the interface unit 16. In different embodiments, the washing program which uses a detergent pod DP may be select in a appropriate menu selectable through the display of the interface unit 16. Alternatively, a washing program wherein the washing phase is carried out using the detergent pod DP may be automatically set by the laundry washing machine, as already described above for the first preferred embodiment of the invention.

The functioning of the laundry washing machine for dispensing a solution of water and detergent into the washing tub 3 according to the invention is the following.

The detergent pod DP is placed inside the compartment 423 by the user.

The detergent pod DP is advantageously maintained inside the compartment 423 thanks to its funnel shape which prevents the detergent pod DP slipping towards the supplying pipe 18. The detergent pod DP advantageously abuts against the inclined side walls of the compartment 423. The method according to the invention comprises a detergent pod breakage step of breaking the pouch P of the detergent pod DP. By opening the controllable valve 440, clean or fresh water, coming from the water source E, flows into the duct 438 up to the nozzle 441. The water jet 451 generated by the nozzle 441 is being directed towards the detergent pod DP, in particular towards the external pouch P of the detergent pod DP.

The water jet 451 substantially define a cutting system for the detergent pod DP.

The water penetrates into the external pouch P and breaks open the detergent pod D with release of detergent D contained therein.

The controllable valve 440 is preferably kept activated for a proper period of time which is considered sufficient to break the detergent pouch P.

Advantageously, the water jet 451 guarantees breakage of the detergent pouch P in a predetermined period of time.

Once the external pouch P has been broken, the dose of released detergent D contained in the detergent pod DP is ready to be conveyed into the washing tub 3. An amount of flushing water is made to flow into the compartment 423 so as to flush out the detergent D contained therein and convey it into the washing tub 3.

Said amount of flushing water is made to flow into the compartment 423 from the same duct 438 by keeping the controllable valve 440 opened for a proper period of time, i.e. a period of time longer than the time which is considered sufficient to break out the detergent pod DP.

In a further preferred embodiment of the invention, said amount of flushing water is made to flow into the compartment through an auxiliary water conveying line (not illustrated)

In a further preferred embodiment of the invention, said detergent pod breakage step and said flushing water adduction through an auxiliary water conveying line may be carried out simultaneously, being clear that the detergent will be flush out once the detergent pod DP has been broken.

An illustrative example of a preferred embodiment of the method for dispensing a solution comprising a dose of detergent D and water into the washing tub 3 is described in the following:

- a detergent pod DP in inserted into the compartment 423 and it abuts against the inclined side walls of the same;
- the user selects the washing program which uses detergent pods (for example through the "Pods cycle" button 16*c* of the interface unit 16) or the laundry washing machine automatically detects the presence of the detergent pod DP inside the compartment 23*a;*
- the valve 440 is activated (opened) for a predetermined period of time, for example 60 sec, so that the water jet is generated by the nozzle 441 and the detergent pod DP, in particular the pouch P of the detergent pod DP is broken;
- the valve 440 is kept activated for a predetermined period of time, for example 50 sec, so that a quantity of flushing water, for example 5 liters is introduced inside the compartment 423 and the detergent D contained in the compartment 423 is conveyed into the washing tub 3 together with the flushing water.
- the valve 440 is keep activated for a predetermined period of time to complete the filling of water into the tub 3, preferably according to the amount of load.

The washing cycle may then proceed with the following phases, such as water heating, drum rotation, spinning cycles, etc., or further water loads.

It is clear that times and liters expressed above are only indicative and depend on various parameter, and in particular on the pressure of the water coming from the water source E, which may typically vary over time or from a house to another where the laundry washing machine is installed.

All the advantages above-mentioned with reference to the first embodiment are therefore achieved.

The method according to the preferred embodiments of the invention has been advantageously described in particular with reference to a detergent pod DP.

It has to be noted that the method may be also be performed when a different unit dose package is utilized.

For example, the method may be advantageously performed for distributing a softener on the laundry in a particular phase of the washing cycle. In such a case, the method according to the invention preferably comprises at least a step of introducing the softener pod into the dedicated compartment of the treating agents dispenser, a softener pod breakage step of breaking the pouch of the softener pod and a step of conveying the dose of softener inside the washing tub. The unit dose package is constituted of a unit dose softener comprising a pre-measured amount, or single dose, of softener incorporated into a water-soluble pouch. The pouch, as described above, is preferably made of a film material that is soluble or dispersible in water.

The same philosophy may analogously apply to other types of unit dose packages which have to be dispensed during a washing cycle.

It has thus been shown that the present invention allows all the set objects to be achieved. In particular, it makes it possible to provide a method for operating a laundry washing machine using a unit dose treating agent which guarantees the use of all the product contained in the unit dose package and avoids any residual of the same on the laundry.

It is underlined that the laundry washing machines illustrated in the enclosed figures are of the front-loading type; however it is clear that the system according to the invention can be applied as well to a top-loading washing machine, substantially without any modification.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A laundry washing machine comprising:

- a cabinet supporting a washing drum adapted to receive laundry and a washing tub external to said washing drum;
- a treating agents dispenser comprising one or more compartments adapted to be filled with at least one treating agent, said treating agents dispenser being provided with one or more water conveying lines for conveying water to said one or more compartments;
- a supply line, fluidly connecting said treating agents dispenser and said washing tub;
- a control unit for controlling functioning of said laundry washing machine;
- an interface unit by means of which the user may select and/or set parameters;

wherein at least a first compartment of said one or more compartments is suited to receive a respective unit dose package comprising a pre-measured amount of treating agent incorporated into a water-soluble pouch and wherein at least a first water conveying line of said one or more water conveying lines comprises one or more outlets configured to direct a respective water flow into said first compartment, the one or more outlets comprising at least one nozzle configured to generate at least one water jet into said first compartment so that said at least one water jet hits said unit dose package and breaks said water-soluble pouch; and a first controllable valve connecting said first water conveying line to a water source, and wherein said first water conveying line comprises a path fluidly connecting said first controllable valve and said one or more outlets, and wherein the entirety of the water conveying line is water tight except for the one or more outlets configured to direct a respective water flow into said first compartment.

2. The machine according to claim 1, wherein said at least one nozzle is configured to generate a laminar-flow water jet.

3. The machine according to claim 1, wherein said at least one nozzle generates at least one water jet directed towards a predefined zone inside said first compartment which is suited for receiving said unit dose package and/or generates at least one water jet directed towards a predefined portion of a bottom side of said first compartment.

4. The machine according to claim 1, wherein said at least one nozzle comprises a first portion and a second terminal portion arranged downstream from the first portion, wherein said first portion has a shape which narrows down from a larger cross section to a smaller cross section and wherein said second terminal portion has a constant, or substantially constant, cross section.

5. The machine according to claim 4, wherein said first portion and said second terminal portion of said at least one nozzle are configured to generate a laminar-flow water jet.

6. The machine according to claim 1, wherein said at least one nozzle comprises a plurality of nozzles configured to each generate a respective water jet, each respective water jet being directed towards a predefined zone inside said first compartment which is suited for receiving said unit dose package and/or towards a predefined portion of a bottom side of said first compartment.

7. The machine according to claim 1, wherein all of the one or more openings comprise a respective nozzle configured to generate at least one water jet into said first compartment.

8. The machine according to claim 1, wherein at least one of the one or more openings comprises at least one outlet configured to convey water into said first compartment in addition to said at least one nozzle.

9. The machine according to claim 8, said at least one outlet is arranged so that said water is directed towards a lateral side wall of said first compartment.

10. The machine to according to claim 1, wherein at least a second water conveying line of said one or more water conveying lines comprises at least one outlet for conveying water into said first compartment, said second water conveying line being fluidly separated from said first water conveying line.

11. The machine according to claim 10, said at least one outlet of said second water conveying line is arranged so that said water is directed towards a lateral side wall of said first compartment.

12. The machine according to claim 10, wherein said second water conveying line fluidly connects a second controllable valve to the at least one outlet of the second water conveying line, and comprises an air-break between the second controllable valve and the at least one outlet of the second water conveying line.

13. The machine according to claim 1, wherein said treating agents dispenser further comprises a stopping device associated to said first compartment adapted for stopping said unit dose package in a predefined zone inside said first compartment.

14. The machine according to claim 13, wherein said stopping device is suited to stop said unit dose package when said unit dose package is intact while it is configured to allow the passage of treating agent released from said unit dose package after breakage of said water-soluble pouch.

15. The machine according to claim 14, wherein said stopping device comprises at least one rib transversely arranged inside said first compartment.

16. The machine according to claim 1, wherein at least one additional controllable valve is fluidly connected between said water source and said treating agents dispenser, and wherein said treating agents dispenser further comprises a flow diverter arranged downstream from said at least one additional controllable valve, the flow diverter being configured to selectively and alternatively channel water arriving from said water source towards said one or more compartments.

17. The machine according to claim 1, wherein the machine further comprises a water softening device for softening water to be directed to said one or more water conveying lines and/or to the washing tub.

18. A method for operating a laundry washing machine comprising:

a cabinet supporting a washing drum adapted to receive laundry and a washing tub external to said washing drum;

a treating agents dispenser comprising one or more compartments adapted to be filled with at least one treating agent, said treating agents dispenser being provided with one or more water conveying lines for conveying water to said one or more compartments;

a supply line, fluidly connecting said treating agents dispenser and said washing tub;

a control unit for controlling functioning of said laundry washing machine;

an interface unit by means of which a user may select and/or set parameters;

wherein said method comprises the steps of:

introducing a unit dose package comprising a pre-measured amount of treating agent incorporated into a water-soluble pouch into a first compartment of said one or more compartments which is suited to receive said unit dose package;

conveying water to said first compartment from a first water conveying line of said one or more water conveying lines for generating at least one water jet into said first compartment so that said at least one water jet hits said unit dose package and breaks said water-soluble pouch so as to release said pre-measured amount of treating agent wherein said first water conveying line is connected to a water source through a controllable valve and wherein said first water conveying line comprises a water tight path fluidly connecting said controllable valve and said at least one nozzle.

19. The method according to claim 18, wherein said step of generating at least one water jet includes a step of generating at least one laminar-flow water jet.

20. The method according to claim 18, wherein said step of generating at least one water jet into said first compartment comprises directing said at least one water jet towards a predefined zone inside said first compartment which is suited for receiving said unit dose package and/or directing said at least one water jet towards a predefined portion of a bottom side of said first compartment.

21. The method according to claim 20, further comprising a step of positioning said unit dose package in said predefined zone inside said first compartment and/or in said predefined portion of a bottom side of said first compartment.

22. The method according to claim 21, wherein said positioning step comprises conveying an amount of water to said first compartment from one of said one or more water conveying lines so that said unit dose package moves towards said predefined zone.

23. The method according to claim 22, wherein said unit dose package moves towards said predefined zone by a pushing action of said amount of water.

24. The method according to claim 22, wherein said unit dose package moves towards said predefined zone by slipping.

25. The method according to claim 22, wherein said breakage step is carried out if the user selects a dedicated washing program through said interface unit.

26. The method according to claim 25, wherein the user selects said dedicated washing program by operating a selector device of said interface unit.

27. The method according to claim 18, further comprising a step of conveying an amount of flushing water into said first compartment to flush out said released pre-measured amount of treating agent from said first compartment and conveying it into said washing tub through said supply line.

28. The method according to claim 18, further comprising a step of conveying an amount of flushing water into said first compartment to flush out said released pre-measured amount of treating agent from said first compartment and convey it into said washing tub through said supply line and wherein said step of conveying an amount of flushing water is carried out through said first water conveying line.

29. The method according to claim 18, further comprising a step of conveying an amount of flushing water into said first compartment to flush out said released pre-measured amount of treating agent from said first compartment and convey it into said washing tub through said supply line and wherein said step of conveying an amount of flushing water is carried out through a second water conveying line different from said first water conveying line.

30. The method according to claim 18, further comprising a step of providing a stopping device associated to said first compartment adapted for stopping said unit dose package in a predefined zone inside said first compartment when said unit dose package is intact and allowing the passage of treating agent released from said unit dose package after breakage of said water-soluble pouch.

31. The method according to claim 30, said stopping step comprising a step of positioning said unit dose package in abutment to a stopping device at said predefined zone inside said first compartment.

32. The method according to claim 21, wherein said positioning step comprises a step of conveying an amount of water to said first compartment from one of said one or more water conveying lines so that said unit dose package moves towards said predefined zone before said unit dose package breakage step of breaking said water-soluble pouch.

33. The method according to claim 21, wherein said positioning step comprises a step of conveying an amount of water to said first compartment from said first water conveying line so that said unit dose package moves towards said predefined zone.

34. The method according to claim 21, wherein said positioning step comprises a step of conveying an amount of water to said first compartment from a second water conveying line different from said first water conveying line so that said unit dose package moves towards said predefined zone.

35. The method according to claim 18, wherein said breakage step is carried out automatically upon detection of the presence of said unit dose package in said first compartment.

36. The method according to claim 18, wherein said treating agent is at least one of the following: a detergent, a softener, a rinse additive, a fabric conditioner, a waterproofing agent, a fabric enhancer, a rinse sanitization additive, a chlorine-based additive.

37. The method according to claim 18, wherein said pre-measured amount of treating agent is powder or liquid or paste or waxy or a gel composition or a combination thereof.

* * * * *